US007286098B2

(12) United States Patent
Ogino et al.

(10) Patent No.: US 7,286,098 B2
(45) Date of Patent: Oct. 23, 2007

(54) CIRCULAR POLARIZATION ANTENNA AND COMPOSITE ANTENNA INCLUDING THIS ANTENNA

(75) Inventors: Kazushige Ogino, Kobe (JP); Yoshio Umezawa, Kobe (JP); Kazuo Takayama, Kobe (JP); Koji Nagao, Kobe (JP); Katsuhiro Tsuruta, Kobe (JP)

(73) Assignee: Fujitsu Ten Limited, Kobe-Shi (JP)

( * ) Notice: Subject to any disclaimer, the term of this patent is extended or adjusted under 35 U.S.C. 154(b) by 169 days.

(21) Appl. No.: 10/929,758

(22) Filed: Aug. 30, 2004

(65) Prior Publication Data

US 2005/0052334 A1 Mar. 10, 2005

(30) Foreign Application Priority Data

| | | |
|---|---|---|
| Aug. 29, 2003 | (JP) | 2003-209615 |
| Feb. 19, 2004 | (JP) | 2004-043178 |
| Feb. 19, 2004 | (JP) | 2004-043239 |
| Jun. 23, 2004 | (JP) | 2004-185084 |

(51) Int. Cl.

| | |
|---|---|
| ***H01Q 19/00*** | (2006.01) |
| ***H01Q 19/10*** | (2006.01) |
| ***H01Q 1/38*** | (2006.01) |
| ***H01Q 11/12*** | (2006.01) |
| *H01Q 1/32* | (2006.01) |

(52) U.S. Cl. ..... 343/833; 343/700 MS; 343/834; 343/742

(58) Field of Classification Search ..... 343/700 MS, 343/711, 713, 742, 833, 834, 873, 844
See application file for complete search history.

(56) References Cited

U.S. PATENT DOCUMENTS 3,440,658 A 4/1969 Bogner (Continued)

FOREIGN PATENT DOCUMENTS

DE 1 860 195 10/1962

(Continued)

OTHER PUBLICATIONS

B. Cetiner et al, "Monolithic Integration of RF MEMS Switches with a Diversity Antenna on PCB Substrate"; IEEE Transactions on Microwave Theory and Techniques, vol. 51, No. 1, Jan. 2003, pp. 332-335.

(Continued)

*Primary Examiner*—Shih-Chao Chen
(74) *Attorney, Agent, or Firm*—Christie, Parker & Hale, LLP

(57) ABSTRACT

When configuring a film antenna for receiving a circular polarized wave, at least one loop antenna is formed on a transparent plastic film and, at the same time, a non-powered element constituted by a wire-shaped conductor independent from the antenna conductor configuring the loop is arranged near this loop antenna. The non-powered element arranged on the side of the loop antenna is configured by a first part and a second part. The first part is made close to the loop antenna in a substantially parallel state. When a monopole antenna is used in place of the loop antenna, by combining this with a wire-shaped conductor orthogonal to this, it becomes possible to receive a circular polarized wave by a configuration providing a power transfer part between the two. It is also possible to configure a composite antenna by mounting another antenna on the transparent plastic film. This antenna can be used as an antenna of a navigation system.

73 Claims, 48 Drawing Sheets

U.S. PATENT DOCUMENTS

| | | | | |
|---|---|---|---|---|
| 4,479,127 | A | 10/1984 | Barbano | |
| 5,083,132 | A | 1/1992 | Kanda et al. | |
| 5,115,214 | A | 5/1992 | Gassmann et al. | |
| 5,198,826 | A * | 3/1993 | Ito | 343/726 |
| 6,087,990 | A * | 7/2000 | Thill et al. | 343/700 MS |
| 6,100,804 | A | 8/2000 | Brady et al. | |
| 6,191,751 | B1 | 2/2001 | Johnson | |
| 6,211,831 | B1 | 4/2001 | Nagy et al. | |
| 6,278,413 | B1 | 8/2001 | Hugh et al. | |
| 6,333,719 | B1 | 12/2001 | Varadan et al. | |
| 6,337,668 | B1 * | 1/2002 | Ito et al. | 343/833 |
| 6,362,784 | B1 * | 3/2002 | Kane et al. | 343/700 MS |
| 6,362,788 | B1 | 3/2002 | Louzir | |
| 6,856,292 | B2 * | 2/2005 | Kuramoto et al. | 343/702 |
| 2001/0045915 | A1 | 11/2001 | Moren | |
| 2003/0080917 | A1 | 5/2003 | Adams et al. | |
| 2003/0132885 | A1 | 7/2003 | Kuramoto et al. | |
| 2003/0156069 | A1 | 8/2003 | Ooe et al. | |

FOREIGN PATENT DOCUMENTS

| | | |
|---|---|---|
| DE | 1 804 622 | 5/1970 |
| EP | 0 340 404 | 11/1989 |
| EP | 1 016 467 A2 | 7/2000 |
| EP | 1 174 946 A1 | 1/2002 |
| GB | 1 532 237 | 11/1978 |
| GB | G 2 370 158 | 6/2002 |
| JP | 61-252701 | 11/1986 |
| JP | 3-113901 | 5/1991 |
| JP | 8-321711 | 12/1996 |
| JP | 9-148838 | 6/1997 |
| JP | 10-13128 | 1/1998 |
| JP | 2000-307321 | 11/2000 |
| JP | 2002-84123 | 3/2002 |
| JP | 2002-135045 | 5/2002 |
| JP | 2003-115718 | 4/2003 |
| KR | 1998-086823 | 12/1998 |
| WO | WO96/24963 | 8/1996 |
| WO | WO97/06578 | 2/1997 |
| WO | WO 00/42649 | 7/2000 |
| WO | WO 02/065578 | 8/2002 |
| WO | WO 03/052805 | 6/2003 |
| WO | WO 03/056658 A1 | 7/2003 |

OTHER PUBLICATIONS

European Search Report, dated Feb. 28, 2006, for application No. 04255220.8, in the name of Fujitsu Ten Limited.

EPO Patent Abstracts of Japan for Publication No. 2003115718; Publication date Apr. 18, 2003, in the name of Eiji Koyama.

European Search Report, dated Nov. 25, 2005, Application No. 04255220.8, in the name of Fujitsu Ten Limited.

Patent Abstracts of Japan for Publication No. 61-252701, published Nov. 10, 1986, in the name of A. Takahashi et al.

Patent Abstracts of Japan for Publication No. 03-113901, published May 15, 1991, in the name of M. Itou.

Patent Abstracts of Japan for Publication No. 08-321711, published Dec. 3, 1996, in the name of G. Yamamoto et al.

Patent Abstracts of Japan for Publication No. 09-148838, published Jun. 6, 1997, in the name of S. Ito.

Patent Abstracts of Japan for Publication No. 10-013128, published Jan. 16, 1998, in the name of T. Taniguchi et al.

Patent Abstracts of Japan for Publication No. 2000-307321, published Nov. 2, 2000, in the name of S. Miyahara et al.

Patent Abstracts of Japan for Publication No. 2002-084123, published Mar. 22, 2002, in the name of T. Kukino et al.

Patent Abstracts of Japan for Publication No. 2002-135045, published May 10, 2002, in the name of K. Ogino.

Office Action for corresponding Korean Patent Application 10-2004-0067777 dated Apr. 24, 2006.

* cited by examiner

CIRCULAR POLARIZATION ANTENNA AND COMPOSITE ANTENNA INCLUDING THIS ANTENNA

CROSS-REFERENCE TO RELATED APPLICATION

This application claims priority from, and incorporates by reference the entire disclosure of, Japanese Patent Applications (1) No. 2003-209615, filed on Aug. 29, 2003.

(2) Nos. 2004-043178 and 2004-043239 filed on Feb. 19, 2004.

(3) No. 2004-185084, field on Jun. 23, 2004.

BACKGROUND OF THE INVENTION

1. Field of the Invention

The present invention relates to a circular polarization antenna, a composite antenna having a plurality of antennas including this antenna combined therein, and a receiver, a navigation system, etc. using this antenna, more particularly relates to a circular polarization antenna used for a film antenna used adhered to a transparent windshield etc. of a mobile body such as an automobile, an antenna formed in a transparent windshield of a mobile body such as an automobile, a composite antenna including this antenna, and a navigation system using this antenna.

2. Description of the Related Art

In recent years, along with the mounting of navigation systems into automobiles and other vehicles (mobile bodies), in addition to the antennas for receiving waves such as medium waves (MW) for AM radio, very high frequency waves (VHF) for FM radio and television, and ultra high frequency waves (UHF), high frequency band antennas for global positioning system (GPS), antennas for receiving satellite waves for satellite digital broadcasts and re-radiated waves thereof (gap-filler waves), and antennas for transmitting and receiving waves for telephones such as car phones and mobile phones are becoming necessary for vehicles. Further, for tapping into intelligent traffic systems (ITS), antennas for transmitting and receiving waves with electric toll collection (ETC) systems for automatically collecting highway and road tools and electric beacons of vehicle inembodimention communication systems (VICS) providing traffic inembodimention are becoming necessary. Further, antennas for use in keyless entry systems for remote locking/unlocking of doors, anti-theft systems, remote engine starter systems for remote starting of engines, etc. are becoming necessary. Accordingly, recent vehicles have had to mount antennas for receiving or transmitting many types of waves.

For the waves for GPS, satellite waves for satellite digital broadcasts, or waves for ETC systems among the waves to be transmitted and received by a mobile body, use is made of circular polarized waves. Patch antennas are frequently used as conventional circular polarization antennas. As such a patch antenna, a configuration arranging a planar ground conductor on one surface of a dielectric substrate made of a ceramic or the like and providing a radiating conductor on the other surface is frequently employed. As this type of patch antenna, a low profile type patch antenna used provided on a roof of an automobile or other mobile body has already been proposed. Such a patch antenna is disclosed in for example Japanese Unexamined Patent Publication (Kokai) No. 2002-135045.

However, in the patch antenna disclosed in Japanese Unexamined Patent Publication (Kokai) No. 2002-135045 etc., since a substrate was used, the thickness of the antenna was liable to end up becoming larger, reduction of thickness difficult, and the design of the vehicle impaired. Further, when not providing this patch antenna on the roof of the vehicle, but on the front windshield etc., since a patch antenna must be provided with a substrate and planar ground conductor having at least a certain area, there also exists the problem of degrading the forward field of vision of the driver.

To deal with such problems, as circular polarization antennas not degrading the forward field of vision, circular polarization antennas configured by wire-like conductors such as helical antennas or cross dipole antennas have been proposed, but the antennas of these proposals had the problems that the heights of the antennas became high and phase shifters, signal combiners, and signal distributors became necessary, so the cost became high.

SUMMARY OF THE INVENTION

An object of the present invention is to provide a circular polarization antenna arranging a wire-like conductor configuring the antenna so as to form a single plane so as to thereby reduce the thickness of the antenna and enable mounting at a vehicle, eliminate any impairment of the design of the vehicle, free from any liability of the antenna blocking the field of vision, having a simple power feed structure, and able to transmit and receive mainly circular polarized waves well.

Another object of the present invention is to provide a composite antenna reducing antenna mounting space and reducing the cost of antennas by assembling other antennas which must be mounted in the vehicle in this thin type antenna as much as possible.

Still another object of the present invention is to provide a receiver, a navigation system, etc. using this antenna by assembling the above circular polarization antenna or composite antenna on a film, correctly connecting a connector provided with a built-in low noise amplifier to power feed terminals of the antenna formed on the film to extract signals received by this antenna, and connecting this to the receiver or a navigation system to which a GPS receiver is connected or built in.

To attain the above objects, according to one aspect of the present invention, there is provided a circular polarization antenna provided with a linear polarization antenna provided with an antenna conductor for transmitting and/or receiving a linear polarized wave and a non-powered element arranged near the antenna conductor of this linear polarization antenna and constituted by a conductor independent from the antenna conductor.

To attain the above objects, according to another aspect of the present invention, there is provided a composite antenna comprised of a linear polarization antenna and a non-powered element formed one surface of a flexible sheet-like dielectric body, an adhesive layer arranged on one surface of the sheet-like dielectric body, and other antennas arranged on the same plane as the plane of arrangement of the linear polarization antenna at the sheet-like dielectric body.

To attain the above objects, according to another aspect of the present invention, there is provided a navigation system provided with a composite antenna comprised of a linear polarization antenna and a non-powered element formed on one surface of a transparent insulation film, an adhesive layer arranged on the other surface of this film, and other antennas arranged on the same plane as a plane of arrangement of the linear polarization antenna of the film, the composite antenna arranged at an outer member made of glass or an insulator of an automobile, and a receiver for receiving as input the signals from a GPS, television signals, and FM radio signals by a cable connected to power feed terminals formed on the film via a connector.

According to the present invention, a circular polarization antenna having a simple power feed structure and able to receive a circular polarized wave is provided. Further, various types of antennas can be provided on a thin type dielectric body and can be provided on a dielectric body of the vehicle, so the design of the vehicle is not liable to be impaired and the antenna is not liable to be damaged or stolen. Further, by making the thin type dielectric body a transparent film, the field of vision of the driver is not liable to be blocked. Still further, by assembling other antennas which must be mounted in the vehicle into this thin type antenna as much as possible, the space for mounting antennas for a plurality of types of waves is reduced and cables can be combined, so the mountability and attachability of the antenna to the vehicle are improved and the cost of mounting the antennas is reduced.

Further, according to the navigation system using the circular polarization antenna or the composite antenna of the present invention, a mark made around the power feed terminals of the antenna on the film enables a connector provided at the front end of an antenna cable connected to the navigation unit to be correctly connected to the power feed terminals of the GPS antenna, therefore the signal from the GPS satellite is reliably input to the navigation unit via the antenna cable, and the operation performance of the navigation unit providing route guidance by detecting the current position is not degraded.

BRIEF DESCRIPTION OF THE DRAWINGS

The present invention will be more clearly understood from the description of the preferred embodiments set forth below with reference to the accompanying drawings, wherein:

FIGS. 11A and 11B are view of examples of the configuration of the circular polarization antenna of the present invention as seen from an arrival direction of the circular polarized wave, in which FIG. 11A is a plan view of the configuration of a right-hand rotating circular polarization antenna, and FIG. 11B is a plan view showing the configuration of a left-hand rotating circular polarization antenna;

FIGS. 12A and 12B are views of examples of the configuration of the circular polarization antenna of the present invention as seen from the arrival direction of the circular polarized wave, in which FIG. 11A is a plan view of another configuration of the right-hand rotating circular polarization antenna, and FIG. 11B is a plan view of another configuration of the left-hand rotating circular polarization antenna;

FIGS. 13A to 13D are views of examples of the configuration of the loop antenna used in the circular polarization antenna of the present invention as seen from the arrival direction of the circular polarized wave, in which FIG. 13A is a view of the configuration of the loop antenna showing another example for transmitting and/or receiving the right-hand rotating circular polarized wave, FIG. 13B is a view of the configuration of the loop antenna showing another example for transmitting and/or receiving the left-hand rotating circular polarized wave, FIG. 13C is a view of the configuration of the loop antenna showing still another example for transmitting and/or receiving the right-hand rotating circular polarized wave, and FIG. 13D is a view of the configuration of the loop antenna showing still another example for transmitting and/or receiving the right-hand rotating circular polarized wave;

FIGS. 14A to 14D are views of examples of the configuration of the circular polarized wave loop antenna used in the circular polarization antenna of the present invention as seen from the arrival direction of the circular polarized wave, in which FIG. 14A is a view of an example of arranging an auxiliary conductor in a horizontal direction with respect to the position of arrangement of the loop antenna shown in FIG. 11A, FIG. 14B is a view of an example of further providing an auxiliary non-powered element the same as the non-powered element of the loop antenna shown in FIG. 11A at a point symmetric position with respect to the center point of the loop antenna, FIG. 14C is a view of an example of further arranging an auxiliary non-powered element at the outside of the non-powered element of the loop antenna shown in FIG. 11A substantially parallel to this, and FIG. 14D is a view of an example of further arranging auxiliary non-powered elements at the outside of the non-powered element of the loop antenna and the auxiliary non-powered element shown in FIG. 11B substantially parallel to them;

DESCRIPTION OF PREFERRED EMBODIMENTS

Below, a detailed explanation will be given of embodiments according to the present invention based on concrete embodiments by using the attached drawings. Note that, in general, an antenna can perform both transmit and receive waves, but in the following embodiment, for simplifying the explanation, only the case where an antenna receives waves is explained. The explanation of the case where an antenna transmits waves is omitted. Needless to say, however, the case where an antenna transmits waves is included in the present invention.

Figure 1:
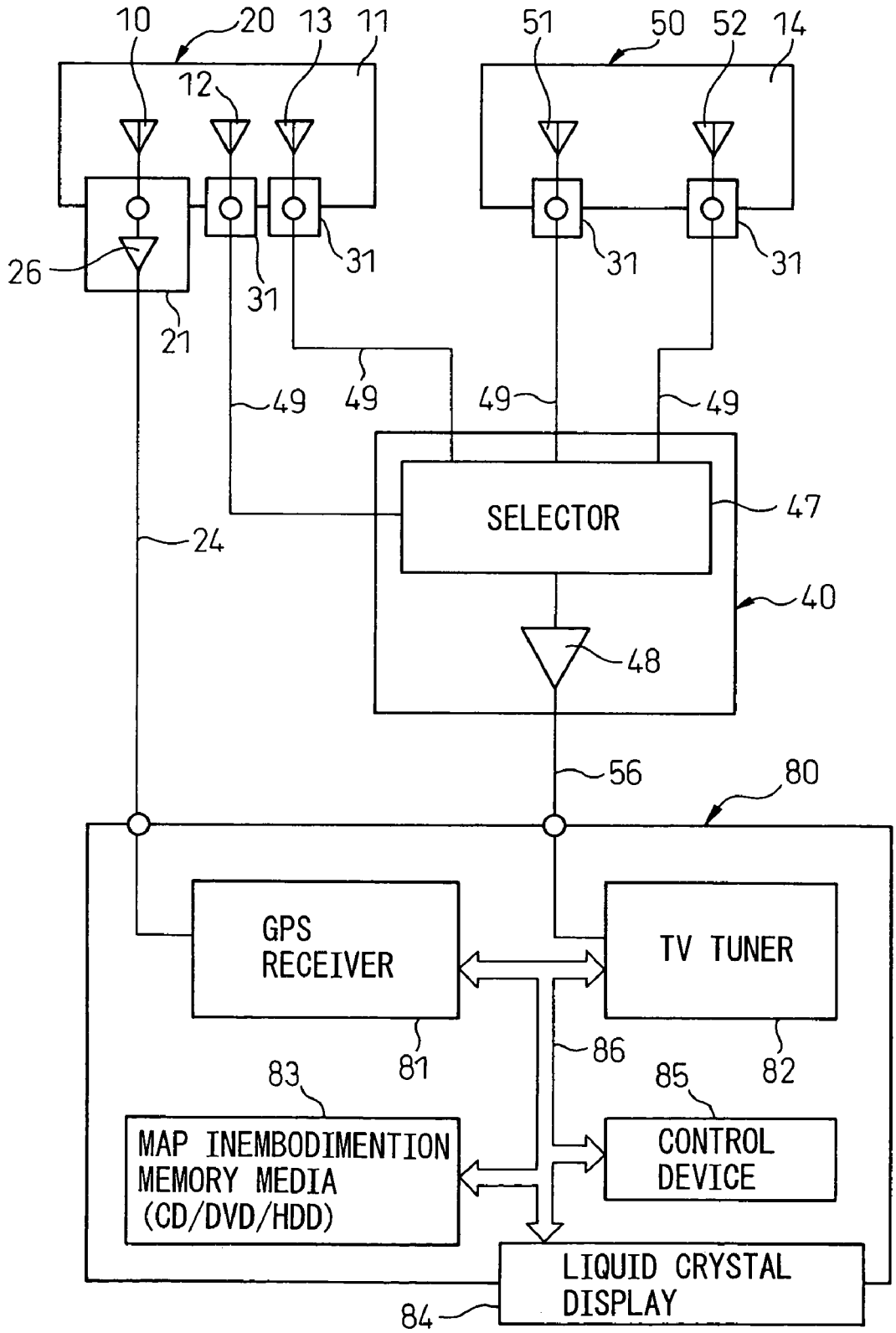
FIG. 1 is a circuit diagram of configurations of circular polarization antennas and a navigation system connected to this according to embodiments of the present invention.

FIG. 1 is a circuit diagram of the configuration of film antennas provided with circular polarization antennas of an embodiment of the present invention and a navigation system using the film antennas. The film antennas of this embodiment include a first film antenna 20 provided with a circular polarization antenna 10 and two TV antennas 12 and 13 and a second film antenna 50 provided with two TV antennas 51 and 52. The first and second film antennas 20 and 50 are constituted by transparent dielectric films (hereinafter simply referred to as "transparent films") 11 and 14.

The circular polarization antenna 10 provided in the first film antenna 20 is connected to a GPS receiver 81 built in a navigation system 80 by using a connector 21 and a coaxial cable 24. In this embodiment, an amplifier 26 is built in the connector 21. The wave received at the circular polarization antenna 10 is amplified at the amplifier 26 and output.

Further, the TV antennas 12 and 13 provided in the first film antenna 20 are connected to a selector 47 of a selector/amplifier 40 by a connector 31, a not illustrated cable, and a coaxial cable 49. On the other hand, the two TV antennas 51 and 52 provided at the second film antenna 50 are connected to the selector 47 of the selector/amplifier 40 by the connector 31, a not illustrated cable 2, and the coaxial cable 49. The selector 47 selects a TV antenna having a high reception sensitivity (either of the TV antennas 12, 13, 51, and 52), and switches the TV antenna so that the output thereof is output to the amplifier 48. As a result, one of the TV antennas 12, 13, 51, and 52 is connected to a TV tuner 82 built in the navigation system 80 through the selector/amplifier 40 and a coaxial cable 56. All of the TV antennas 12, 13, 51, and 52 can receive TV broadcast waves and FM broadcast waves.

The navigation system 80, other than the GPS receiver 81 and the TV tuner 82, includes a memory medium 83 configured by a CD, DVD, or HDD for storing map inembodimention, a liquid crystal display 84 serving as a display unit for displaying the map and the TV, and a control device 85 for computing the present position, route guidance, etc. all connected to each other by an internal bus 86. The TV tuner 82 and the liquid crystal display 84 are sometimes provided integrally in the navigation system 80 as well, but are sometimes separately independently provided as well. Further, the selector/amplifier 40 is sometimes built in the navigation system 80 as well.

When the navigation system 80 is in navigation mode, the control device 85 computes the present position based on the signal from the GPS satellite received by the circular polarization antenna 10 and the GPS receiver 81, reads out a map corresponding to this present position from the map inembodimention memory media 83, and displays the map on the liquid crystal display 84 and, at the same time, displays the present position on this map. Further, where a destination is input, it is also possible for the control device 85 to compute the route up to this destination and display it on the map. Further, when the navigation system 80 is in the navigation mode, the control device 85 computes the present position based on the signal from the GPS satellite received by the circular polarization antenna 10 and the GPS receiver 81, reads out a map corresponding to this present position from the map inembodimention memory media 83, and displays the map on the liquid crystal display 84 and, at the same time, displays the present position on this map. Where the navigation system 80 is in a TV mode, the control device 85 receives the TV broadcast by either of the TV antennas 12, 13, 51, and 52 and the TV tuner 82 and displays the received TV broadcast on the liquid crystal display 84.

Figure 2A:
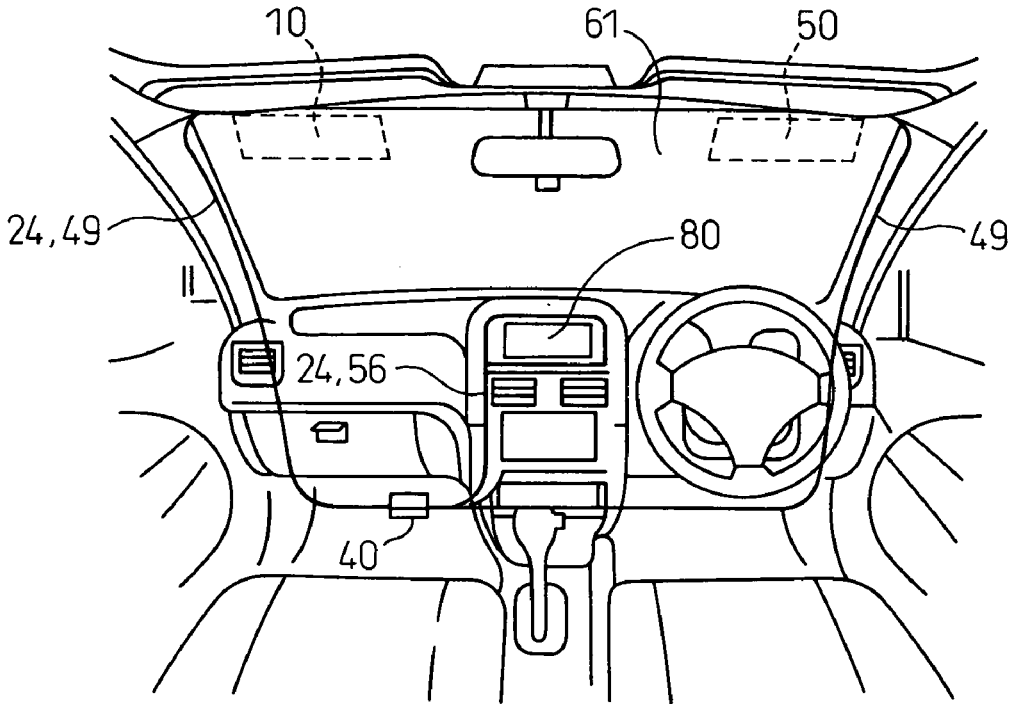
FIG. 2A is a perspective view of the front in a compartment of an automobile showing positions of attachment of film antennas provided at a windshield of the automobile and the connection between the antennas and the navigation system.

FIG. 2A shows positions of arrangement of the first and second film antennas 10 and 50 and the navigation system 80 shown in FIG. 1 in an automobile. The first and second film antennas 10 and 50 are arranged at the top left and right of a windshield 61 of the automobile. The navigation system 80 is built in an instrument panel of the automobile, and the selector/amplifier 40 is built in the base of the front passenger's seat. Cables 24 and 49 from the first and second film antennas 20 and 50 are attached along an A pillar of the automobile and directly connected to the navigation system 80 or connected to the navigation system 80 through the selector/amplifier 40 and cables 24 and 56.

Figure 2B:
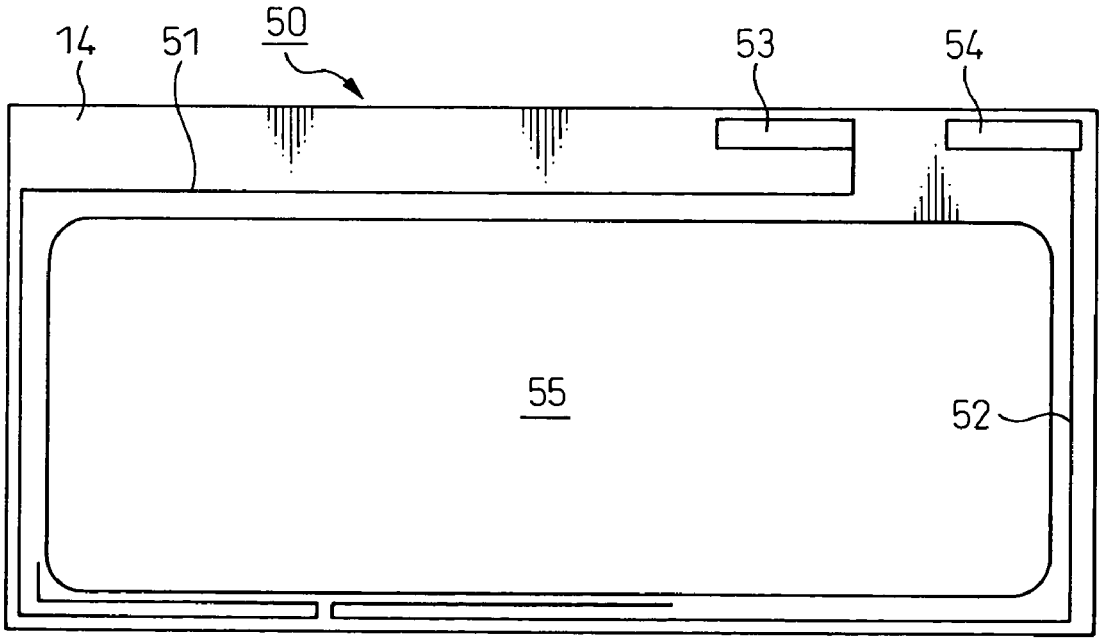
FIG. 2B is a plan view of details of the configuration of one film antenna of FIG. 2A and shows a configuration in which two TV signal antennas are provided at the film.

FIG. 2B shows the detailed configuration of the second film antenna 50 shown in FIG. 1. The second film antenna 50 is provided with two TV antennas 51 and 52 for receiving the TV signals on the transparent film 14. The second film antenna 50 is arranged inside the windshield of the automobile by using two-sided adhesive tape.

The state of FIG. 2B is one viewing the second film antenna 50 from the inside of the compartment of the automobile. Two TV antennas 51 and 52 are provided along the peripheral portion of the transparent film 14. In this embodiment, the part of the transparent film 14 where the two TV antennas 51 and 52 are not provided is cut away and becomes an aperture part 55. Further, antenna connection terminals 53 and 54 are provided at ends of the wire-like conductors constituting the TV antennas 51 and 52. The antenna connection terminals 53 and 54 are provided in the top right of the transparent film 14 in this embodiment. The TV antennas 51 and 52 and the antenna connection terminals 53 and 54 are formed by conductive ink or conductive foil such as copper foil.

The TV antennas 51 and 52 formed on the transparent film 14 are provided with protective films for protecting the TV antennas 51 and 52. On the other hand, no protective films are provided on the antenna connection terminals 53 and 54. This is because cables 49 are connected to the antenna connection terminals 53 and 54 via the connectors 31 shown in FIG. 1. The signals obtained from waves received by the TV antennas 51 and 52 are guided to the selector/amplifier 40 through the connectors 31 and the cables 49 connected to the antenna connection terminals 53 and 54. The signal from the selector/amplifier 40 is guided to the TV tuner 82 through the cable 56.

Figure 3:
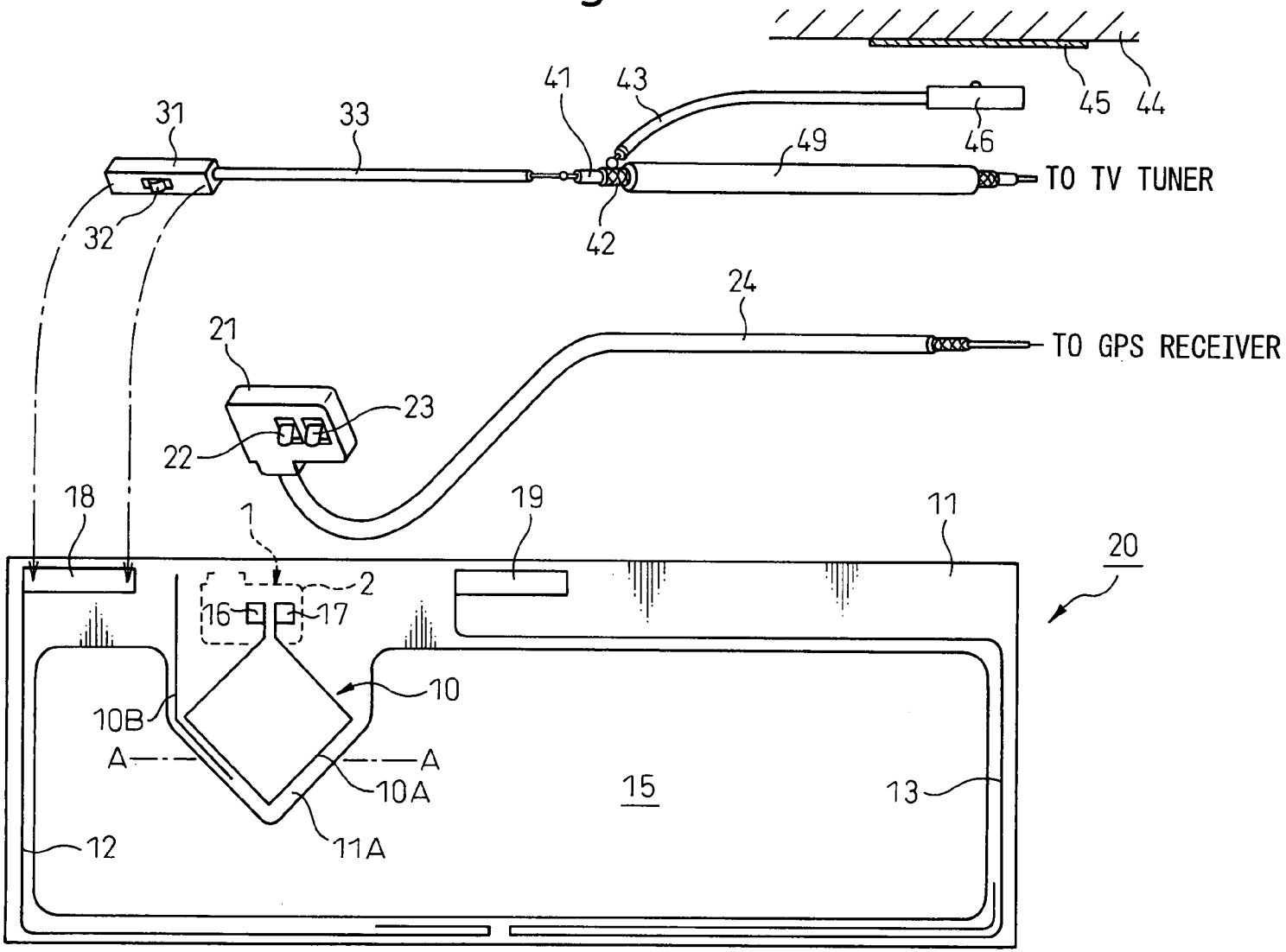
FIG. 3 is a plan view of an example of the configuration of the other film antenna of FIG. 2A, explains a cable connected to this, and shows a configuration in which a first embodiment of the circular polarization antenna, two TV signal antennas, and a mark indicating a position of arrangement of the connector connected to the circular polarization antenna are provided on the film.

FIG. 3 shows the configuration of an embodiment of the first film antenna 20 shown in FIG. 1 and details of the connector and the cable connected to the first film antenna 20. The first film antenna 20 is provided with two TV antennas 12 and 13 for receiving TV signals, one loop-like circular polarization antenna 10 for receiving the circular polarized wave, and a mark 1 indicating an attachment position of the connector to be connected to the circular polarization antenna on the transparent film 11. The circular polarization antenna 10 of this example is a right-hand rotating circular polarization antenna and provided with a loop antenna 10A and a non-powered element 10B. The first film antenna 20 is arranged inside the windshield of the automobile by using two-sided adhesive tape.

The state of FIG. 3 is one viewing the first film antenna 20 from the inside of the compartment of the automobile. The TV antennas 12 and 13 are provided along the peripheral portion of the transparent film 11, and the front ends are bent. The antenna connection terminals 18 and 19 are provided at ends of the wire-like conductors constituting the TV antennas 12 and 13. In this embodiment, the part of the transparent film 11 where the circular polarization antenna 10 and the TV antennas 12 and 13 are not provided is cut away and becomes an aperture part 15. This aperture part 15 is provided so as to surround the part of the transparent film 11A in which the circular polarization antenna 10 is arranged. The part of the transparent film 11A in which the circular polarization antenna 10 is arranged becomes a tongue part 11A. Further, the end of the power feed side of the loop antenna 10A constituting the circular polarization antenna 10 is formed in the form of lands which become power feed terminals 16 and 17.

The antenna connection terminals 18 and 19 are provided at the two sides of the circular polarization antenna 10 in this embodiment. The loop antenna 10A and the non-powered element 10B and the TV antennas 12 and 13 and the antenna connection terminals 18 and 19 are formed by conductive ink or conductive foil such as copper foil. Protective films for protection are provided on the loop antenna 10A and the non-powered element 10B formed on the transparent film 11 and the TV antennas 12 and 13. However, no protective films are provided on the power feed terminals 16 and 17 and the antenna connection terminals 18 and 19. This is because the cable 24 is connected to the power feed terminals 16 and 17 via the connector 21 shown in FIG. 1, and the cables 49 are connected to the antenna connection terminals 18 and 19 via the connectors 31 shown in FIG. 1.

Here, an explanation will be given of the connector 21 and the cable 24 connected to it and the connectors 31 and the cables 49 connected to them.

First, the connectors 31 provided with the connection terminals 32 are connected to the antenna connection terminals 18 and 19 of the TV antennas 12 and 13. The connection terminals 32 are provided with a spring property. Two-sided adhesive tapes are adhered to the antenna connection terminals 18 and 19 of the connectors 31. The outer shapes of the surfaces of the connectors 31 provided with the connection terminals 32 are almost the same as the outer shapes of the antenna connection terminals 18 and 19. Accordingly, when the connectors 31 are connected to the antenna connection terminals 18 and 19, they may be attached by peeling off peeling sheets of the two-sided adhesive tapes and superposing the connectors 31 on the antenna connection terminals 18 and 19, that is, hiding the antenna connection terminals 18 and 19 the connectors 31.

On the other hand, the cables 49 comprised of coaxial cables are actually connected by connecting core wires 41 thereof to the connectors 31 via other single-core cables 33. The ground lines 42 of the coaxial cables 49 are guided to parts of the body 44 of the automobile by other single-core cables 43 and connected to metal foil 45 attached to this body 44 by the connectors 46. Namely, the ground lines 42 of the coaxial cables 49 are AC grounded to the body 44 of the automobile.

In this way, signals obtained from the waves received at the TV antennas 12 and 13 are guided to a not illustrated selector/amplifier 40 by the antenna connection terminals 18 and 19, the connectors 31, the cables 33, and the cables 49 connected to them, and a signal from the selector/amplifier 40 is guided to a not illustrated TV tuner through the cable 56.

Next, an explanation will be given of the connector 21 and the cable 24 connected to this. The connector 21 includes connection terminals 22 and 23 connected to the power feed terminals 16 and 17 of the circular polarization antenna 10. The two connection terminals 22 and 23 are provided with a spring property in this embodiment. The connector 21 may be attached to the transparent film 11 by for example two-sided adhesive tape. Inside the connector 21, the amplifier shown in FIG. 1 for amplifying the received signal is mounted. The cable 24 connected to the connector 21 is a coaxial cable. The waves received at the circular polarization antenna 10 can be guided to a predetermined receiver, for example, the GPS receiver, via the power feed terminals 16 and 17, the connector 21, and the cable 24.

When the connectors 31 are connected to the antenna connection terminals 18 and 19 of the TV antennas 12 and 13, if they are attached so that the connectors 31 are superimposed on the antenna connection terminals 18 and 19, that is, the antenna connection terminals 18 and 19 are hidden by the connectors 31, the connection terminals 32 of the connectors 31 can be reliably connected to the antenna connection terminals 18 and 19.

Where the connector 21 is connected to the power feed terminals 16 and 17 of the circular polarization antenna 10, however, the outer shape of the connector 21 is larger than those of the power feed terminals 16 and 17. Accordingly, conventionally, it was difficult to correctly connect the connection terminals 22 and 23 of the connector 21 onto the power feed terminals 16 and 17. If the connection terminals 22 and 23 of the connector 21 are not correctly connected to the power feed terminals 16 and 17, the reception sensitivity of the circular polarization antenna 10 is lowered, and the full performance of the navigation system cannot be exhibited.

Therefore, in the first film antenna 20 of this embodiment, as shown in FIG. 3, the mark 1 of the first embodiment indicating the connection position of the connector 21 is formed around the power feed terminals 16 and 17 of the circular polarization antenna 10 of the transparent film 11. In the mark 1 of the first embodiment, the mark 1 is formed by the same material as that of the circular polarization antenna 10, the TV antennas 12 and 13, the power feed terminals 16 and 17, and the antenna connection terminals 18 and 19, and simultaneously with them. Namely, the mark 1 can be formed by conductive ink or a conductor foil such as copper foil.

Further, in the first embodiment of this mark 1, the mark 1 is formed a broken line or a dotted line 2. This is because if the mark 1 is formed by a continuous straight line, this continuous straight line will function as an antenna, so will exert influence upon the reception performance of the circular polarization antenna 10.

Figure 4A:
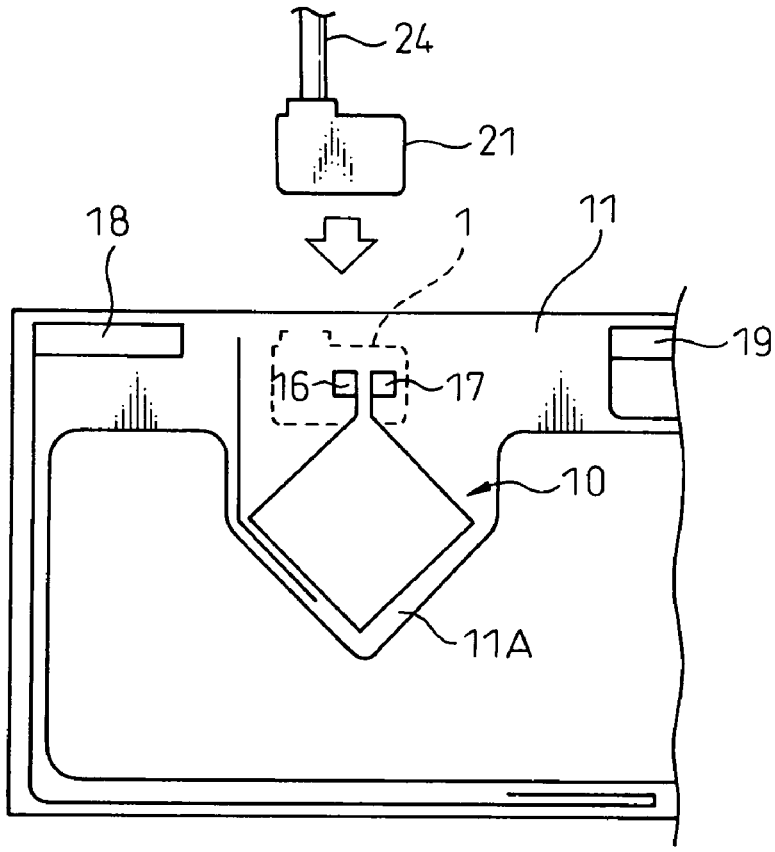
FIG. 4A is an explanatory view of the state before the connector is attached to the film antenna shown in FIG. 3.
Figure 4B:
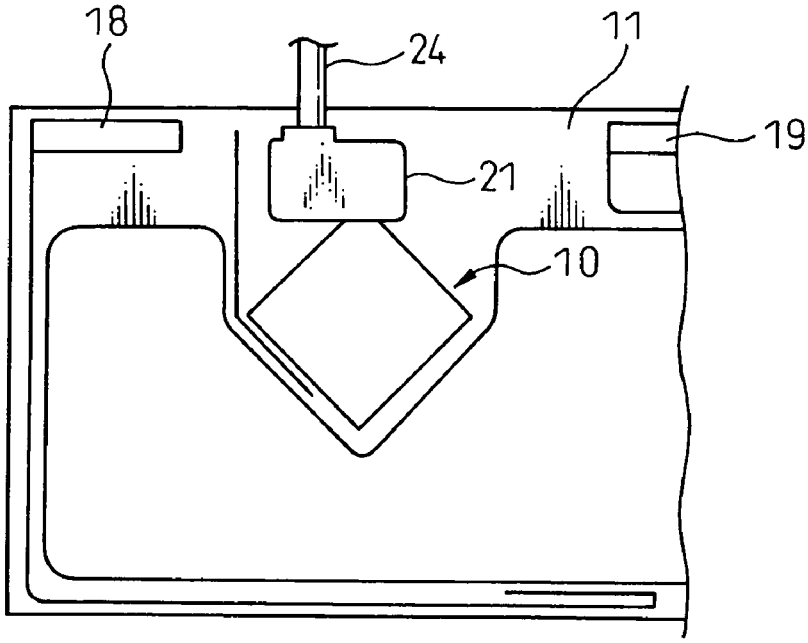
FIG. 4B is an explanatory view of a state where the connector is attached to the film antenna shown in FIG. 4A and the first embodiment of the mark is hidden.

FIG. 4A shows an embodiment of the mark in which the outer shape of the mark 1 formed by the broken line or dotted line is made the same as the outer dimensions of the connector 21. In the second embodiment, if peeling off the peeling sheets of the two-sided adhesive tape, then, as shown in FIG. 4B, adhering the connector 21 onto the transparent film 11 so that the mark 1 is hidden by the connector 21, the connection terminals 22 and 23 of the connector 21 can be correctly connected to the power feed terminals 16 and 17 on the transparent film 11.

Figure 5A:
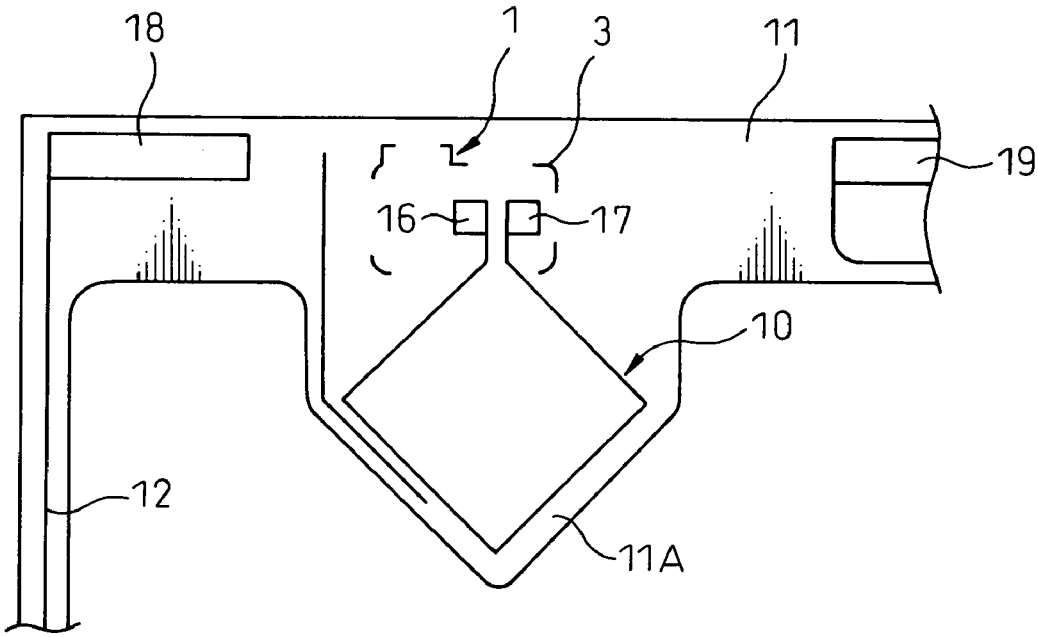
FIG. 5A is a partially enlarged view of a film antenna showing a second embodiment of the mark on the film antenna shown in FIG. 3.

FIG. 5A shows a second embodiment in which the mark 1 is formed by brackets 3. The brackets 3 may be formed at positions indicating four corner portions of the connector 21 so as to be hidden by the connector 21 or at positions of an outer shape slightly larger than the outer shape of the connector 21. The shape of the mark 1 is not limited to these brackets 3.

Figure 5B:
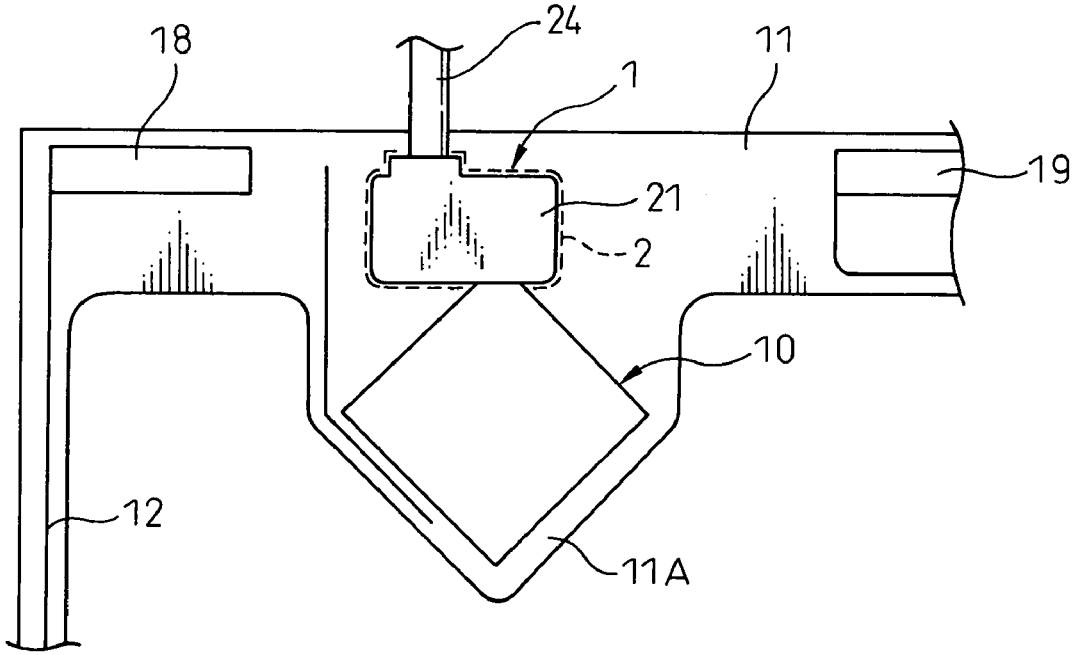
FIG. 5B is a partially enlarged view of the film antenna showing a third embodiment of the mark on the film antenna shown in FIG. 3.

FIG. 5B shows a third embodiment in which the mark 1 is formed by a broken line or dotted line 2. In the embodiment shown in FIG. 4A, the outer shape of the mark 1 was formed to the same as the outer shape of the connector 21, but in the third embodiment shown in FIG. 5B, the outer shape of the mark 1 is formed slightly larger than the outer shape of the connector 21. In this case, as shown in this figure, when the connector 21 is adhered onto the transparent film 11 so that the mark 1 appears as if evenly bulging out to the outside of the connector 21, the connection terminals 22 and 23 of the connector 21 can be correctly connected to the power feed terminals 16 and 17 on the transparent film 11.

Figure 5C:
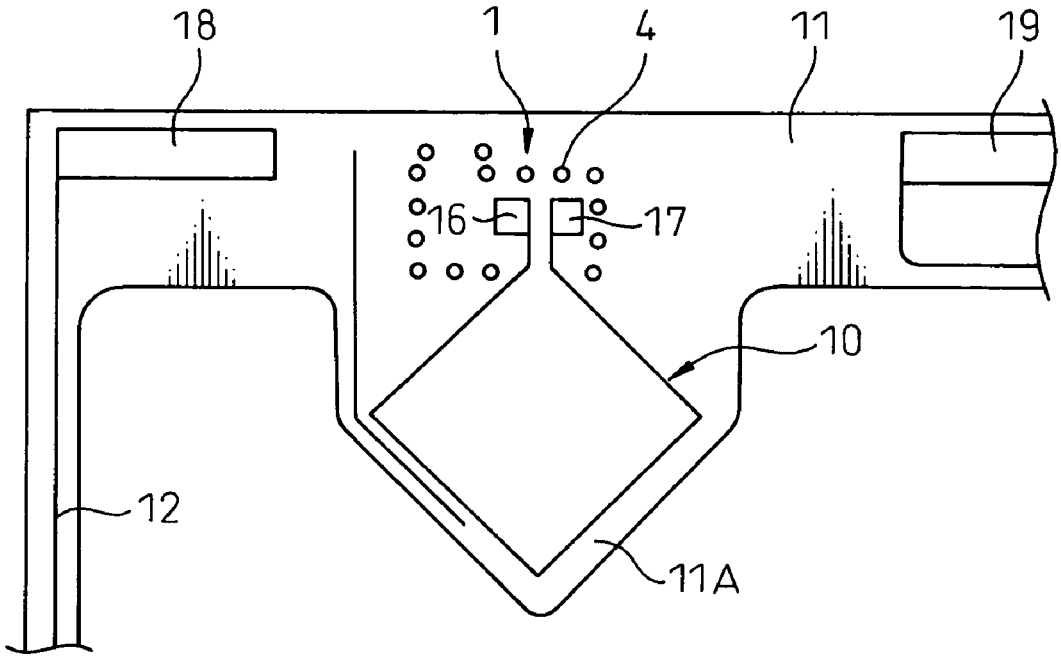
FIG. 5C is a partially enlarged view of the film antenna showing a fourth embodiment of the mark on the film antenna shown in FIG. 3.

FIG. 5C shows a fourth embodiment in which the mark 1 is formed by a plurality of small apertures 4 formed in the transparent film 11. In the fourth embodiment, the outer shape of the mark 1 formed by the small apertures 4 is made the same as the outer shape dimension of the connector 21. Accordingly, in the fourth embodiment, if peeling off the peeling sheet of the two-sided adhesive tape, then attaching the connector 21 onto the transparent film 11 so that the mark 1 is hidden by the connector 21, a state the same as the state shown in FIG. 4B is exhibited, and it becomes possible to correctly connect the connection terminals 22 and 23 of the connector 21 to the power feed terminals 16 and 17 of the transparent film 11.

Figure 5D:
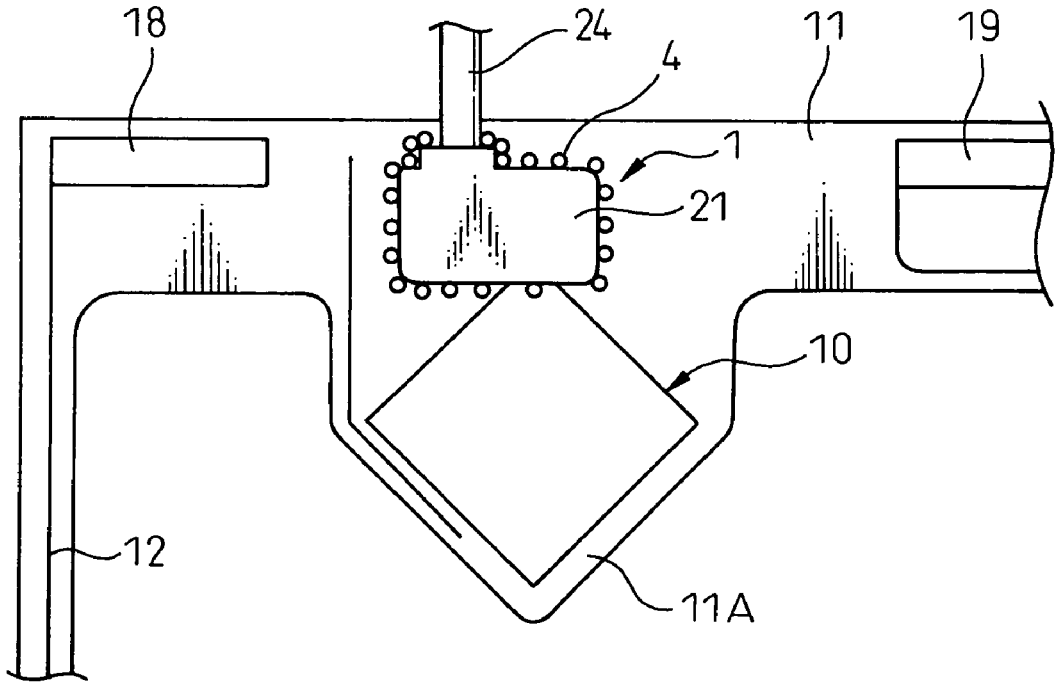
FIG. 5D is a partially enlarged view of the film antenna showing a fifth embodiment of the mark on the film antenna shown in FIG. 3.

On the other hand, FIG. 5D shows a fifth embodiment in which the mark 1 is formed by a plurality of small apertures 4 formed in the transparent film 11. In the fifth embodiment, the outer shape of the mark 1 formed by the small apertures 4 is formed slightly larger than the outer shape of the connector 21. In this case, as shown in FIG. 5D, when the connector 21 is adhered onto the transparent film 11 so that appears to bulge out in the state where the small apertures 4 contact the outside of the connector 21, the connection terminals 22 and 23 of the connector 21 can be correctly connected to the power feed terminals 16 and 17 of the transparent film 11. Note that it is sufficient so far as the broken line or dotted line 2, the bracket 3, and small apertures 4 constituting the mark 1 can correctly connect the connector 21. They are not limited to the above embodiments.

Figure 6A:
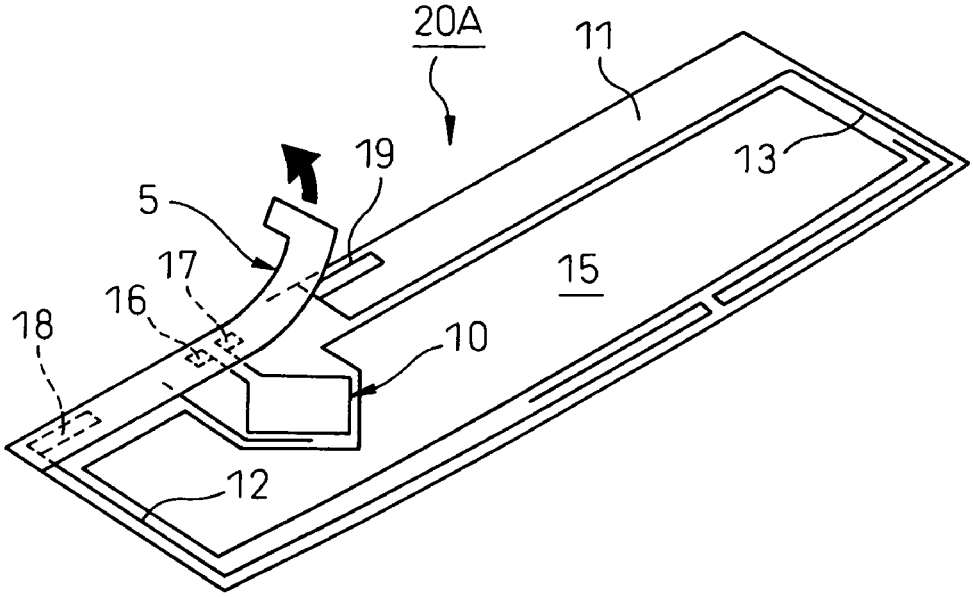
FIG. 6A is a perspective view of the state where a protective sheet adhered to a connection terminal of an antenna provided at the film antenna shown in FIG. 3 is peeled off.
Figure 6B:
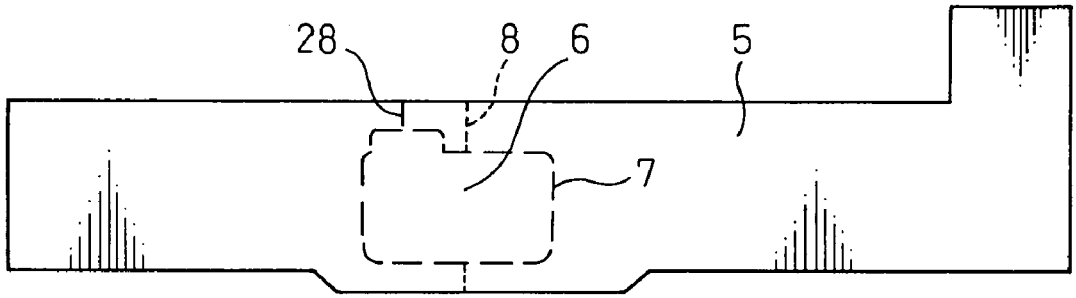
FIG. 6B is an enlarged view of the protective sheet shown in FIG. 6A.
Figure 6C:
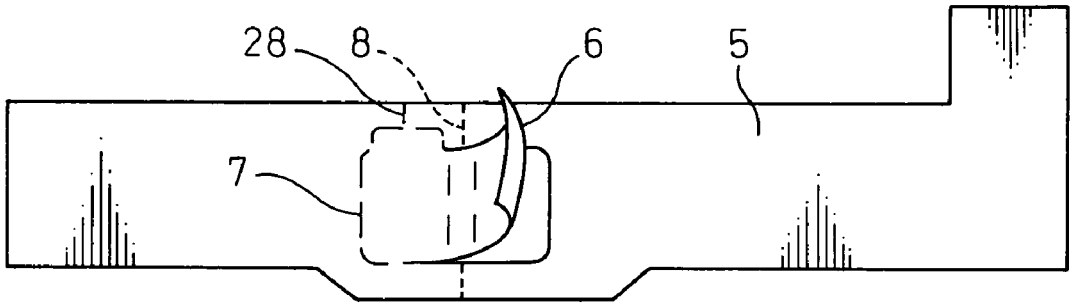
FIG. 6C is a view for explaining a state where a cut part of the protective sheet shown in FIG. 6B is removed from the protective sheet.

FIGS. 6A to 6C show the configuration of the first film antenna 20A as a modification of the first film antenna 20 mentioned above. In the first film antenna 20A, in the same way as the first film antenna 20 shown in FIG. 3, the periphery of the aperture part 15 provided at the center of the transparent film 11 is provided with two TV antennas 12 and 13 for receiving the TV signals, the loop-like circular polarization antenna 10 for receiving the circular polarized wave, antenna connection terminals 18 and 19 connected to the TV antennas 12 and 13, and power feed terminals 16 and 17 of the circular polarization antenna 10. The difference of the first film antenna 20A from the first film antenna 20 resides in the point that no mark 1 is made at the periphery of the power feed terminals 16 and 17.

As mentioned above, the transparent film 11 is not provided with any protective film at the parts of the power feed terminals 16 and 17 and the antenna connection terminals 18 and 19 formed by the conductive ink or the conductor foil such as copper foil, that is, the conductive parts are exposed. Therefore, the exposed terminal parts of the film antennas 20 and 50, like the first film antenna 20A shown in FIG. 6A, are provided with detachable protective sheets 5 covering the exposed terminal parts. The protective sheets 5 are peeled off when connecting the connectors 21 and 31 to the first film antenna 20A. The protective sheets 5 can be correctly adhered onto the transparent film 11 by positioning by using a fixture at the time of the temporary adhesion onto the transparent film 11.

The inventors took note of this point and, in the first film antenna 20A, as shown in FIG. 6B, provided a cut part 6 indicating the correct attachment position of the connector at a part of this protective sheet 5 facing the power feed terminals 16 and 17 of the transparent film 11. This cut part 6 can be independently detached from the protective sheet 5 by a perforation 7. Further, another perforation 8 indicated by the broken line or a cut 28 indicated by the solid line able to divide the protective sheet 5 to two left and right parts is provided in the width direction of the protective sheet 5 at the position of provision of this cut part 6. This is necessary for detaching the protective sheet 5 from the transparent film 11 after the connector is attached onto the transparent film 11. The outer shape of the cut part 6 may be made the same as the outer shape of the connector 21 or slightly larger than the outer shape of the connector 21. Note that the perforations 7 and 8 and the cut 28 need only show the tearing line and are not limited to those of the above embodiment.

In the first film antenna 20A shown in FIG. 6B, when connecting the connector 21 to the transparent film 11, before peeling off the protective sheet 5 from the transparent film 11, as shown in FIG. 6C, the cut part 6 is removed from the protective sheet 5. Then, the connector 21 is fit in the aperture formed after the cut part 6 is removed, and the connector 21 is adhered onto the transparent film 11. At this time, care is taken to prevent the connector 21 from riding up over the protective sheet 5. By doing this, the connection terminals 22 and 23 of the connector 21 are correctly connected to the power feed terminals 16 and 17. Next, the remaining parts of the protective sheet 5 are peeled off from the transparent film 11. When peeling, if a perforation 8 is provided, by tearing along the perforation 8 to divide the protective sheet 5 to two, the parts of the protective sheet 5 can be easily removed from the transparent film 11. Further, if a cut 28 is provided, by passing the connector or the coaxial cable connected to the connector through the portion of this cut 28, the protective sheet 5 can be easily removed from the transparent film 11. Thereafter, the connectors 31 may be connected to the exposed antenna terminal terminals 18 and 19 as shown in FIG. 3.

Figure 7:
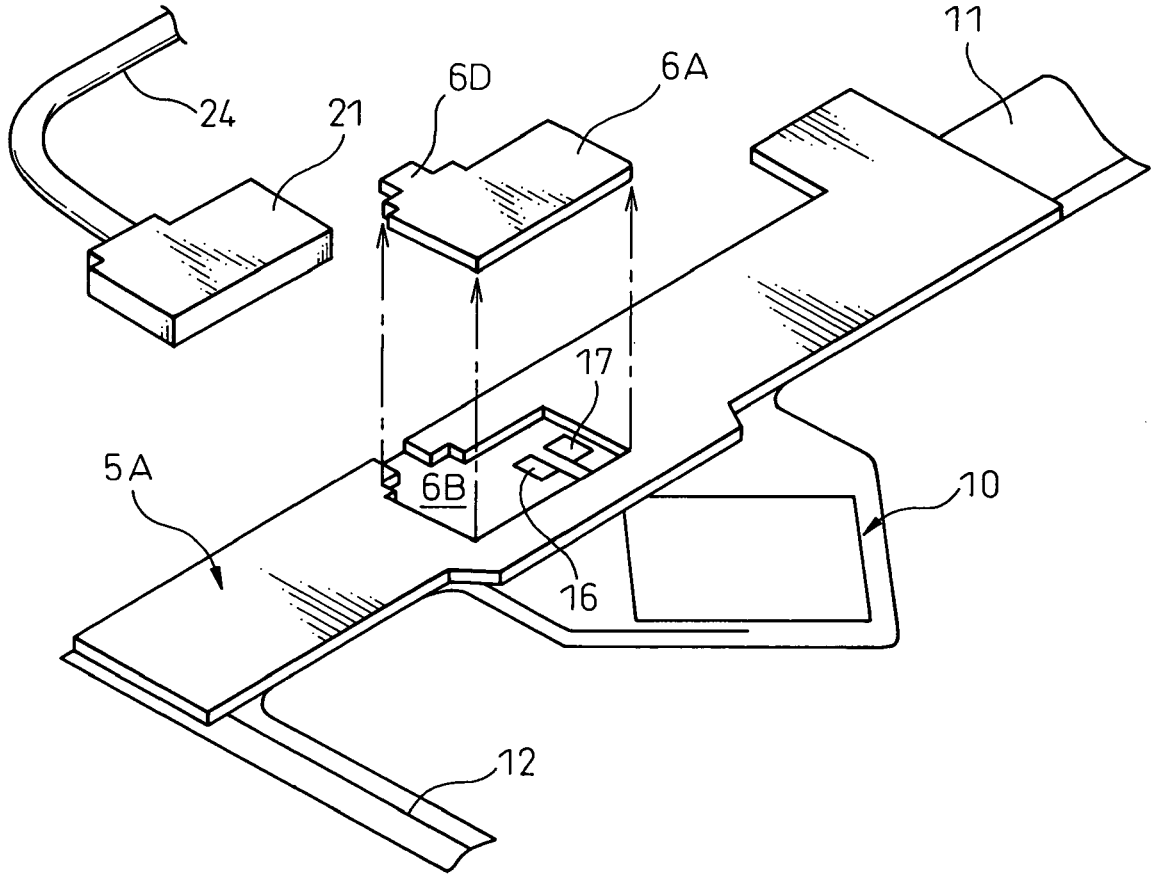
FIG. 7 is a partially enlarged perspective view of the configuration of a modification of the protective sheet.

FIG. 7 shows the configuration of a protective sheet 5A as a modification of the protective sheet 5 mentioned above. The protective sheet 5 shown in FIGS. 6A to 6C is a sticky tape such as a PVC tape. There is almost no thickness to the protective sheet 5 per se. When the connector 21 is fit in the aperture formed after the cut part 6 is removed, the aperture part of the protective sheet 5 only functions like the mark 1 at the first film antenna 20 mentioned above. On the other hand, the protective sheet 5A shown in FIG. 7 is formed by for example a flexible member having a predetermined thickness of about 1 mm. In the same way as the above embodiment, a part of the protective sheet 5A facing the power feed terminals 16 and 17 of the transparent film 11 is provided with a cut part 6A indicating the correct attachment position of the connector 21. Since the protective sheet 5A is thick, the cut part 6A can be provided not by forming a perforation, but by forming a cut in the protective sheet 5A. A tongue part 6D provided in the cut part 6A is for forming a recess on the transparent film 11 for receiving the coaxial cable 24 when the connector 21 is attached to the transparent film 11.

In this modification, when the cut part 6 is removed from the protective sheet 5A in the state adhered to the transparent film 11, a step difference is formed around the remaining aperture 6B. Accordingly, when the connector 21 is fit in this aperture 6B, this step difference serves as a guide which makes the attachment of the connector 21 to the transparent film 11 very easy.

Figure 8A:
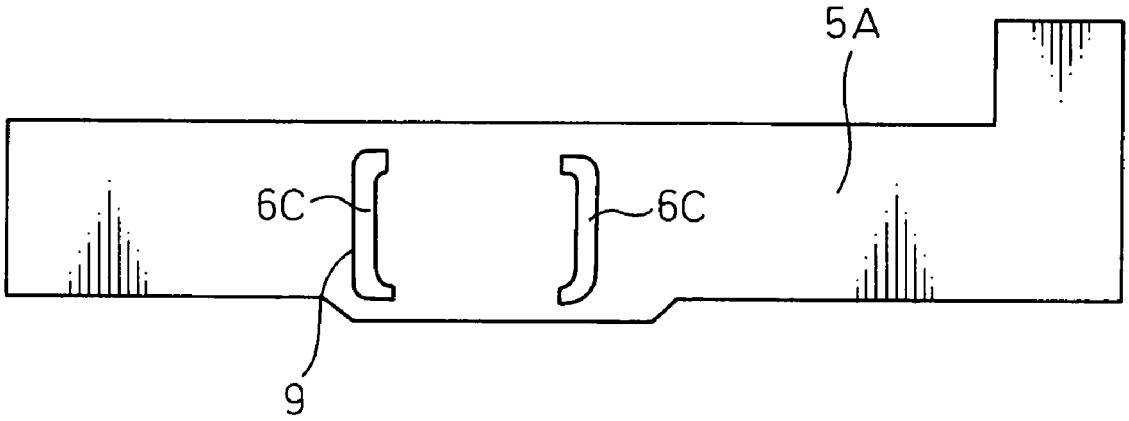
FIG. 8A is a plan view of the configuration of another modification of the protective sheet.
Figure 8B:
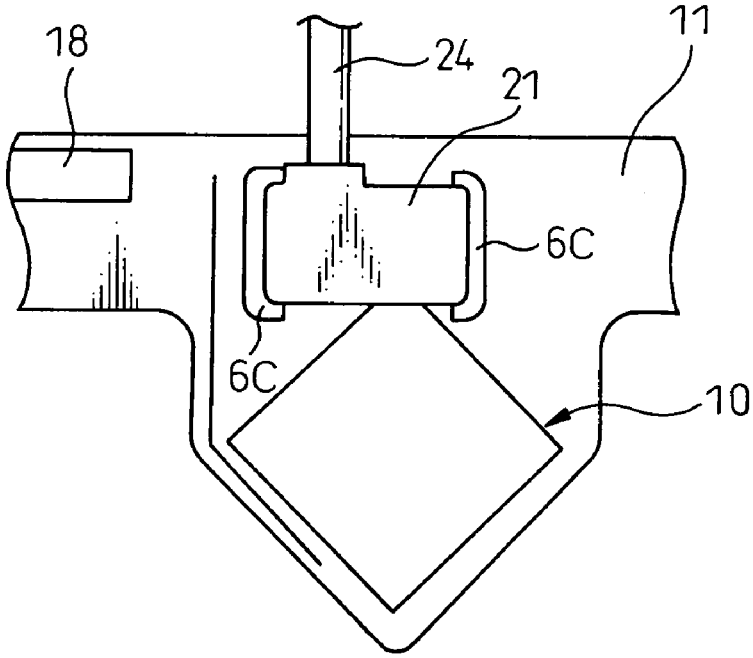
FIG. 8B is a partially enlarged plan view of a state where only a guide part of the protective sheet of FIG. 8A is left and the rest of the protective sheet is removed.

Further, as a modification of the thick protective sheet 5A, as shown in FIG. 8A, it is also possible to provide the cut part 6A and a guide part 6C in the protective sheet 5A by a cut 9. In this modification, after the cut part 6 is removed from the protective sheet 5A in the state adhered to the transparent film 11, the body of the sheet is removed leaving only the guide part 6C. Therefore, only the guide part 6C remains on the transparent film 11. Since this guide part 6C has the above thickness, if attaching the connector 21 onto the transparent film 11 abutting against the guide part 6C, the attachment of the connector 21 to the transparent film 11 becomes very easy.

The first and second film antennas 20, 20A, and 50 of the present invention can be provided by adhering them to the windshield, rear window, side window, etc. of an automobile from the back surface thereof and can be effectively used as antennas of a navigation system.

Further, in the above explained embodiment, the case where only one circular polarization antenna 10 was formed on the first film antennas 20 and 20A was explained, but even when providing more than one circular polarization antenna provided with the power feed terminals on the first film antenna 20, the mark of this embodiment can be effectively applied. Further, the application of the mark of this embodiment is not limited to only the above circular polarization antenna. It can be effectively applied to any other antenna provided with a plurality of power feed terminals for which positioning precision of the connector connected onto the film is required. Still further, even when there is only one power feed terminal on the film and even when the size of the power feed terminal cannot be made as large as the connector and positioning precision is required in the connector connected onto the film, the mark can be effectively applied.

Figure 22A:
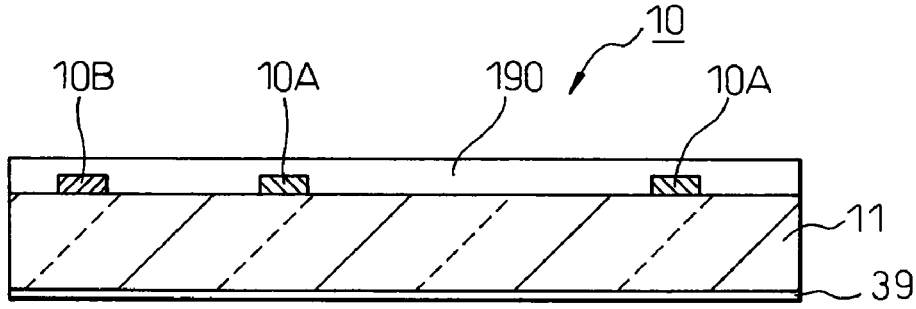
FIG. 22A is a local sectional view taken along a line A-A of FIG. 3.
Figure 22B:
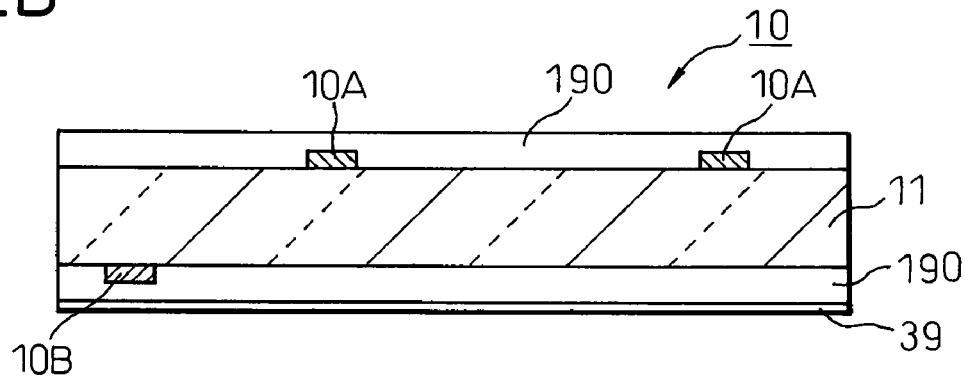
FIG. 22B is a local sectional view of the configuration of the modification of FIG. 17A.

Note that a sectional view taken along a line A-A of the loop antenna 10A provided in the first film antenna 10 shown in FIG. 3 is shown in FIG. 22A. Reference numeral 190 of the figure is the protective film. This film antenna 20 can be adhered to the back surface (inside the compartment) of the windshield 61 of the automobile shown in FIG. 2A by a two-sided adhesive tape 39 adhered to the surface opposite to the protective film 190. Further, as another embodiment, it is possible to provide the loop antenna 10A on one surface of the transparent film 11 and provide the non-powered element 10B on the other surface of the transparent film 11. This embodiment is shown in FIG. 22B. In this embodiment, protective films 190 are provided on both surfaces of the transparent film 11, and the two-sided adhesive tape 39 is adhered to the surface on the side having the non-powered element 10B. In this way, even if the non-powered element 10B is not on the same surface as the antenna conductor of the loop antenna 10A, the invention is effective if it is in proximity to the antenna conductor. Further, it is also possible to provide the loop antenna and the non-powered element on one surface and provide another antenna on the other surface.

Figure 22C:
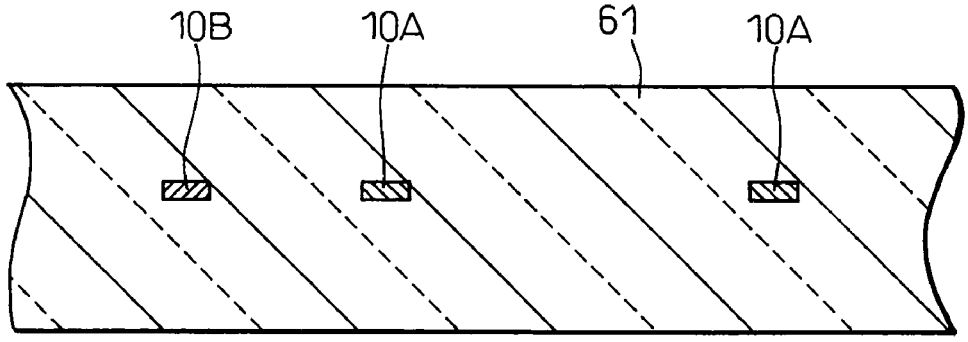
FIG. 22C is a partially sectional view of the state where the loop antenna of the present invention is embedded in a windshield of an automobile or other dielectric body.

As still another embodiment, it is also possible to build the film antenna 20 and second film antenna 50 in the windshield 61 of the automobile. The embodiment is shown in FIG. 22C. FIG. 22C is a partial sectional view of the windshield 61 of an automobile at the same position as that of FIG. 22A.

Figure 9A:
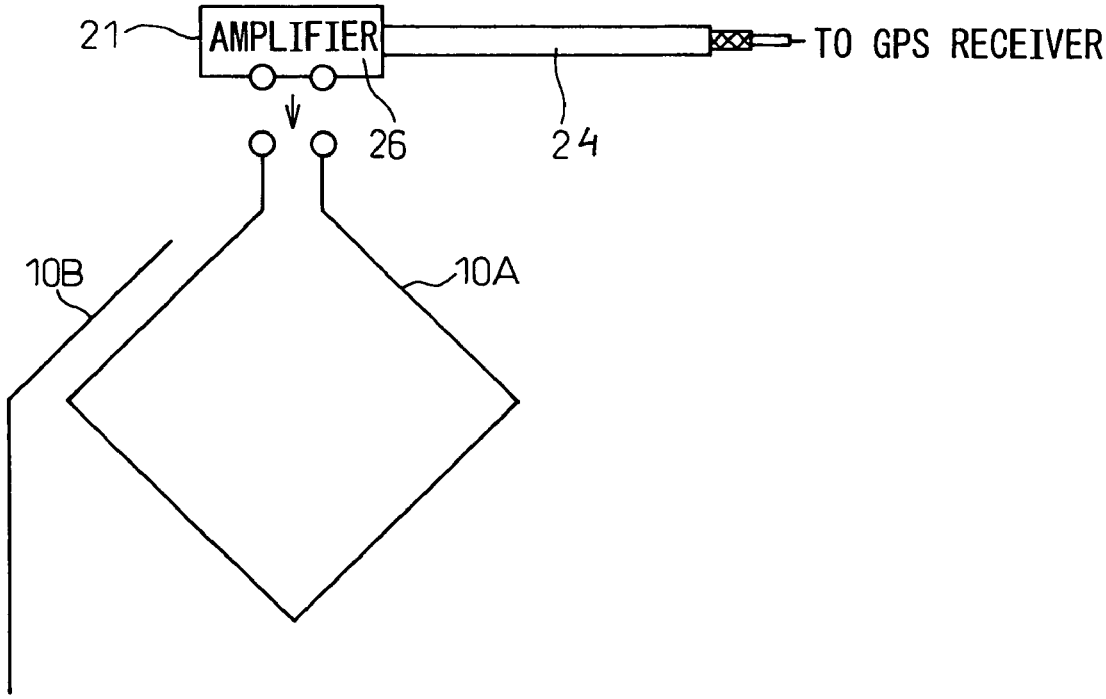
FIG. 9A is a view for explaining the connection between a loop antenna shown in FIG. 3 and a cable having a connector having a built-in amplifier attached at its front end.
Figure 9B:
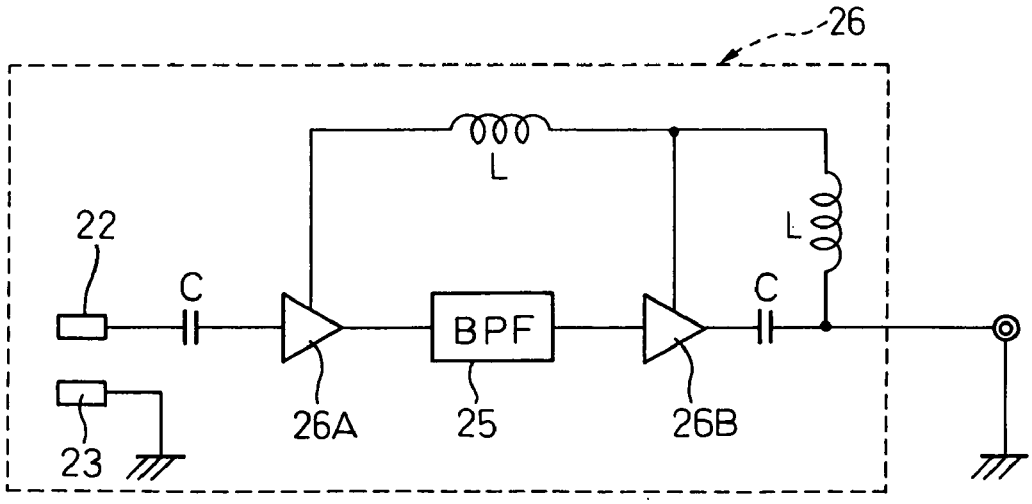
FIG. 9B is a circuit diagram of an example of the configuration of a circuit inside the amplifier shown in FIG. 9A.

FIG. 9A shows an embodiment in which an amplifier (low noise amplifier) 26 is built in the connector 21 connected to the loop antenna 10A shown in FIG. 3. When this configuration is employed, the wave received at the loop antenna 10A is amplified at the amplifier 26 and can be guided to the GPS receiver by the coaxial cable 24. FIG. 9B is a circuit diagram of an example of the internal configuration of the amplifier 26 shown in FIG. 9A. In this diagram, C indicates a capacitor, L indicates a coil, 26A and 26B indicate amplifiers, and 25 indicates a band pass filter (BPF). When the loop antenna 10A receives a wave used for the GPS, the center frequency of the BPF 25 is 1575 MHz, and the band is 1.5 MHz above and below this frequency.

Figure 10A:
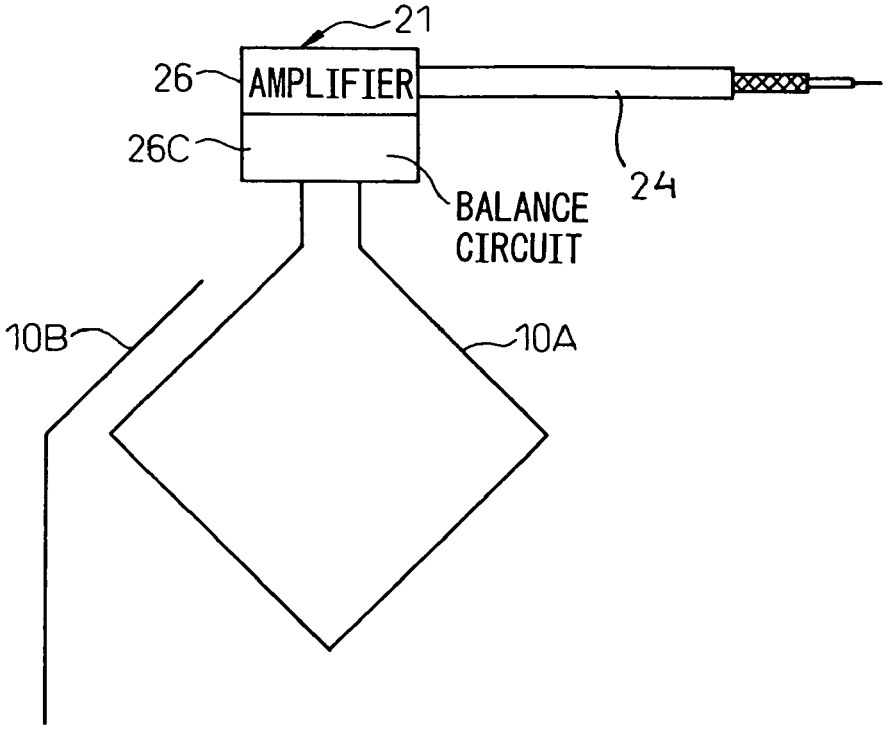
FIG. 10A is a view of the state where a cable is connected to the loop antenna shown in FIG. 3 via a balance circuit and the amplifier.
Figure 10B:
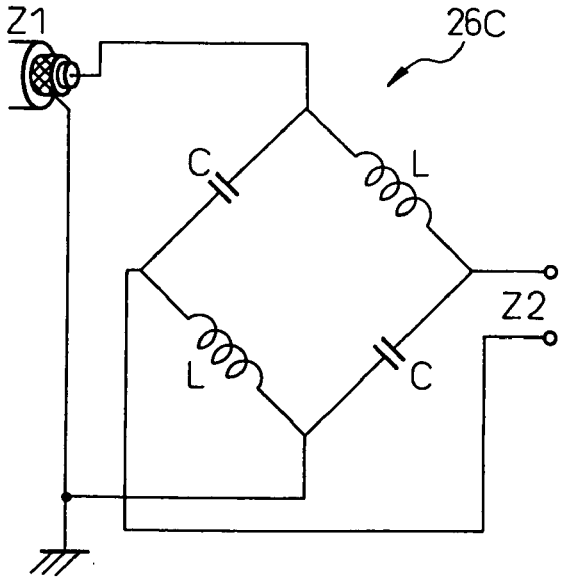
FIG. 10B is a circuit diagram of an example of the balance circuit of FIG. 10A.
Figure 10C:
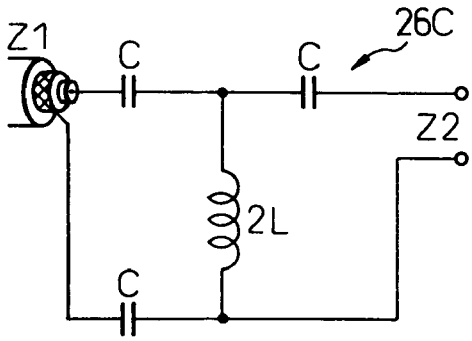
FIG. 10C is a circuit diagram of another example of the balance circuit of FIG. 10A.

FIG. 10A shows an embodiment in which a balance circuit (balance/imbalance conversion circuit, described as "balance" in the diagram) 26C and an amplifier 26 are built in the connector 21 connected to the loop antenna 10A shown in FIG. 3, while FIG. 10B and FIG. 10C show two examples which can be used in the balance circuit 26C of FIG. 10A. FIG. 10B shows an example of a balance circuit 26C of a bridge type, and FIG. 10C shows an example of a balance circuit 26C of a ladder type. These circuits are well known, so no further explanation will be provided.

Here, an explanation will be given of the configuration in the present invention of the loop antenna 10A for the circular polarized wave mainly received by the first film antenna 20 of the present invention.

Figure 11A:
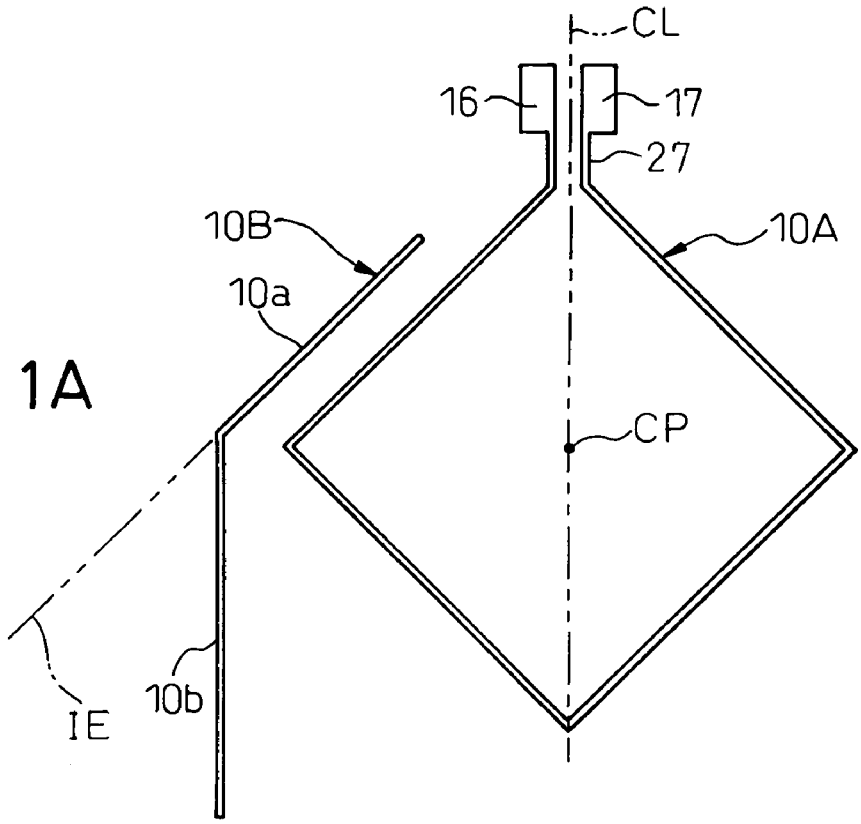

FIG. 11A shows the configuration of the loop antenna 10A for a right-hand rotating circular polarized wave in the loop antenna 10A for the circular polarized wave used in the present invention. A right-hand rotating circular polarized wave is used not only for the wave for GPS, but also used for the wave for an ETC system. This diagram shows the state of the loop antenna 10A as seen from the arrival direction of the right-hand rotating circular polarized wave. In the diagram, reference numerals 16 and 17 are power feed terminals to which the power feed circuit or coaxial cables are connected. The antenna conductor is connected to these power feed terminals 16 and 17 via the connecting conductors 27. Further, reference numeral 10B shows an independent wire-like conductor not connected to the loop antenna 10A and arranged outside of the loop antenna 10A. In the present invention, this wire-like conductor will be referred to as the "non-powered element".

The shape of the antenna conductor of the loop antenna 10A of this embodiment is a square. The power feed terminals 16 and 17 are provided at one vertex thereof. In this embodiment, the non-powered element 10B is configured by a first part 10*a* comprised of a wire-like conductor parallel to one side of the antenna conductor and a linear second part 10*b* electrically connected to this first part 10*a*. The second part 10*b* is arranged at a predetermined angle with respect to an imaginary extended line 1E of the first part 10*a*. Hereinafter, this state will be referred to as "the second part 10*b* being bent with respect to the first part". The bending direction of the second part 10*b* is bending to the antenna conductor side with respect to the imaginary extended line 1E of the first part 10*a*, that is, the side where the other side of the antenna conductor exists. This second part 10*b* gradually moves away from the antenna conductor of the loop antenna 10A the more toward its free end.

Further, the second part 10*b* of this embodiment is arranged parallel with respect to a straight line CL connecting the intermediate point of the power feed terminals 16 and 17 and the vertex facing this. Further, in this embodiment, the power feed terminal 17 among the power feed terminals 16 and 17 is grounded.

Here, an explanation will be given of the function of the non-powered element 10B. If now considering the loop antenna 10A in a state where there is no non-powered element 10B, particularly in a loop antenna 10A with a circumference (total length of antenna conductor) of one wavelength, when attached to an automobile, only the component of the electric field in the vertical direction with respect to the automobile (lateral component) will be received. This has no relation to the shape of the antenna conductor of the loop antenna 10A. As opposed to this, a circular polarized wave changes in direction of the electric field along with time. Unless constantly receiving the changing circular polarized wave, the circular polarized wave will not be completely received. The non-powered element 10B is provided close to the antenna conductor of the loop antenna 10A so as to receive the vertical component of this circular polarized wave. Explaining this more accurately, the vertical component of the circular polarized wave is acquired by the second part 10*b* of the non-powered element 10B and coupled with the vertical component of the circular polarized wave received by the first part 10*a* at the antenna conductor of the loop antenna 10A close to i. As a result, the vertical component and the lateral component of the circular polarized wave are received at the loop antenna 10A in the same phase. Namely, when the non-powered element 10B is configured by only the second part 10*b*, the received circular polarized wave is hard to transmit to the loop antenna 10A, therefore the first part 10*a* is provided in the non-powered element 10B in order to efficiently transmit the received circular polarized wave to the loop antenna 10A.

The total length of the antenna conductor configuring the loop antenna 10A is formed to be equal to the wavelength of the wave to be transmitted and received. In the case of a GPS, the length of one side of the antenna conductor is 48 mm. Further, the total length of the conductor configuring the non-powered element 10B (total of the length of the first part and the length of the second part) is a length of about ½ of the wavelength of the wave transmitted and received by this loop antenna 10A or about 90 mm. It is also possible to make the total length of the conductor configuring the non-powered element 10B longer than about ½ wavelength of the wave transmitted and received by the loop antenna 10A and make it a whole multiple of the wave transmitted and received by the loop antenna 10A.

Note that this embodiment shows a case where the loop antenna is arranged at a dielectric body having a relative dielectric constant of 1. When this loop antenna is arranged at a member having a high dielectric constant such as glass, the size of the loop antenna may be made smaller in accordance with the shorter wavelength.

For example, when defining $\lambda 1$ as the wavelength at a certain specific frequency on the dielectric body, defining $\lambda 0$ as the wavelength of the wave at the same frequency as a certain specific frequency mentioned above in free space, and defining $\alpha$ as the wavelength shortening rate by the dielectric body around the antenna, the relationship of $\lambda 1=\alpha\times\lambda 0$ stands, therefore the size of the loop antenna can be made smaller in accordance with this wavelength shortening rate $\alpha$.

Further, the conductors configuring the loop antenna 10A and the non-powered element 10*b* may be formed by conductive thin films, wires, or printing by conductive ink.

Further, in the present invention, the non-powered element 10B is located at one side of a dividing line substantially equally dividing the loop antenna 10A to two parts (center line CL in the embodiment of FIG. 11A) and is arranged so as not to reach the region on the opposite side across this dividing line. Further, the non-powered element 10B is arranged near the loop antenna 10A so that there is always a parallel component where dividing it into a component parallel to the straight line (center line CL in the embodiment of FIG. 11A) connecting opposite poles of the loop seen from the power feed points 16 and 17 of the loop antenna 10A and a component vertical to the straight line. Namely, the non-powered element 10B in the present invention is not configured by only a component vertical with respect to the center line CL.

The reason for this is that the non-powered element 10B is provided for receiving the component of the circular polarized wave which cannot be received at the loop antenna 10A as mentioned above.

Figure 11B:
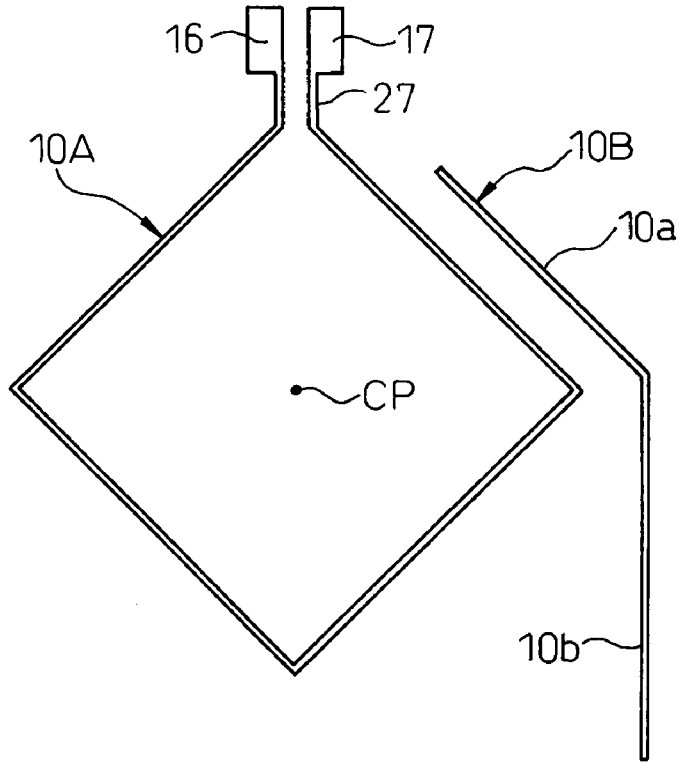

FIG. 11B shows the configuration of the loop antenna 10A for a left-hand rotating circular polarized wave in the loop antenna 10A for a circular polarized wave used in the present invention. A left-hand rotating circular polarized wave is used as a wave for satellite digital broadcasts. This diagram is the diagram of the loop antenna 10A seen from the arrival direction of the left-hand rotating circular polarized wave. The difference of the loop antenna 10A for the left-hand rotating circular polarized from the loop antenna 10A for the right-hand rotating circular polarized wave resides in only the position of the non-powered element 10B. Accordingly, the same reference numerals are assigned to the same components as those of the loop antenna 10A for the right-hand rotating circular polarized wave, and the explanations thereof will be omitted. In the loop antenna 10A for the left-hand rotating circular polarized wave shown in FIG. 11B, the position of the non-powered element 10B is made a linearly symmetric position from the non-powered terminal 14 in the loop antenna 10A for the right-hand rotating circular polarized wave shown in FIG. 11A with respect to the straight line CL mentioned above. Further, in the loop antenna 10A for the left-hand rotating circular polarized wave, the power feed terminal 16 is grounded.

The reason for making the position of the non-powered element 10B of the loop antenna 10A for the left-hand rotating circular polarized wave a position linearly symmetric to the position of the non-powered element 10B of the loop antenna 10A of the right-hand rotating circular polarized wave in this way is for receiving the vertical component of the left-hand rotating circular polarized wave at the second part 10*b* and transmitting the vertical component of the circular polarized wave received at the first part 10*a* to the loop antenna 10A.

Figure 12A:
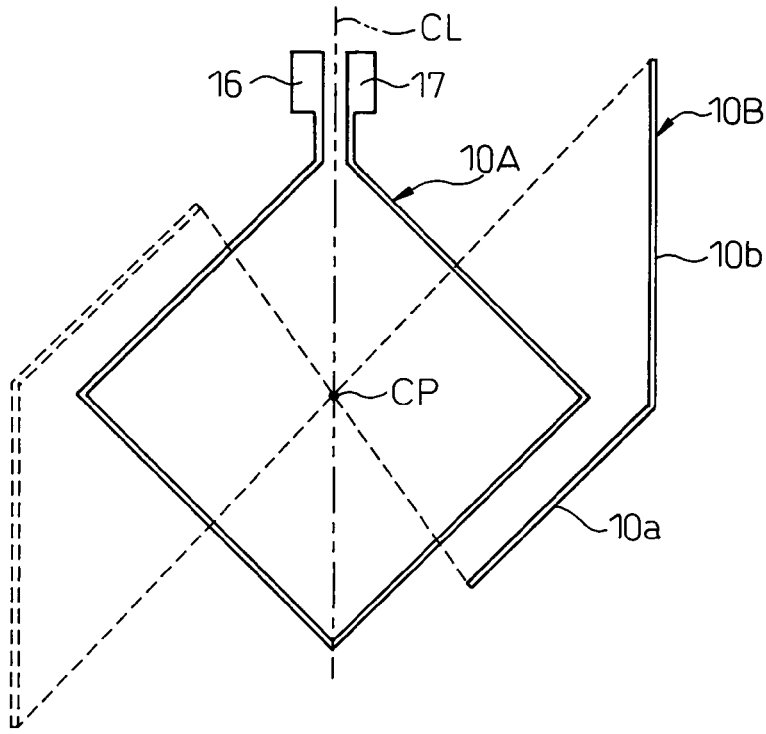

FIG. 12A shows another configuration of the loop antenna 10A for a right-hand rotating circular polarized wave in the loop antenna 10A for the circular polarized wave used in the present invention. The loop antenna 10A for the right-hand rotating circular polarized wave shown in this diagram is seen from the same direction as that of the loop antenna 10A for the right-hand rotating circular polarized wave explained in FIG. 11A. The difference of this from the loop antenna 10A for the right-hand rotating circular polarized wave explained in FIG. 11A resides in only the position of the non-powered element 10B. Accordingly, the same reference numerals are assigned to the same components as those of FIG. 11A, and the explanations thereof will be omitted.

In the loop antenna 10A for the right-hand rotating circular polarized wave, the non-powered element 10B was provided at the left side of the loop antenna 10A. On the other hand, in the loop antenna 10A for the right-hand rotating circular polarized wave shown in FIG. 12A, the non-powered element 10B is arranged at a position point symmetric to the non-powered element 10B of FIG. 11A with respect to the center point CP existing on the straight line CL connecting the intermediate point of the power feed terminals 16 and 17 and the vertex opposite to this, that is, a position where the non-powered element 10B of FIG. 11A is rotated by 180° with the center point CP. In the loop antenna 10A for the right-hand rotating circular polarized wave, even if the non-powered element 10B is arranged at such a point symmetric position, the effect does not change. This is because the second part 10*b* receives the vertical component of the right-hand rotating circular polarized wave and can transmit the vertical component of the circular polarized wave received at the first part 10*a* to the antenna conductor of the loop antenna 10A.

Figure 12B:
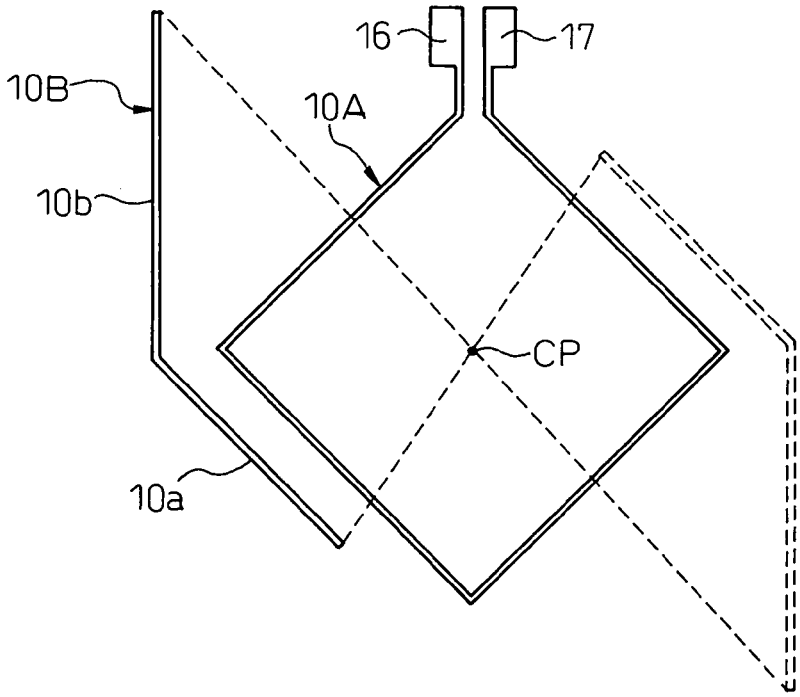

FIG. 12B shows another configuration of the loop antenna 10A for the left-hand rotating circular polarized wave in the loop antenna 10A for the circular polarized wave used in the present invention. The loop antenna 10A for the left-hand rotating circular polarized wave shown in this diagram is seen from the same direction as that for the loop antenna 10A for the left-hand rotating circular polarized wave explained in FIG. 11B. The difference of this from the loop antenna 10A for the left-hand rotating circular polarized wave explained in FIG. 11B resides in only the position of the non-powered element 10B. Accordingly, the same reference numerals are assigned to the same components the same as those of FIG. 11B, and the explanations thereof is omitted.

In the loop antenna 10A for the right-hand rotating circular polarized wave explained in FIG. 11B, the non-powered element 10B was provided at the right side of the loop antenna 10A. On the other hand, in the loop antenna 10A for the left-hand rotating circular polarized wave shown in FIG. 12B, the non-powered element 10B is arranged at a point symmetric position with respect to the center point CP existing on the straight line CL connecting the intermediate point of the power feed terminals 16 and 17 and the vertex opposite to this. In the loop antenna 10A for the left-hand rotating circular polarized wave, even if the non-powered element 10B is arranged at such a point symmetric position, the effect does not change. This is because the second part 10*b* receives the vertical component of the left-hand rotating circular polarized wave and can transmit the vertical component of the circular polarized wave received at the first part 10*a* to the antenna conductor of the loop antenna 10A.

FIG. 13A to FIG. 14D show embodiments of a variety of arrangements of the non-powered element 10B with respect to the loop antenna 10A where the shape of the antenna conductor of the loop antenna 10A is a square. Note that, here, the explanation will be given by assuming that the loop antennas 10A for the right-hand rotating and left-hand rotating circular polarized waves shown in FIGS. 11A and 11B are given the basic form, and the center point of the antenna conductor is defined as CP.

Figure 13A:
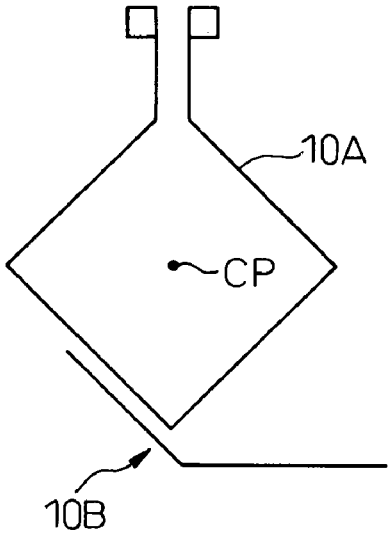
Figure 13B:
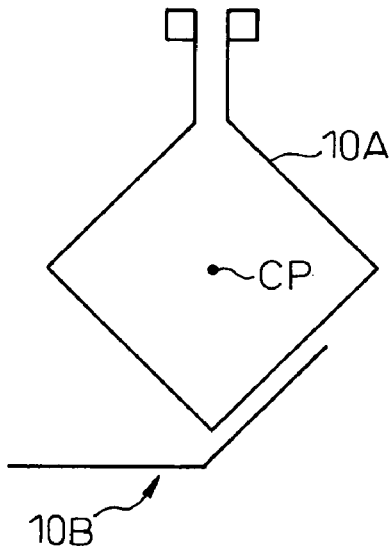

In FIG. 13A, the non-powered element 10B in the loop antenna 10A of FIG. 11A is arranged at a position rotated counterclockwise by 90° with respect to the center point CP. Further, FIG. 13B shows a state where the non-powered element 10B in the loop antenna 10A of FIG. 11B is arranged at a position rotated clockwise by 90 degrees with respect to the center point CP. Even if the non-powered element 10B is arranged in these ways, there is no difference in the reception performance of the circular polarized wave of the loop antenna 10A.

Figure 13C:
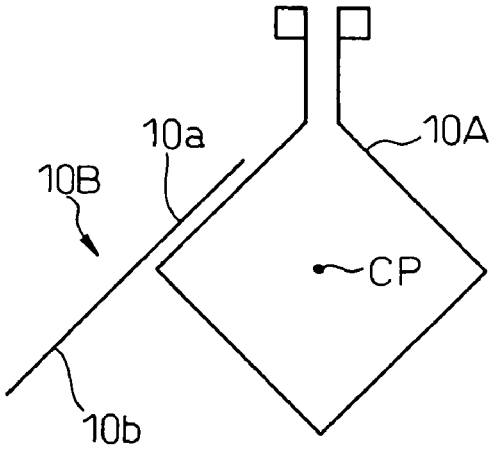

FIG. 13C shows a state where the second part 10*b* of the non-powered element 10B in the loop antenna 10A of FIG. 11A is not bent with respect to the first part 10*a*, but extends in the same direction as that for the first part 10*a* as it is. It is also possible to extend the second part 10*b* of the non-powered element 10B in the loop antenna 10A of FIG. 11B in the same direction as that for the first part 10*a* as it is without bending this with respect to the first part 10*a*.

Figure 13D:
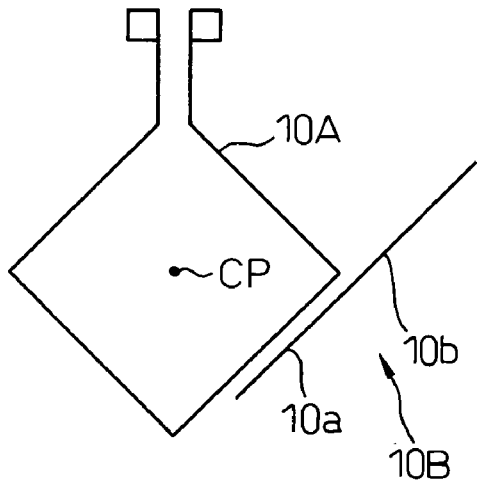

On the other hand, FIG. 13D shows a state where the non-powered element 10*b* of FIG. 13C is rotated by 180° with respect to the center point CP of the loop antenna 10A. The same arrangement is possible also in the loop antenna 10A for the left-hand rotating circular polarized wave. Even if the non-powered element 10B is arranged in this way, there is no difference in the reception performance of the circular polarized wave of the loop antenna 10A.

Figure 14A:
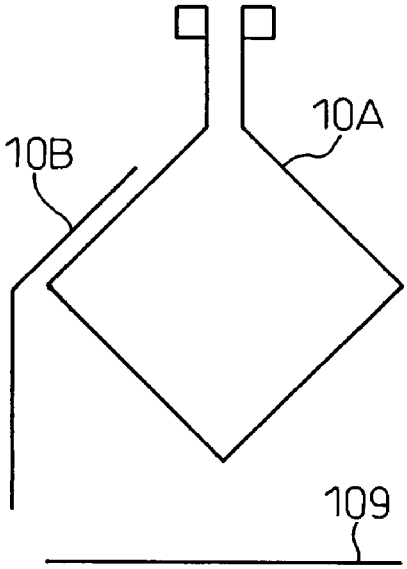
Figure 14B:
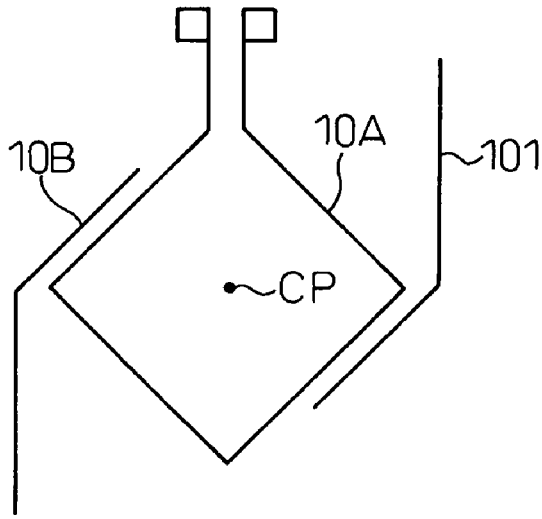
Figure 14C:
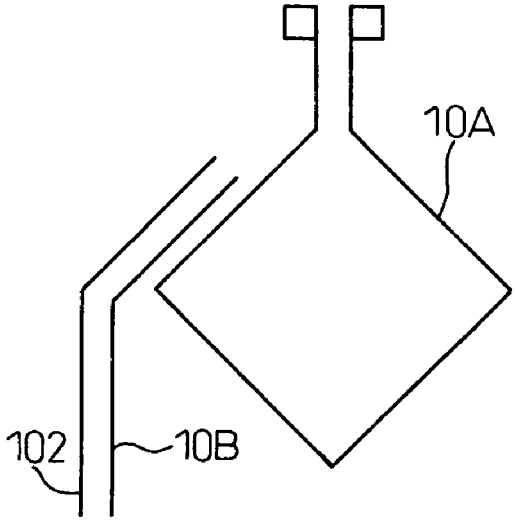
Figure 14D:
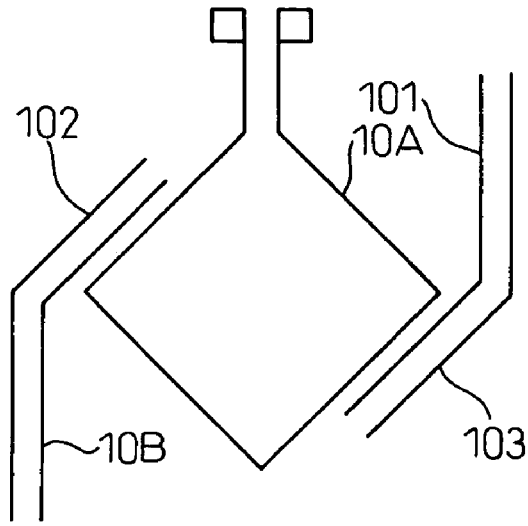

FIG. 14A shows an example in which an auxiliary conductor 109 is arranged in the horizontal direction below the loop antenna 10A with respect to the position of arrangement of the loop antenna 10A shown in FIG. 11A. This embodiment will be explained later. FIG. 14B shows a state where one more auxiliary non-powered element 101 the same as the non-powered element 10B of the loop antenna 10A shown in FIG. 11A is arranged at a point symmetric position with respect to the center point CP of the antenna conductor. Further, FIG. 14C shows a state where the auxiliary non-powered element 102 is arranged outside of the non-powered element 10B shown in FIG. 11A substantially parallel to this. Further, FIG. 14D shows a state where auxiliary non-powered elements 102 and 103 are further arranged outside of the non-powered element 10B and the auxiliary non-powered element 101 shown in FIG. 11B substantially parallel to them. When the number of the non-powered elements is increased, the reception performance of the circular polarized wave of the loop antenna 10A is improved.

Figure 15:
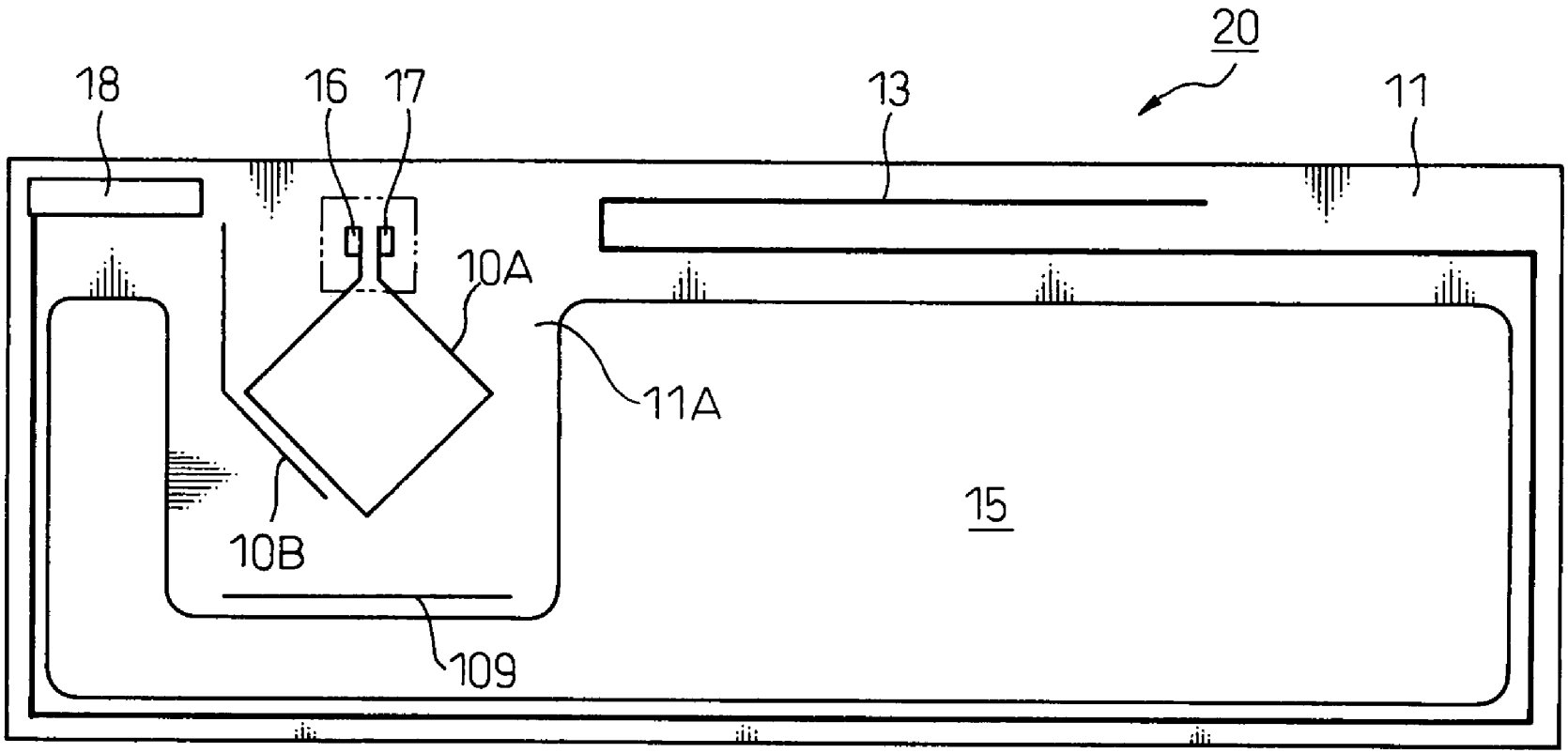
FIG. 15 is a plan view of the configuration of a modification of a second film antenna of the present invention.

FIG. 15 shows the configuration of a modification of the first film antenna 20 of the present invention as seen from the same direction as that for the first film antenna 20 shown in FIG. 3. The difference of the film antenna 20 of this modification from the first film antenna 20 shown in FIG. 1 resides only in the points that the tongue part 11A of the transparent film having the loop antenna 10A arranged therein is extended to the free end side and that the auxiliary conductor 109 explained in FIG. 14A is provided in this extended portion. This auxiliary conductor 109 is provided outside of the loop antenna 10A so as to contact the imaginary circle IC about the center point CP of the antenna conductor (refer to FIGS. 16A and 16B mentioned later). Accordingly, the same reference numerals are assigned to the same portions as those of the first film antenna 20, and the explanations thereof will be omitted.

The auxiliary conductor 109 provided at the front end of the tongue part 11A of the transparent film shown in FIG. 15 can change the directivity of the film antenna 20 by making the total length thereof longer or shorter with respect to ½ of the wavelength of the wave transmitted and received by the loop antenna 10A. This auxiliary conductor 109 may be one as shown in FIG. 15 or a plurality of auxiliary conductors 109. Further, it is also possible if part of the TV antenna 13 arranged in the film antenna 20 is used also as the auxiliary conductor as shown in FIG. 15.

Figure 16A:
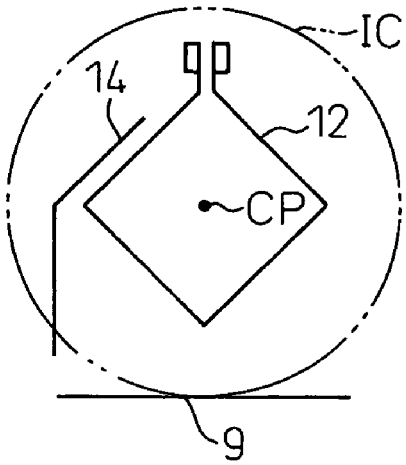
FIG. 16A is a view of an embodiment in which a length of the auxiliary conductor is made a length of ½ or more of a wavelength of a transmission and/or reception wave of the loop antenna.
Figure 17A:
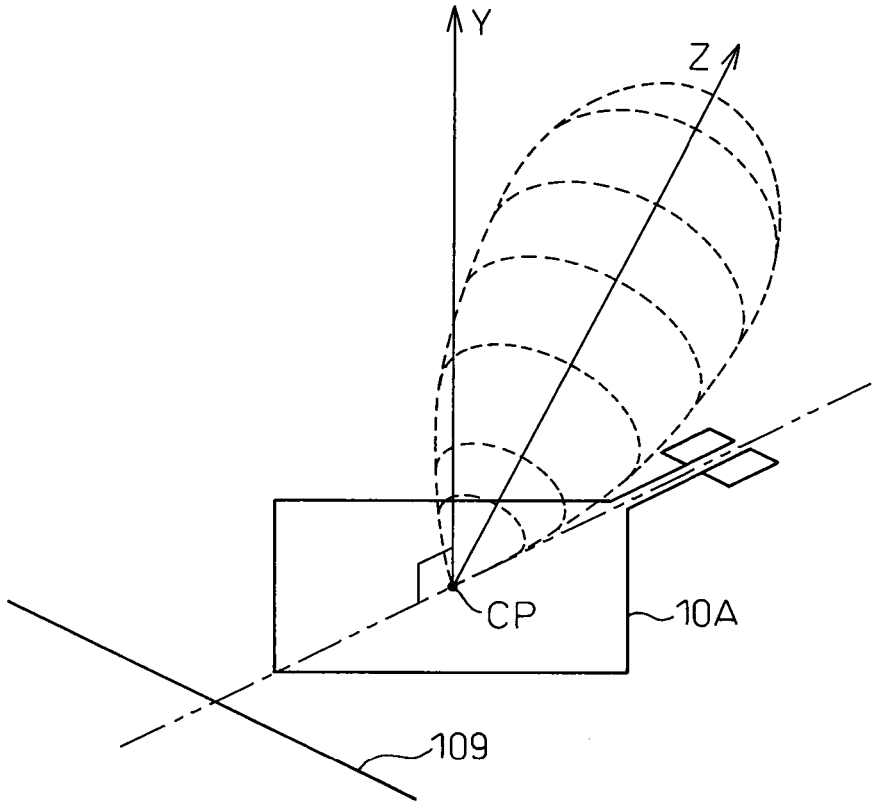
FIG. 17A is a view for explaining the directivity of the transmission and/or reception of the loop antenna shown in FIG. 16A.

FIG. 16A shows an embodiment in which the length of the auxiliary conductor 109 is made a length of ½ or more of the wavelength of the transmitted and received wave of the loop antenna 10A. When making the length of the auxiliary conductor 109 a length of ½ or more of the wavelength of the transmitted and received wave of the loop antenna 10A in this way, as shown in FIG. 17A, the directivity of the transmission and reception of the loop antenna 10A becomes a directive axis Z oriented obliquely upward at the opposite side of the auxiliary conductor 109 with respect to the vertical axis Y extending from the center point CP of the antenna conductor. Note that, the illustration of the non-powered element 10B is omitted in FIG. 17A.

Figure 16B:
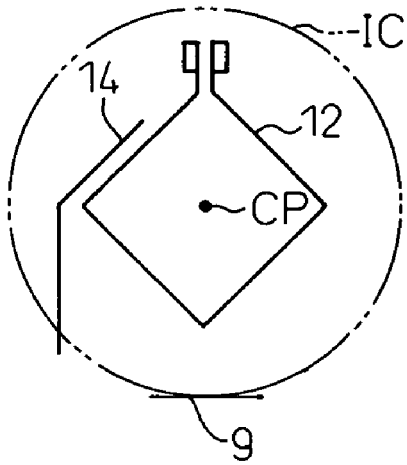
FIG. 16B is a view of an embodiment in which a length of the auxiliary conductor is made a length of less than ½ of the wavelength of a transmission and/or reception wave of the loop antenna.
Figure 17B:
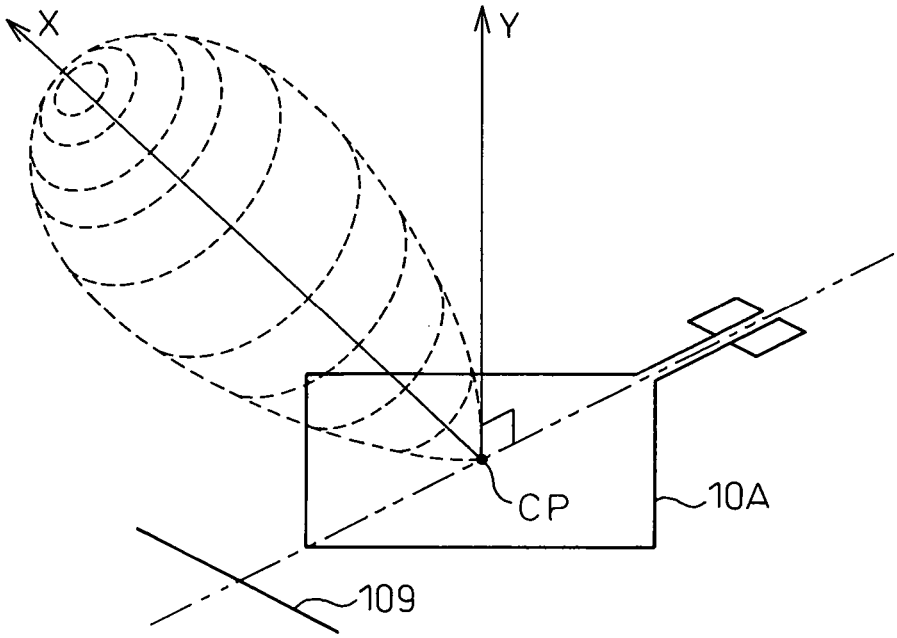
FIG. 17B is a view for explaining the directivity of the transmission and/or reception of the loop antenna shown in FIG. 16B.

FIG. 16B shows an embodiment in which the length of the auxiliary conductor 109 is made a length of less than ½ of the wavelength of the transmitted and received wave of the loop antenna 10A. When the length of the auxiliary conductor 109 is made a length less than ½ of the wavelength of the transmitted and received wave of the loop antenna 10A in this way, as shown in FIG. 17B, the directivity of the transmission and reception of the loop antenna 10A becomes the directive axis X oriented obliquely upward at the same side as the auxiliary conductor 109 with respect to the vertical axis Y extending from the center point CP of the antenna conductor. Note that, the illustration of the non-powered element 10B is omitted in FIG. 17B.

Figure 16C:
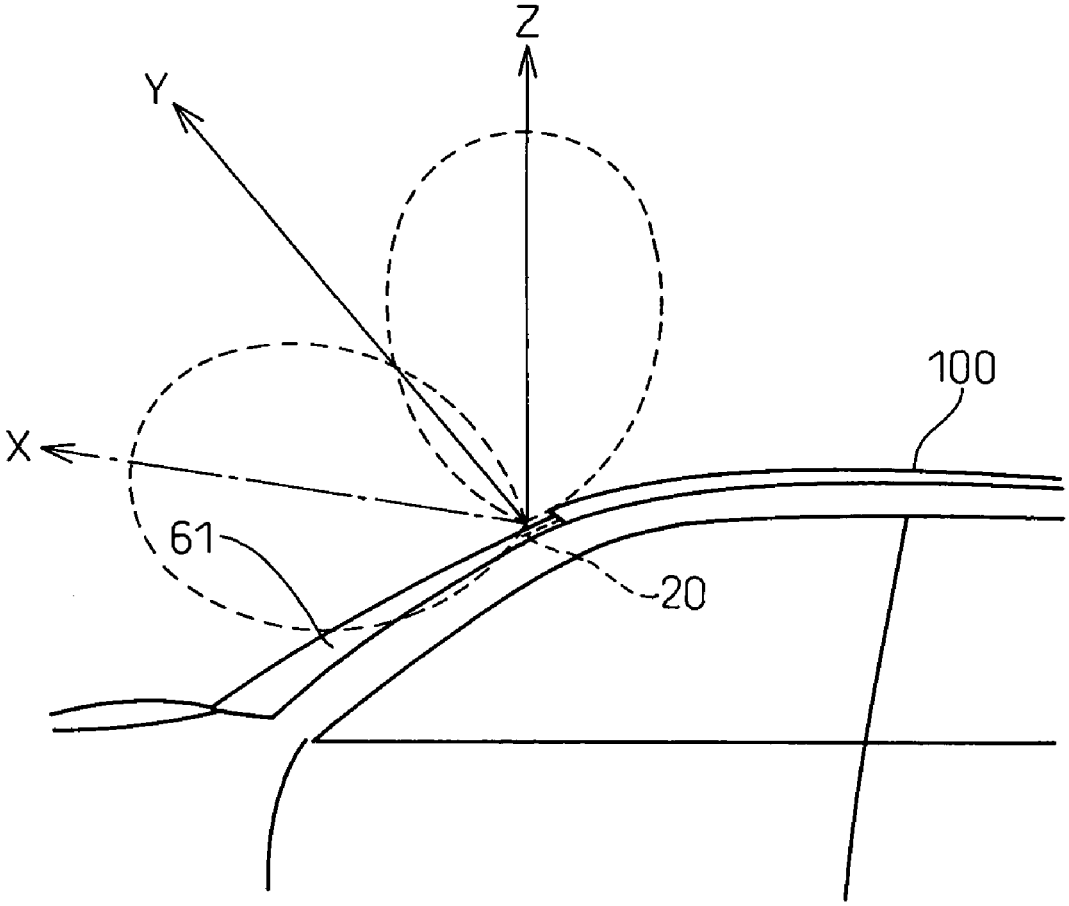
FIG. 16C is a view of a difference of directivity of thin film antennas due to the difference of configurations of FIG. 16A and FIG. 16B.

Accordingly, when a film antenna 20 having a loop antenna 10A where the length of the auxiliary conductor 109 shown in FIG. 16A has a length of ½ or more of the wavelength of the transmitted and received wave of the loop antenna 10A is attached to the inclined windshield 61 of the automobile 100 as shown in FIG. 16C, the direction of the directive axis of transmission and reception of the film antenna 20 can be oriented to the zenithal direction indicated by an arrow Z. As a result, the transmission and reception performance of the film antenna 20 with respect to the zenithal direction is improved. On the other hand, when a film antenna 20 having a loop antenna 10A where the length of the auxiliary conductor 109 shown in FIG. 16B is less than ½ of the wavelength of the transmitted and received wave of the loop antenna 10A is attached to the inclined windshield 61 of the automobile 100 as shown in FIG. 16C, the direction of the directive axis of transmission and reception of the film antenna 20 can be oriented to the direction near the horizontal direction indicated by the arrow X. As a result, the transmission and reception performance of the film antenna 20 with respect to the direction near the horizon is improved.

Figure 18A:
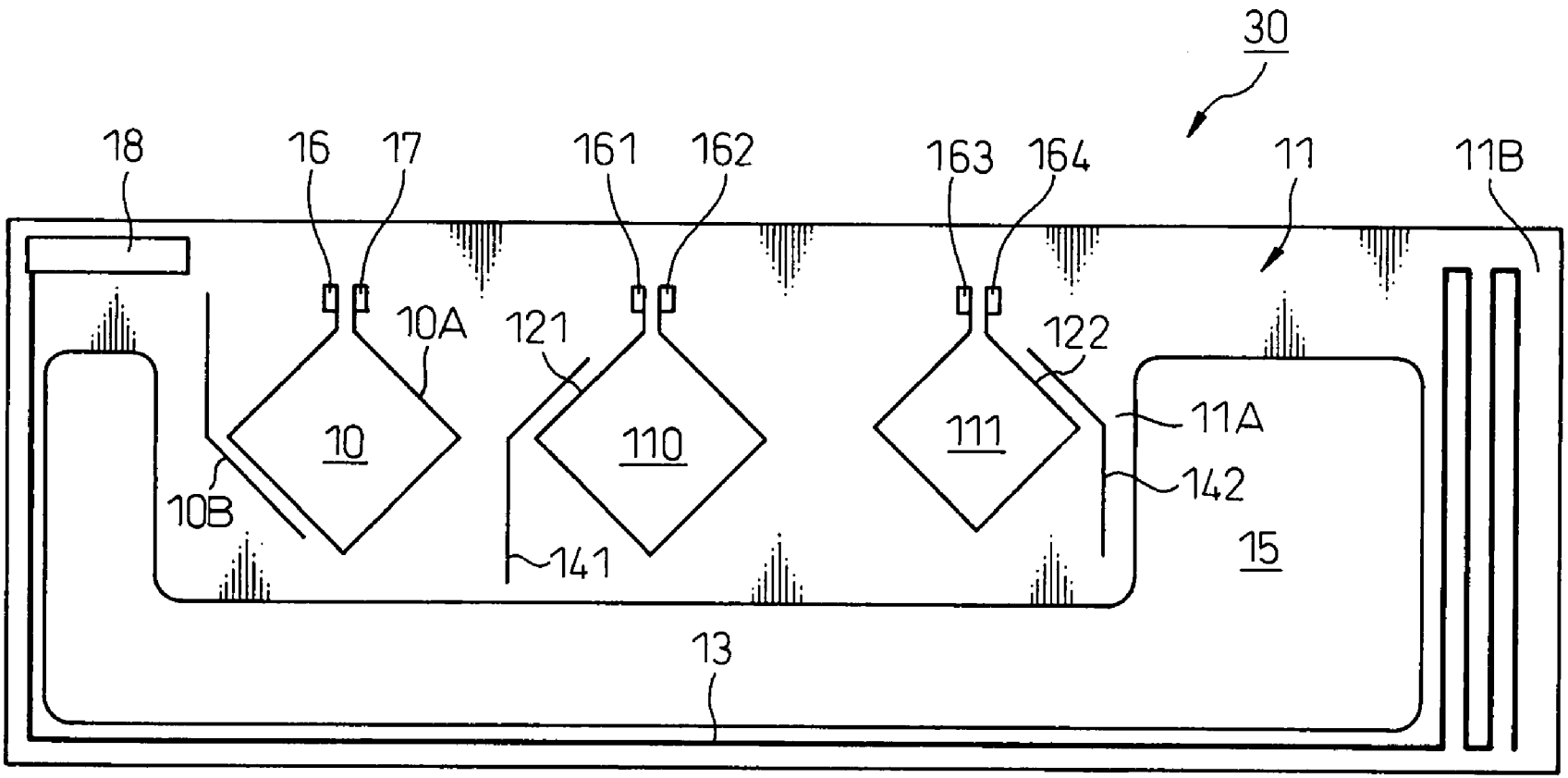
FIGS. 18A and 18B are plan views of the configuration of a third film antenna of the present invention.

FIG. 18A shows the configuration of a third film antenna 30 of the present invention as seen from a reverse direction to the arrival direction of the wave. The difference of the third film antenna 30 from the first film antenna 20 shown in FIG. 3 resides in only the points that the tongue part 11A of the transparent film having the loop antenna 10A arranged therein is extended in the lateral direction and that the loop antennas 121 and 122 are provided also in the extended portion. Accordingly, the same reference numerals are assigned to the same portions as those of the first film antenna 20, and the explanations thereof are omitted.

The arrangement of a non-powered element 142 is the same as that of FIG. 11B (this diagram is a diagram seen from the reverse direction to the arrival direction of the wave, so the arrangement of the non-powered element 141 becomes opposite to that of FIG. 11B), therefore the loop antenna 121 is a loop antenna for transmitting and receiving a left-hand rotating circular polarized wave. Reference numerals 161 and 162 are power feed terminals. Further, the arrangement of a non-powered element 142 is the same as that of FIG. 11A (this diagram is the diagram seen from the reverse direction to the arrival direction of the wave, so the arrangement of the non-powered-element 142 becomes opposite to that of FIG. 11A), therefore the loop antenna 122 is a loop antenna for transmitting and receiving a right-hand rotating circular polarized wave in the same way as the loop antenna 10A, but the total length of the loop is shorter with respect to the loop antenna 10A. Accordingly, the loop antenna 122 transmits and receives a right-hand rotating circular polarized wave having a higher frequency. Reference numerals 163 and 164 are power feed terminals.

Note that, in the third film antenna 30, the tongue part 11A of the transparent film becomes laterally long. In the modification of the first film antenna 20, power feed terminals 161, 162, 163, and 164 are provided at the position where the TV antenna 13 was arranged. For this reason, in this embodiment, an extended portion 11B is formed by extending the right side portion of the transparent film 11, the TV antenna 13 is bent at this extended portion 11B, and a length of the worth of the wavelength of the transmission and reception frequency of a TV is secured. In this way, in the third film antenna 30, a plurality of loop antennas can be mounted on the transparent film 11. As a result, the space for mounting antennas for a plurality of types of waves can be reduced and cables can be combined, therefore the mounting property and attachment property of the antennas to vehicle are improved and the cost of providing the antennas can be reduced.

Figure 18B:
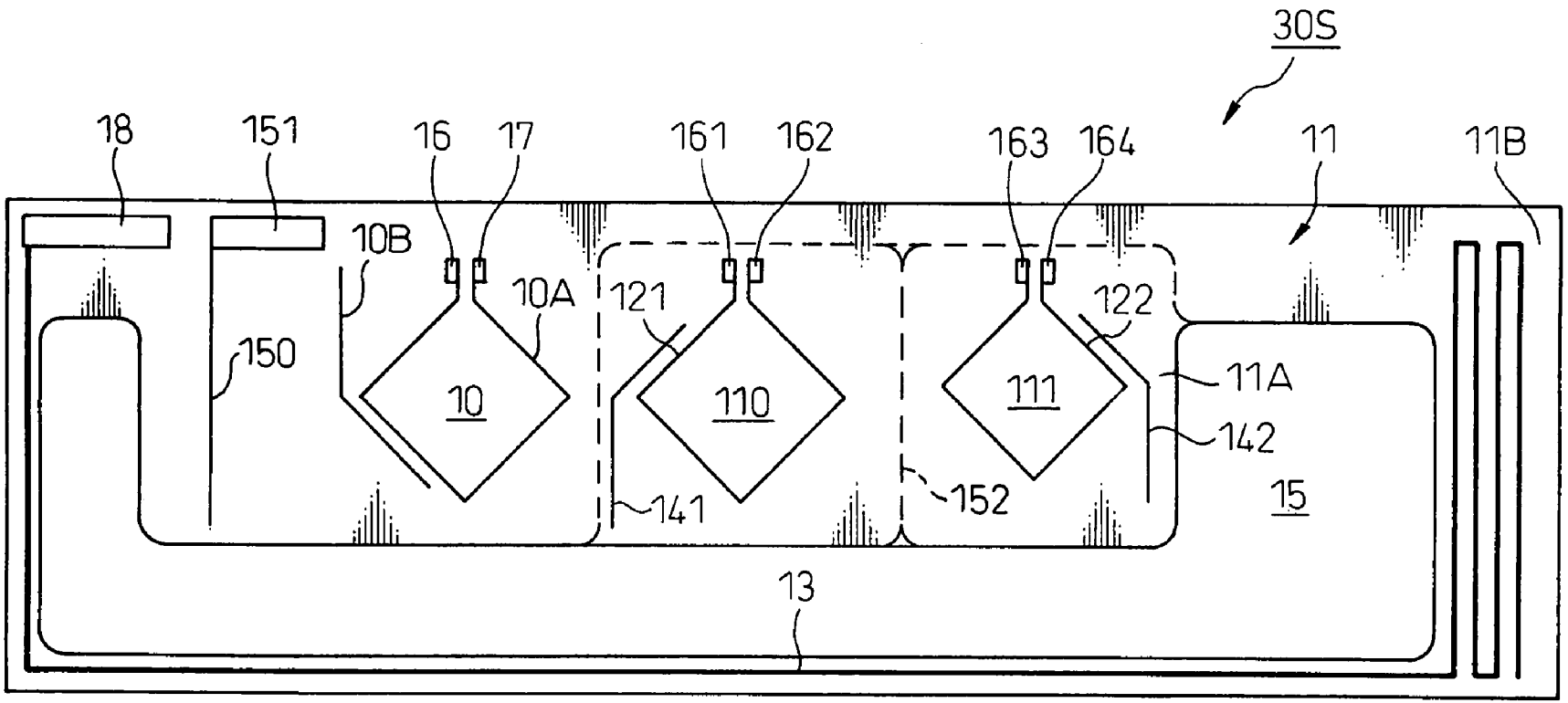

FIG. 18B shows the configuration of a film antenna 30S of a modification of the third film antenna 30 shown in FIG. 18A as seen from the reverse direction to the arrival direction of the wave. The difference of the film antenna 30S of the modification from the third film antenna 30 shown in FIG. 18A resides in only the points that the tongue part 11A of the transparent film having the loop antenna 10A arranged therein is extended to also the antenna connection terminal 18 side of the TV antenna 13, an antenna 150 for transmitting and/or receiving the signal used in an anti-car jack system (for security) and an antenna connection terminal 151 thereof are provided in the extended portion, and the loop antennas 121 and 122 are provided so that they can be independently cut from the tongue part 11A by the perforations 152. Accordingly, the same reference numerals are assigned to the same portions as those of the third film antenna 30, and the explanations thereof will be omitted.

In the film antenna 30S of this modification, the security system can be connected and, at the same time, the loop antennas 121 and 122 can be removed by the perforations 152 when not necessary. The film antenna 30S, other than this, may also mount an antenna for transmitting and/or receiving the keyless entry system signal of the automobile or an antenna for transmitting and/or receiving a signal used in a remote engine starter system so that they can be cut out.

FIGS. 19A to 19D show examples of the arrangement of the non-powered element 10B when the shape of the antenna conductor of the loop antenna 10A used in the circular polarization antenna of the present invention is rectangular. These diagrams are diagrams viewing the loop antenna 10A from the arrival direction of the right-hand rotating circular polarized wave.

Figure 19A:
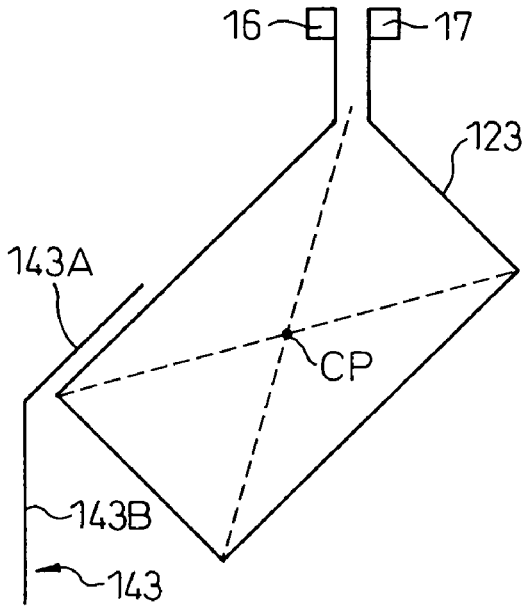
FIGS. 19A to 19D are views of various examples of arrangement of the non-powered element when making the shape of the antenna conductor of the loop antenna for the circular polarized wave used in the circular polarization antenna of the present invention rectangular.

The loop antenna 123 of FIG. 19A is provided with a rectangular antenna conductor obtained by extending the parallel sides of the antenna conductor of the loop antenna 10A shown in FIG. 11A in the bottom left direction by exactly the same length and provided with power feed terminals 16 and 17 at one vertex thereof. In this embodiment as well, the non-powered element 143 is configured by a first part 143A parallel to one side of the antenna conductor and a second part 143B electrically connected to this first part 143A and connected in a bent state with respect to this first part 143A. The second part 143B is bent in the direction approaching the other side of the antenna conductor. The distance of this second part 143B from one close side of the antenna conductor becomes larger the further toward the free end thereof. The power feed terminal 17 among the power feed terminals 16 and 17 is grounded.

Figure 19B:
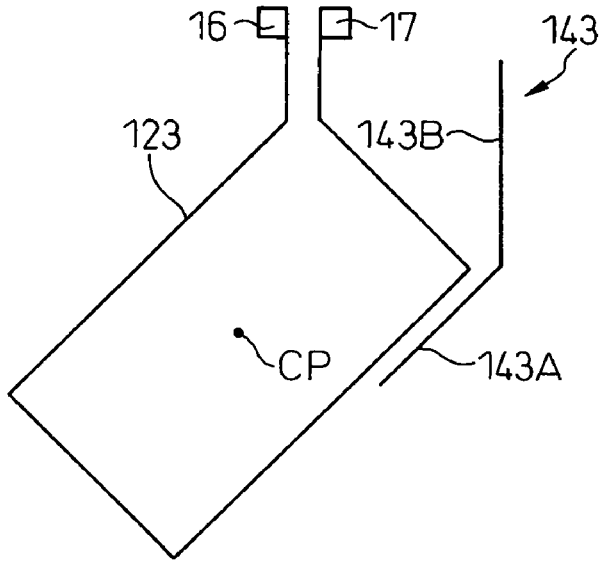

The loop antenna 123 of FIG. 19B is provided with a rectangular antenna conductor of same shape as that of the loop antenna 123 of FIG. 19A and has power feed terminals 16 and 17 provided at one vertex thereof. The non-powered element 143 of this embodiment is provided at a point symmetric position from the non-powered element 143 shown in FIG. 19A with respect to the center point CP of the rectangular antenna conductor. The power feed terminal 16 among the power feed terminals 16 and 17 is grounded.

Figure 19C:
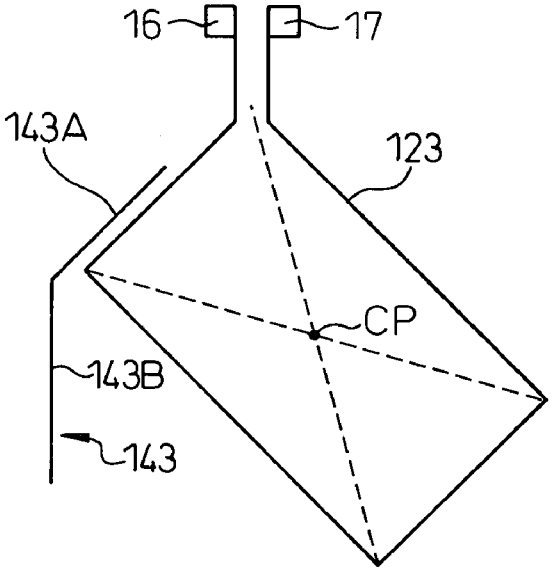

The loop antenna 123 of FIG. 19C is provided with a rectangular antenna conductor obtained by extending the parallel sides of the antenna conductors of the loop antenna 10A shown in FIG. 11A in the bottom right direction by exactly the same length and provided with power feed terminals 16 and 17 at one vertex thereof. In this embodiment as well the non-powered element 143 is configured by a first part 143A parallel to one side of the antenna conductor and a second part 143B electrically connected to this first part 143A and connected in the bent state with respect to the first part 143A. The second part 143B is bent in the direction approaching the other side of the antenna conductor. The distance of this second part 143B from one close side of the antenna conductor becomes larger the further to the free end thereof. The power feed terminal 17 among the power feed terminals 16 and 17 is grounded.

Figure 19D:
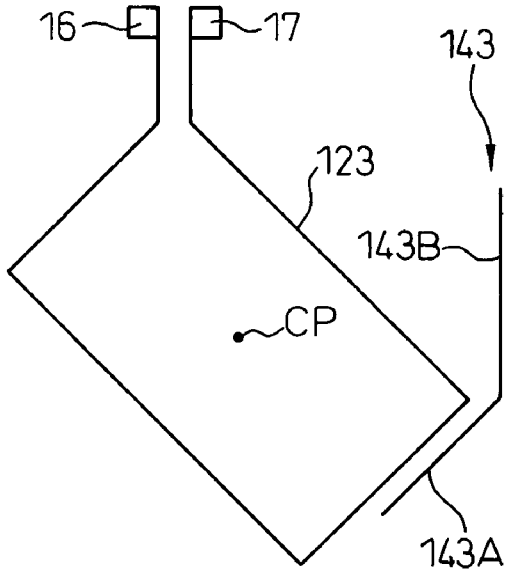

The loop antenna 123 of FIG. 19D is provided with a rectangular antenna conductor having the same shape as that of the loop antenna 123 of FIG. 19C and provided with power feed terminals 16 and 17 at one vertex thereof. The non-powered element 143 of this embodiment is provided at a point symmetric position from the non-powered element 143 shown in FIG. 19C with respect to the center point CP of the rectangular antenna conductor. The power feed terminal 16 among the power feed terminals 16 and 17 is grounded.

The shapes of the antenna conductors of the loop antennas 10A and 123 for transmitting and receiving the circular polarized wave used in the film antennas 20 and 30 of the present invention can be a variety of shapes other than the above squares and rectangles. The shapes thereof will be explained below.

Figure 20A:
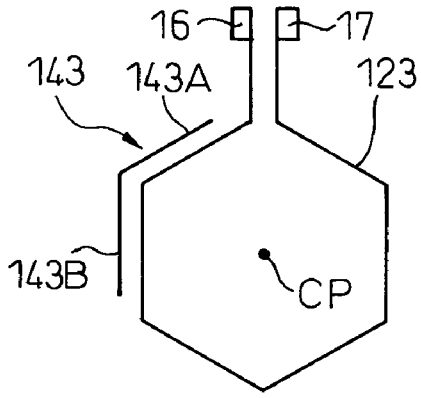
FIG. 20A is a view of an example of the arrangement of the non-powered element when making the shape of the antenna conductor of the loop antenna used in the circular polarization antenna of the present invention hexagonal.
Figure 20B:
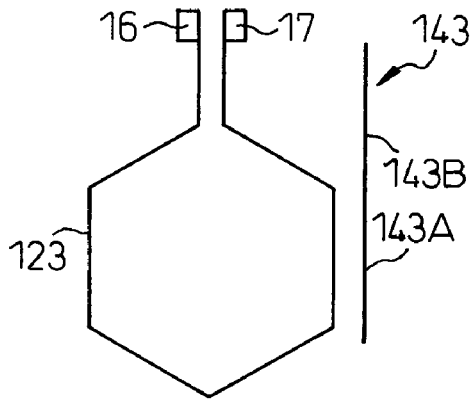
FIG. 20B is a view of another example of the arrangement of the non-powered element when making the shape of the antenna conductor of the loop antenna used in the circular polarization antenna of the present invention hexagonal.

FIG. 20A shows an example of the arrangement of the non-powered element 143 when the shape of the antenna conductor of the loop antenna 123 is made hexagonal. In this example, of the first part 143A and the second part 143B of the non-powered element 143 are formed parallel to two adjacent sides of the hexagonal antenna conductor. It is also possible if the second part 143B is further extended exceeding the length of one side of the adjacent hexagonal antenna conductor. Further, the non-powered element 143 can be arranged at the position rotated by exactly a whole multiple of 60 degrees with respect to the center point CP of this hexagonal antenna conductor. Further, the second part 143B of the non-powered element 143 can be extended linearly as it is without being bent with respect to the first part 143A as shown in FIG. 20B as well.

Figure 20C:
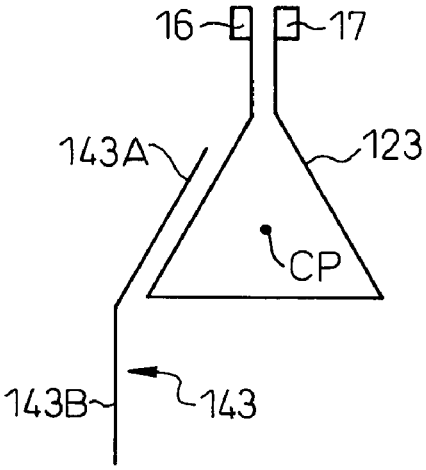
FIG. 20C is a view of an example of the arrangement of the non-powered element when making the shape of the antenna conductor of the loop antenna used in the circular polarization antenna of the present invention triangular.

FIG. 20C shows an example of the arrangement of the non-powered element 143 in a case where the shape of the antenna conductor of the loop antenna 123 is made triangular. In this example, the first part 143A of the non-powered element 143 is formed parallel to one side of the triangular antenna conductor adjacent to the power feed terminal 16, and the second part 143B is bent to the side approaching the other side of the triangular antenna conductor with respect to the first part 143A. Further, the non-powered element 143 can be arranged at a position rotated counterclockwise by exactly 120 degrees with respect to the center point CP of this triangular antenna conductor as well.

Figure 20D:
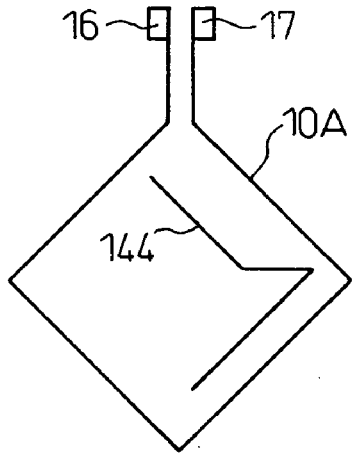
FIG. 20D is a view of still another example of the arrangement of the non-powered element when making the shape of the antenna conductor of the loop antenna used in the circular polarization antenna of the present invention square.

FIG. 20D shows still another example of the arrangement of the non-powered element 143 in a case where the shape of the antenna conductor of the loop antenna 123 is made square. In the above embodiments, the non-powered elements 143 were all arranged outside of the antenna conductor of the loop antenna 123, but this embodiment differs in the point that the non-powered element 144 is arranged inside the antenna conductor of the loop antenna 10A. In this way, it is also possible to arrange the non-powered elements 10B and 143 inside the antenna conductor irrespective of the shapes of the antenna conductors of the loop antennas 10A and 123.

In the above embodiments, the shapes of the antenna conductors of the loop antennas 10A and 123 were polygonal, but the shapes of the antenna conductors may be circular too. Embodiments thereof will be explained next.

Figure 21A:
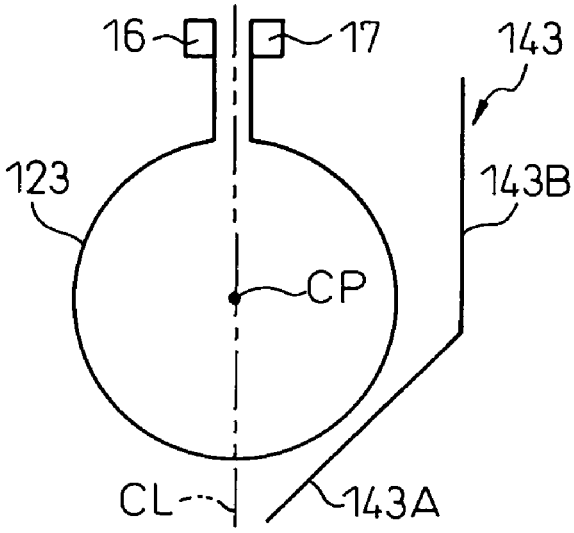
FIG. 21A is a view of an example of the arrangement of the non-powered element when making the shape of the antenna conductor of the loop antenna used in the circular polarization antenna of the present invention circular.
Figure 21B:
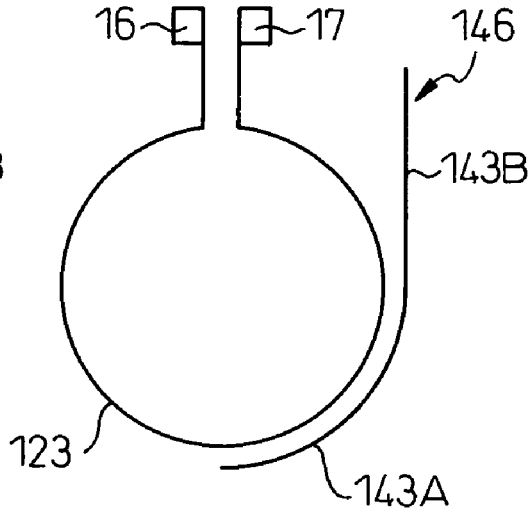
FIG. 21B is a view of another example of the arrangement of the non-powered element when making the shape of the antenna conductor of the loop antenna used in the circular polarization antenna of the present invention circular.
Figure 21C:
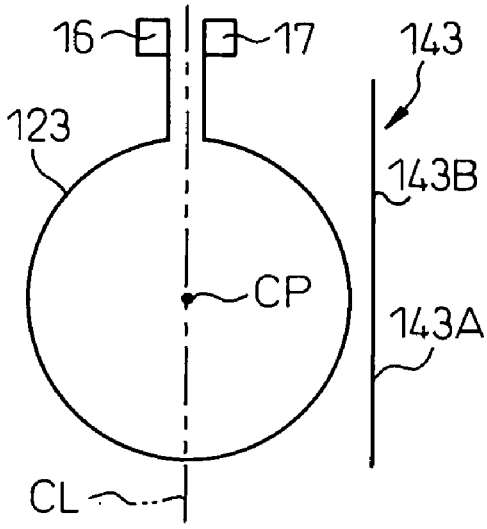
FIG. 21C is a view of still another example of the arrangement of the non-powered element when making the shape of the antenna conductor of the loop antenna used in the circular polarization antenna of the present invention circular.
Figure 21D:
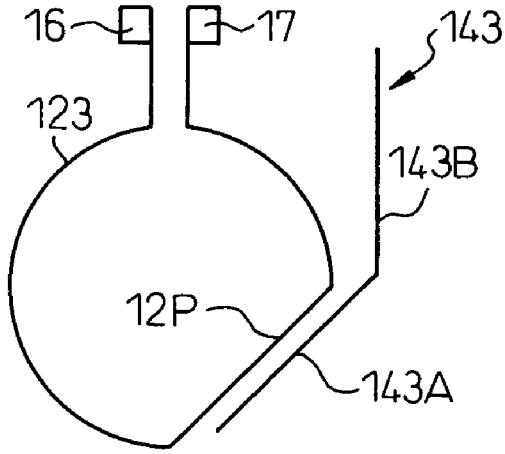
FIG. 21D is a view of an example of the arrangement of the non-powered element when making the shape of the antenna conductor of the loop antenna used in the circular polarization antenna of the present invention part of a circle and a straight line.

FIG. 21A shows an example of the arrangement of the non-powered element 143 when the shape of the loop antenna 123 is made circular. In this example, the first part 143A of the non-powered element 143 is formed parallel to one tangent of the circular antenna conductor at the position away from the arc by exactly a predetermined distance. The second part 143B is formed while being bent to the side approaching the antenna conductor with respect to the first part 143A. In this embodiment, the second part 143B is arranged parallel to the center line CL passing between the two power feed terminals 16 and 17 and through the center point CP. Note that, as shown in FIG. 21B, it is also possible if the first part 143A of the non-powered element 143 is formed parallel (concentric circle state) to the arc antenna conductor of the loop antenna 123. Further, it is also possible to arrange both of the first part 143A and the second part 143B of the non-powered element 143 parallel with respect to the center line CL passing between the two power feed terminals 16 and 17 and through the center point CP as shown in FIG. 21C. Still further, as shown in FIG. 21D, it is also possible to form a linear portion 12P parallel to the first part 143A of the non-powered element 143 in part of the antenna conductor of the circular loop antenna 123.

Note that the shapes of the antenna conductors of the loop antennas 10A and 123 useable in the film antennas 20 and 30 of the present invention and the numbers and arrangements of the non-powered elements 10B, 143, and 144 are not limited to those of the above embodiments.

Figure 23:
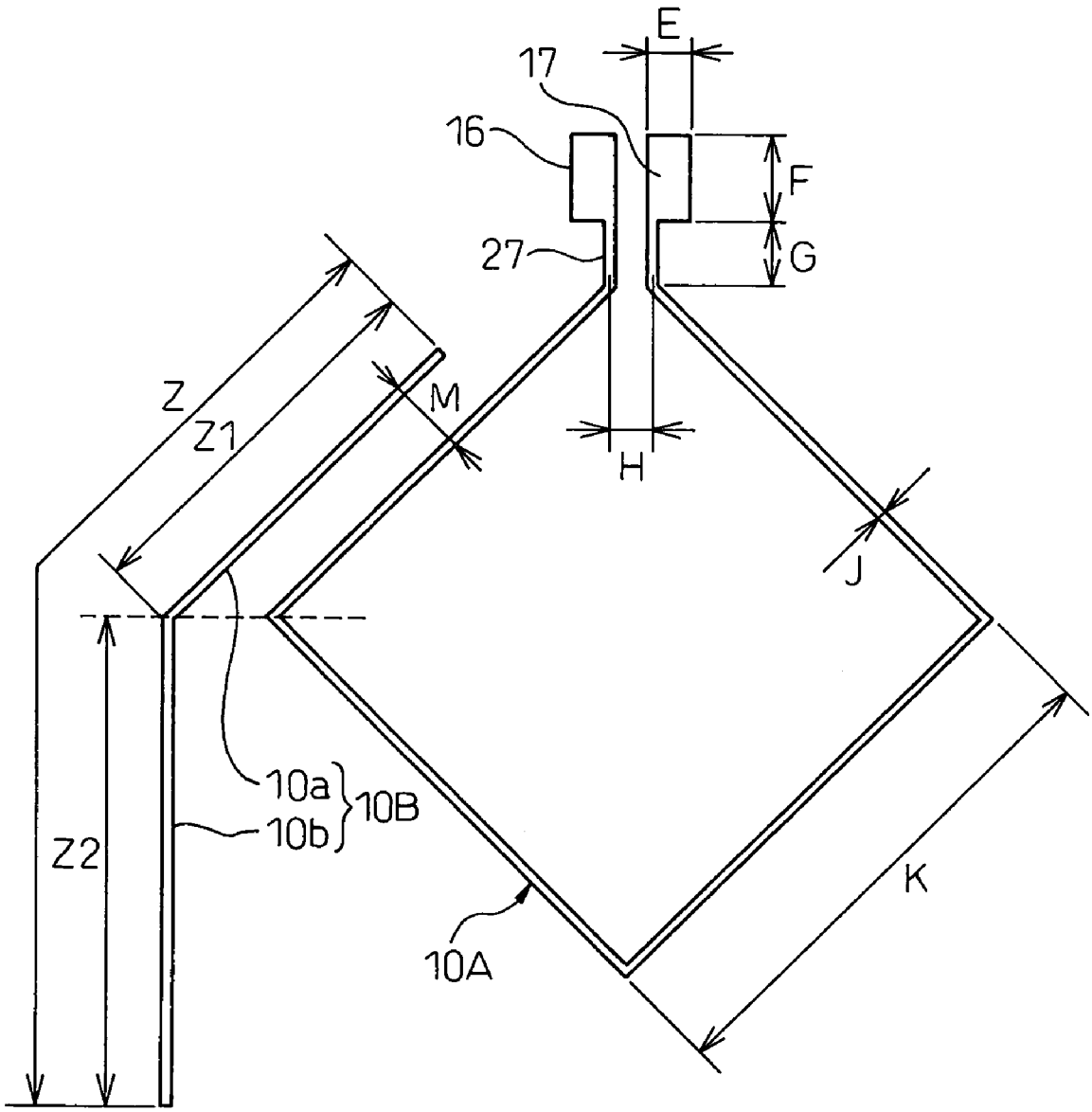
FIG. 23 is a view for explaining the specific dimensions in an embodiment of the circular polarization antenna of the present invention.

FIG. 23 is a view for explaining an example of the specific dimensions of the loop antenna 10A and the non-powered element 10B in the circular polarization antenna 10 of the present invention explained in FIG. 11A. First, an explanation will be given of various dimensions on the loop antenna 10A side. In this embodiment, among the dimensions of the power feed terminals 16 and 17, the length E in the short direction is 3 mm, the length F in the long direction is 5 mm, and the length G of connecting conductors 27 connecting the power feed terminals 16 and 17 and the antenna conductor is 10 mm. Further, the dimension H between the connecting conductors 27 is 3 mm. Further, the length K of one side of the square shaped antenna conductor is 30 to 35 mm, and the pattern width J of the antenna conductor is 0.3 mm.

Next, in the non-powered element 10B, the length Z1 of the first part 10*a* parallel to the antenna conductor is 15 to 25 mm, the length Z of the second part 10*b* electrically connected to the first part 10*a* is 35 to 45 mm, and the total length Z obtained by adding the first part 10*a* and the second part 10*b* is 55 to 75 mm. Further, the distance M between the first part 10*a* and the antenna conductor is 1.5 to 3.5 mm.

The antenna 10A for the circular polarized wave of the embodiment shown in FIG. 23 can receive the wave for a GPS. The dimensions of this embodiment are only examples. If the frequency of the transmitted and received wave is different, the above dimensions can be increased or decreased proportionally in accordance with the level of the frequency.

Further, in the above embodiments, the explanation was given of the film antennas 20 and 30 formed by forming the loop antenna 10A on the transparent film 11 and adhering the result to the back surface of the windshield 61 of an automobile, but the loop antenna 10A can be formed on a usual printed board or an opaque dielectric body like the surface of a plastic case. Such an embodiment can be effectively applied to a home electric appliance having a communication function and using a circular polarized wave as the communication wave, for example, for wireless connection between a personal computer and its peripherals by a circular polarized wave.

Next, an explanation will be given of embodiments of a circular polarization antenna using a monopole antenna.

Figure 24A:
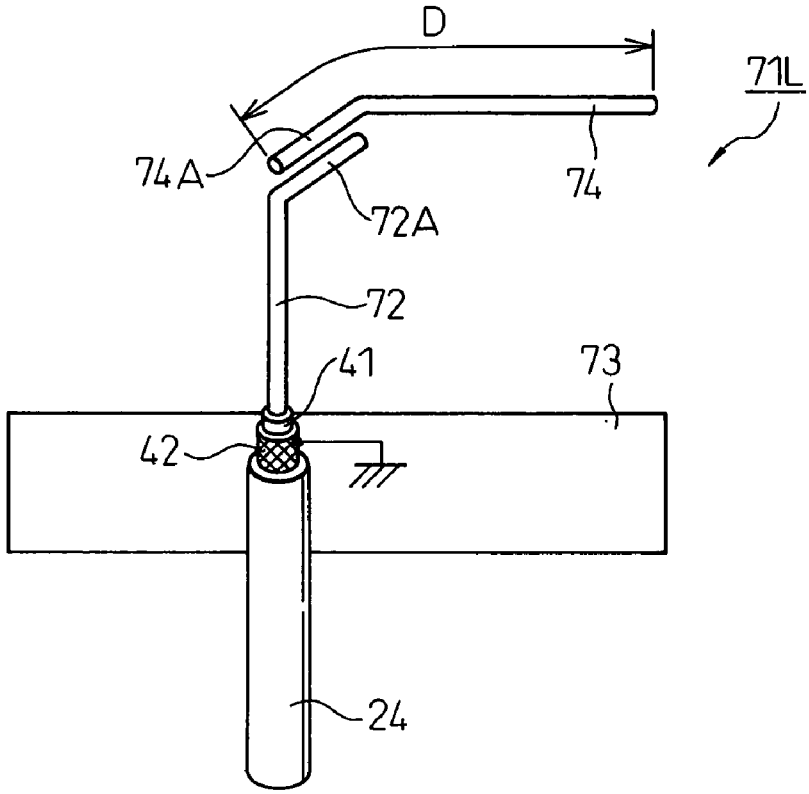
FIG. 24A is a view of the basic configuration of the circular polarization antenna of the present invention for receiving a left-hand rotating circular polarized wave.

FIG. 24A shows the basic configuration of a circular polarization antenna 71L of an embodiment of the present invention for receiving a left-hand rotating circular polarized wave. The circular polarization antenna 71L of this embodiment is configured by a monopole antenna 72, a ground plate 73, and a non-powered conductor 74. The power feed point of the monopole antenna 72 is connected to a core wire 41 of the coaxial cable 24, and the ground plate 73 is connected to the ground line 42 of the coaxial cable 24. The non-powered conductor 74 is not electrically connected to the monopole antenna 72, but arranged near the front end of the monopole antenna 72 in a direction orthogonal to the monopole antenna 72.

In this embodiment, the front end 72A comprised of the free end of the monopole antenna 72 is obliquely bent, one end 74A of the non-powered conductor 74 is obliquely bent, and the two are arranged close in parallel. Namely, one end 74A of the non-powered conductor 74 and the front end 72A of the monopole antenna 72 form a power transfer part, whereby the non-powered conductor 74 becomes able to transfer power with the monopole antenna 72. When the power transfer part is formed obliquely, current loss is reduced. The length (including also the portion of one end 74A) D of the non-powered conductor 74 in this embodiment becomes a length of ½ or more of the wavelength of the wave of the reception frequency of the circular polarization antenna 71L or a length of a whole multiple of the ½ wavelength.

Figure 24B:
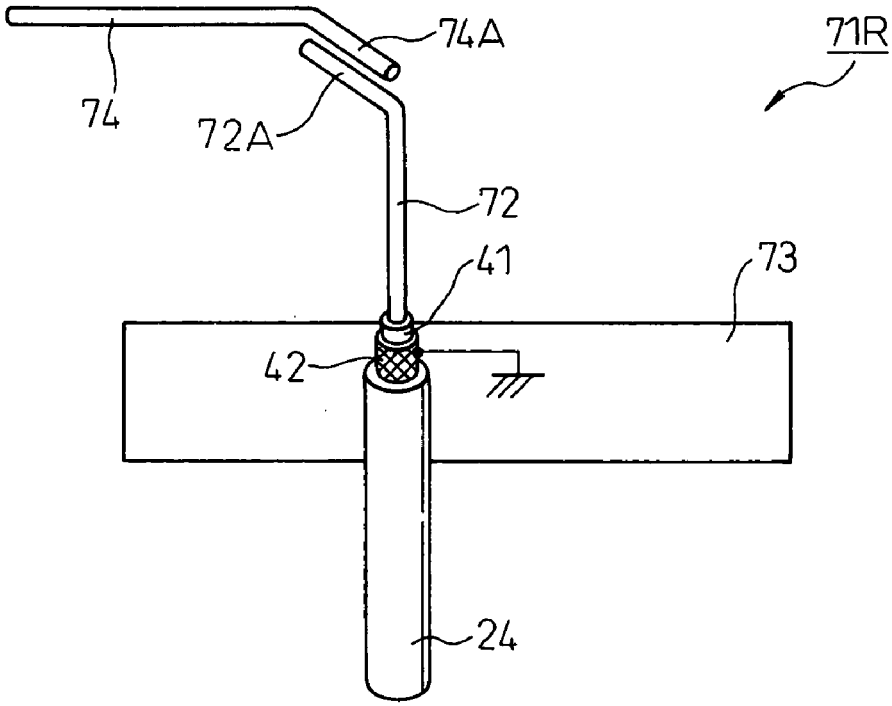
FIG. 24B is a view of the basic configuration of the circular polarization antenna of the present invention for receiving a right-hand rotating circular polarized wave.

FIG. 24B shows the basic configuration of a right-hand rotating circular polarization antenna 71R of an embodiment of the present invention for receiving a right-hand rotating circular polarized wave. The right-hand rotating circular polarization antenna 71R of this embodiment is configured by a monopole antenna 72, a ground plate 73, and a non-powered conductor 74 in the same way as the left-hand rotating circular polarization antenna 71L. The power feed point of the monopole antenna 72 is connected to the core wire 41 of the coaxial cable 24, and the ground plate 73 is connected to the ground line 42 of the coaxial cable 24 in the same way as above. Further, while the non-powered conductor 74 was arranged at the right side in the figure with respect to the monopole antenna 72 in the left-hand rotating circular polarization antenna 71L, it is arranged at the left side of the figure with respect to the monopole antenna 72 in the right-hand rotating circular polarization antenna 71R.

In this embodiment as well, the front end 72A comprised of the free end of the monopole antenna 72 is bent obliquely, one end 74A of the non-powered conductor 74 is bent obliquely, and the two are arranged parallel in close contact. Namely, one end 74A of the non-powered conductor 74 and the front end 72A of the monopole antenna 72 form a power transfer part in the right-hand rotating circular polarization antenna 71R as well. The length (including also the portion of one end 74A) of the non-powered conductor 74 in the right-hand rotating circular polarization antenna 71R may be the same as the left-hand rotating circular polarization antenna 71L and becomes a length of ½ or more of the wavelength of the wave of the reception frequency of the right-hand rotating circular polarization antenna 71R or a length of a whole multiple of the ½ wavelength.

Figure 25A:
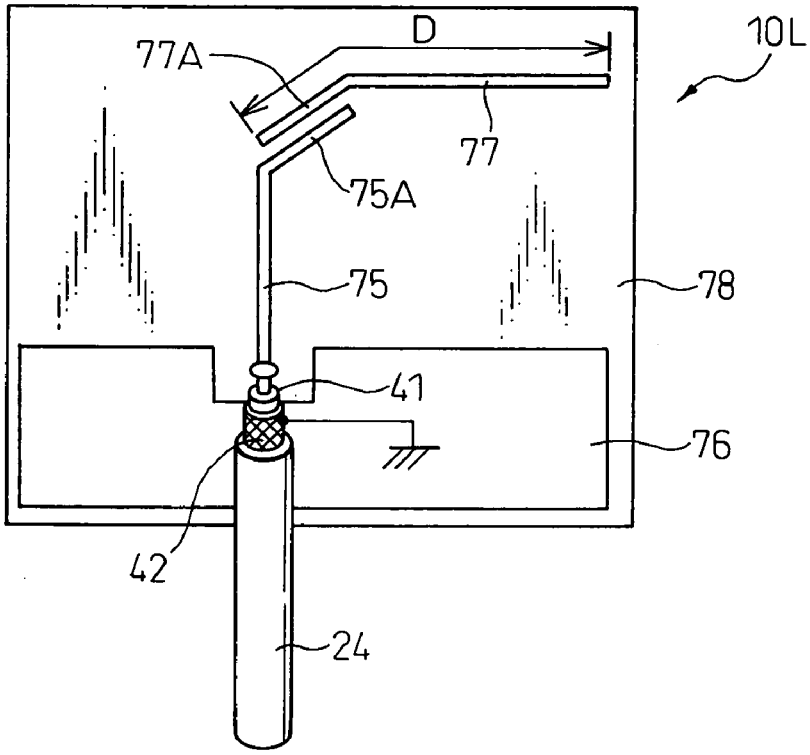
FIG. 25A is a view of the basic configuration of a case where the circular polarization antenna of the present invention for receiving a left-hand rotating circular polarized wave is formed on a dielectric film.

FIG. 25A shows the basic configuration of an embodiment of a left-hand rotating circular polarization antenna 10L of the present invention for receiving a left-hand rotating circular polarized wave formed on a dielectric film 78. The left-hand rotating circular polarization antenna 10L of this embodiment is configured so that a monopole antenna 75, a ground pattern 76, and a non-powered element 77 are formed on a dielectric film 78 by patterns. The power feed point of the monopole antenna 75 is connected to the core wire 41 of the coaxial cable 24, and the ground pattern 76 is connected to the ground line 42 of the coaxial cable 24. The non-powered element 77 is not electrically connected to the monopole antenna 75, but formed near the front end comprised of the free end of the monopole antenna 75 in a direction orthogonal to the monopole antenna 75.

In this embodiment, the front end 75A of the pattern of the monopole antenna 75 is formed obliquely bent, one end 77A of the pattern of the non-powered element 77 is bent obliquely, and the two are arranged close in parallel. Namely, one end 77A of the non-powered element 77 and the front end 75A of the monopole antenna 75 form a power transfer part, so the non-powered element 77 can transfer power with the monopole antenna 75. The length (including also the portion of one end 77A) D of the non-powered element 77 in this embodiment becomes a length of ½ or more of the wavelength of the wave of the reception frequency of the left-hand rotating circular polarization antenna 10L or a length of a whole multiple of the ½ wavelength.

Figure 25B:
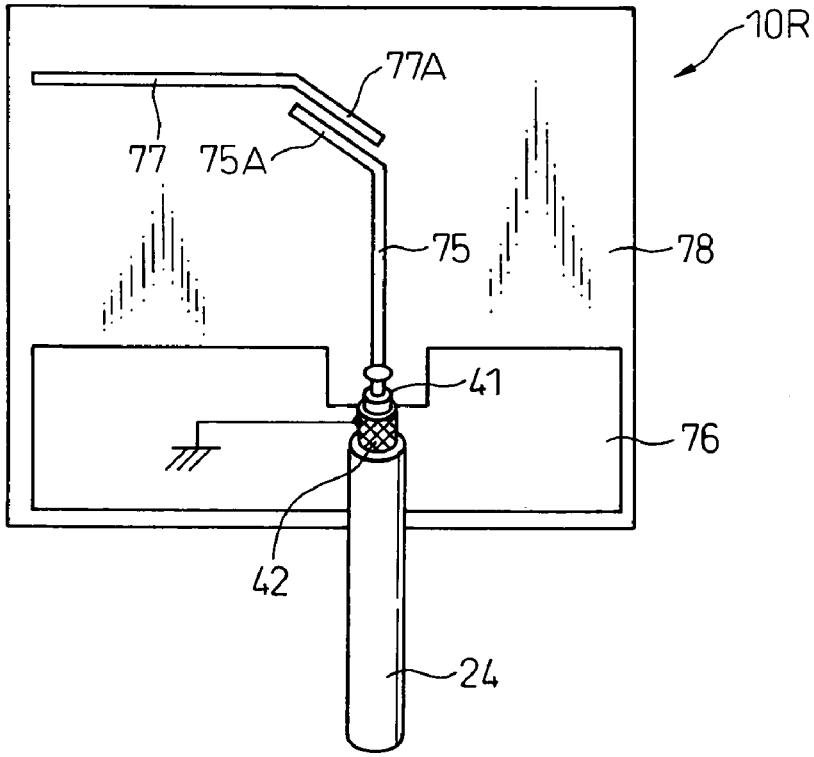
FIG. 25B is a view of the basic configuration of a case where the circular polarization antenna of the present invention for receiving a right-hand rotating circular polarized is formed on a dielectric film.

FIG. 25B shows the basic configuration of an embodiment of a right-hand rotating circular polarization antenna 10R of the present invention for receiving a right-hand rotating circular polarized wave formed on the dielectric film 78. The right-hand rotating circular polarization antenna 10R of this embodiment, in the same way as the left-hand rotating circular polarization antenna 10L, is configured by forming the monopole antenna 75, the ground pattern 76, and the non-powered element 77 on a dielectric film 78 by patterns. The power feed point of the monopole antenna 75 is connected to the core wire 41 of the coaxial cable 24, and the ground pattern 76 is connected to the ground line 42 of the coaxial cable 24 in the same way as above. Further, while the non-powered element 77 was arranged at right side of the figure with respect to the monopole antenna 75 in the left-hand rotating circular polarization antenna 10L, it is arranged at the left side of the figure with respect to the monopole antenna 75 in the right-hand rotating circular polarization antenna 10R.

In this embodiment as well, the front end 75A comprising the free end of the monopole antenna 75 is obliquely bent, one end 77A of the non-powered element 77 is obliquely bent, and the two are arranged close in parallel. Namely, in the right-hand rotating circular polarization antenna 10R as well, one end 77A of the non-powered element 77 and the front end 75A of the monopole antenna 75 form a power transfer part. The length (including also the portion of the one end 77A) of the non-powered element 77 in the right-hand rotating circular polarization antenna 10R may be the same as that of the left-hand rotating circular polarization antenna 10L and becomes a length of ½ or more of the wavelength of the wave of the reception frequency of the right-hand rotating circular polarization antenna 10R or a length of a whole multiple of the ½ wavelength.

Below, an explanation will be given of modifications of the circular polarization antenna of the present invention formed on this dielectric film 78 focusing on embodiments for receiving a left-hand rotating circular polarized wave.

Figure 26A:
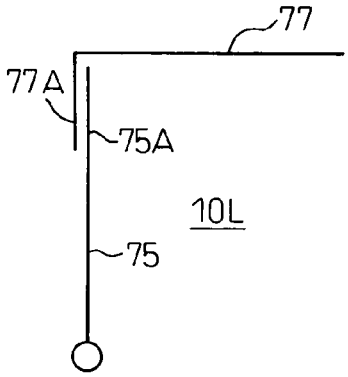
FIGS. 26A to 26H are explanatory views of embodiments of a variety of shapes of a power transfer part of the circular polarization antenna of the present invention.
Figure 26B:
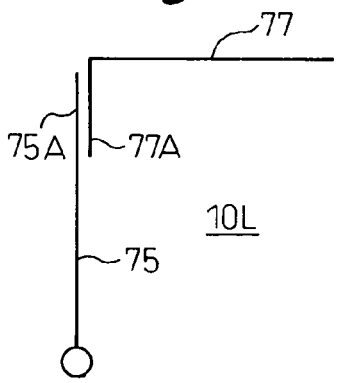
Figure 26C:
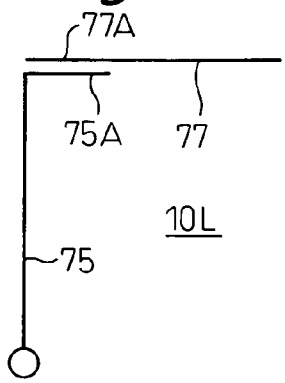
Figure 26D:
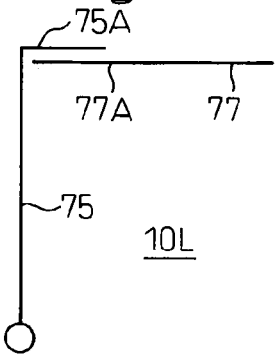

FIGS. 26A to 26H are explanatory views of embodiments of a variety of shapes of the power transfer part of the left-hand rotating circular polarization antenna 10L of the present invention explained in FIG. 25A. Circle marks in these diagrams show power feed terminals. FIG. 26A shows an embodiment in which the front end 75A comprised of the free end of the monopole antenna 75 is not bent, but one end 77A of the non-powered element 77 is bent at a right angle and is close to the left side of this front end 75A. FIG. 26B shows an embodiment in which the front end 75A of the monopole antenna 75 is not bent, but one end 77A of the non-powered element 77 is bent at a right angle and is close to the right side of this front end 75A. FIG. 26C shows an embodiment in which the front end 75A of the monopole antenna 75 is bent to the right side at a right angle, while the end 77A of the non-powered element 77 is not bent and is close to the top side of this front end 75A. FIG. 26D shows an embodiment in which the front end 75A of the monopole antenna 75 is bent at a right angle to the right side, while the end 77A of the non-powered element 77 is not bent and is close to the bottom side of this front end 75A.

Figure 26E:
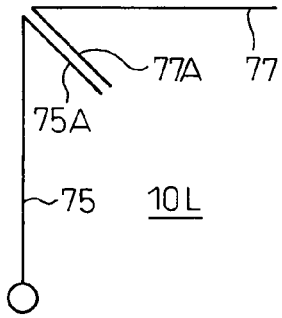
Figure 26F:
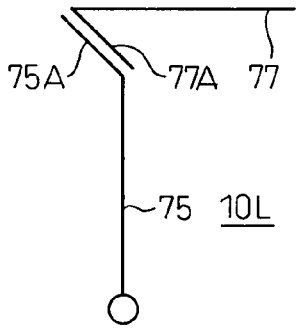
Figure 26G:
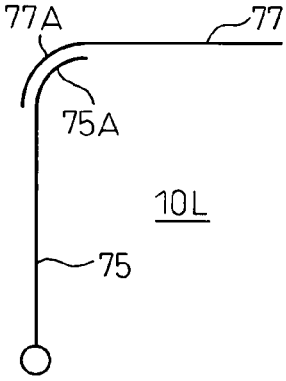
Figure 26H:
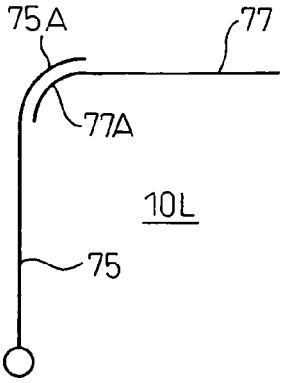

FIG. 26E shows an embodiment in which the front end 75A of the monopole antenna 75 is obliquely bent to the bottom right, one end 77A of the non-powered element 77 is bent to the bottom right, and the two are arranged in parallel. FIG. 26F shows an embodiment in which the front end 75A of the monopole antenna 75 is obliquely bent to the top left, one end 77A of the non-powered element 77 is bent to the bottom right, and the two are arranged in parallel. FIG. 26G shows an embodiment in which the front end 75A of the monopole antenna 75 is curved to the top right, while one end 77A of the non-powered element 77 is curved to the bottom left and arranged in parallel to the outside of this front end 75A. FIG. 26H shows an embodiment in which the front end 75A of the monopole antenna 75 is curved to the top right, while one end 77A of the non-powered element 77 is curved to the bottom left and arranged in parallel to the inside of this front end 75A.

Figure 27A:
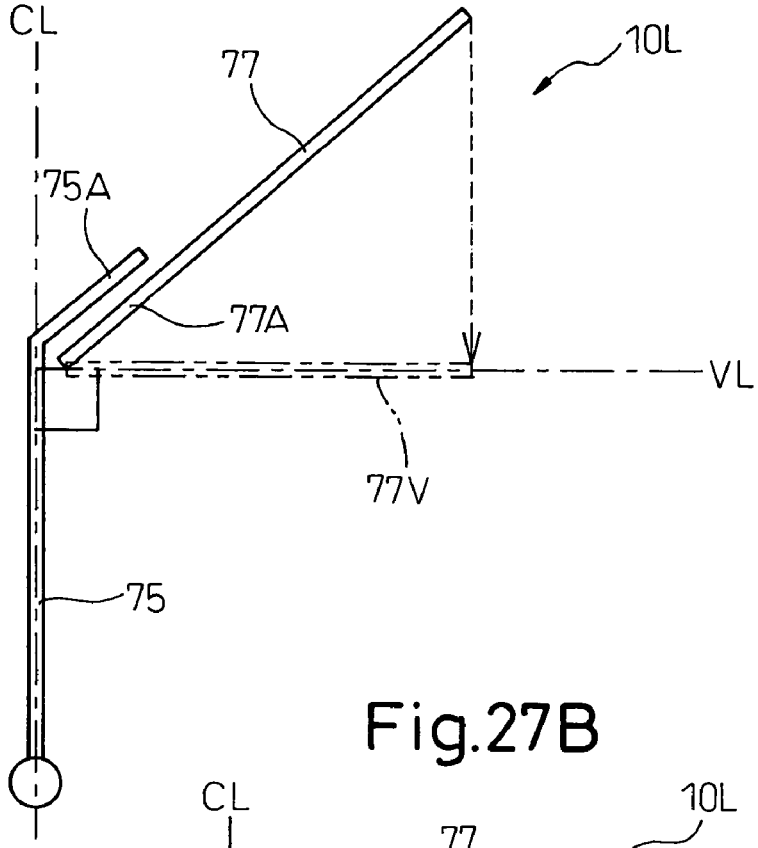
FIG. 27A is a view of the configuration of a modification of the circular polarization antenna of the present invention.

FIG. 27A shows the configuration of a modification of the circular polarization antenna 10L of the present invention. In the above embodiments, the non-powered element 77 was arranged in a direction orthogonal to the monopole antenna 75. In the non-powered element 77 in the present invention, however, there may be a component orthogonal to the monopole antenna 75, and it is not always necessary to arrange the same in a direction orthogonal to the monopole antenna 75.

Namely, in the embodiment shown in FIG. 27A, the front end 75A of the monopole antenna 75 is formed while being bent in the top right direction, and the non-powered element 77 having one end 77A and the body portion in a straight line state is formed parallel with this front end 75A. In this case, even if the non-powered element 77 becomes oblique with respect to the monopole antenna 75, the non-powered element 77 has an antenna component 77V (axial line VL) indicated by the two dotted chain line in the direction orthogonal to the axial line CL of the monopole antenna 75, therefore the circular polarization antenna 10L having this configuration can receive a circular polarized wave (left-hand rotating circular polarized wave).

Figure 27B:
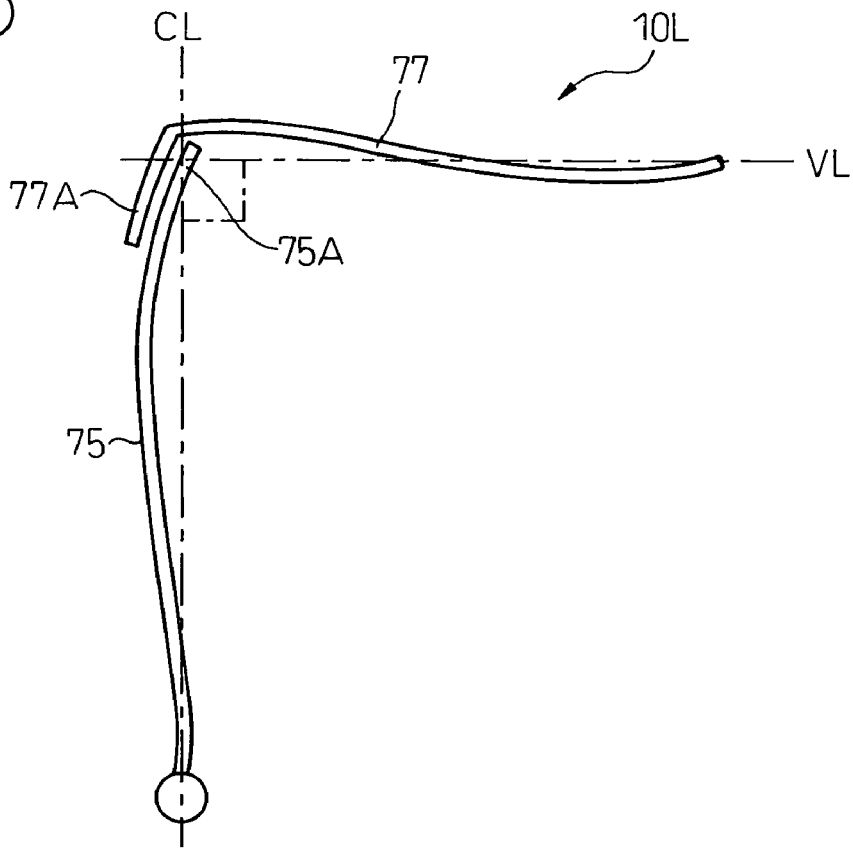
FIG. 27B is a view of the configuration of another modification of the circular polarization antenna of the present invention.

FIG. 27B shows the configuration of another modification of the circular polarization antenna 10L of the present invention. In the above embodiments, the monopole antenna 75 and the non-powered element 77 formed straight lines. However, the monopole antenna 75 and the non-powered element 77 in this embodiment are curved with respect to the axial line CL and the axial line VL orthogonal to this. In the circular polarization antenna 10L of this embodiment, however, the monopole antenna 75 has a component of the axial line CL direction, and the non-powered element 77 has a component of the axial line VL in a direction orthogonal to the axial line CL, therefore the circular polarization antenna 10L having this configuration can receive a circular polarized wave (left-hand rotating circular polarized wave). In this way, the monopole antenna 75 and the non-powered element 77 used in the circular polarization antenna 10L of the present invention do not always have to form straight lines.

Figure 28A:
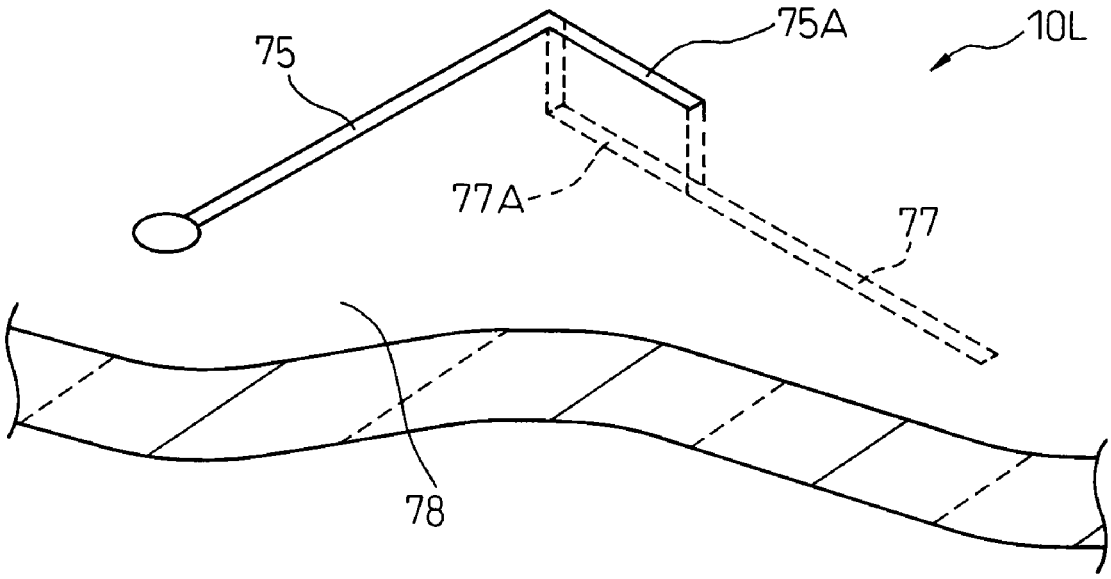
FIG. 28A is a partially cutaway perspective view of the configuration of another modification of the circular polarization antenna of the present invention.
Figure 28B:
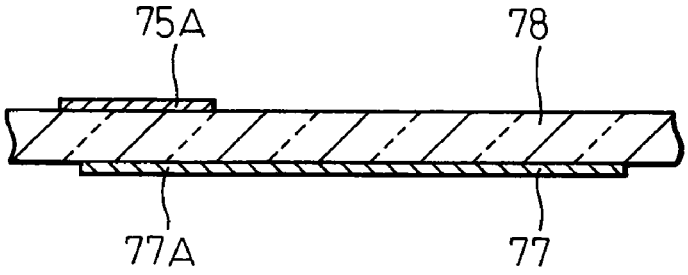
FIG. 28B is a sectional view of principal parts of FIG. 28A.

FIG. 28A shows the configuration of another modification of the portions of the monopole antenna 75 and the non-powered element 77 of the circular polarization antenna 10L of the present invention, and FIG. 28B shows a cross-section of principal portions of FIG. 28A. In the embodiments explained hitherto, the monopole antenna 75 and the non-powered element 77 were located on the same plane, but in this embodiment, the monopole antenna 75 is formed at a front side of the dielectric film 78, and the non-powered element 77 is formed at a back side of the dielectric film 78. When the monopole antenna 75 and the non-powered element 77 are formed on the same plane, as shown in FIG. 26C or FIG. 26D, it was necessary to arrange the front end 75A of the monopole antenna 75 and the end 77A of the non-powered element 77 in parallel. On the other hand, in this embodiment, the end 77A of the non-powered element 77 is arranged at the back surface right under the front end 75A of the bent monopole antenna 75 so as to form the power transfer part. In this way, the monopole antenna 75 and the non-powered element 77 do not have to be provided on the same plane.

Figure 29A:
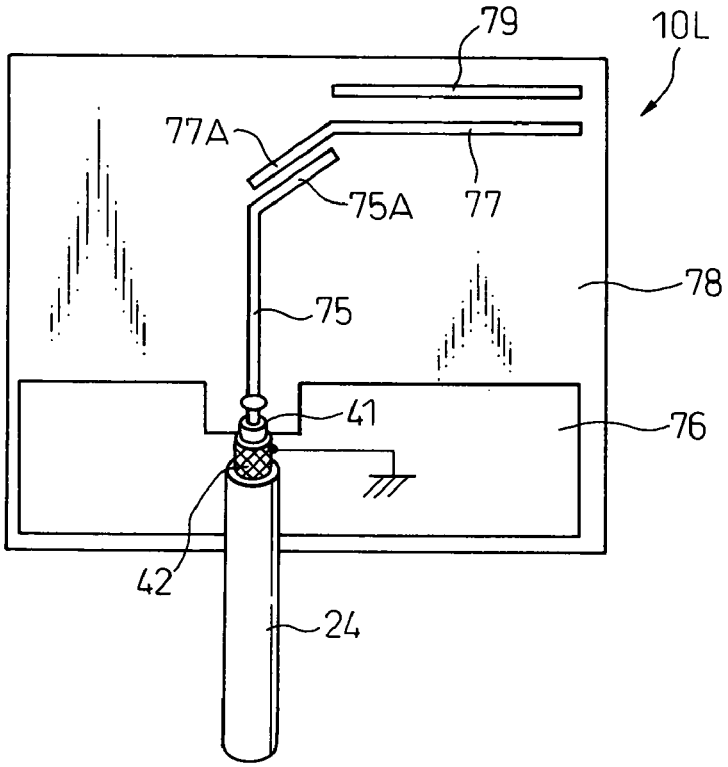
FIG. 29A is a view of the configuration of a modification of the circular polarization antenna of the embodiment of FIG. 25A obtained by forming the circular polarization antenna of the present invention for receiving a left-hand rotating circular polarized wave on a dielectric film.
Figure 29B:
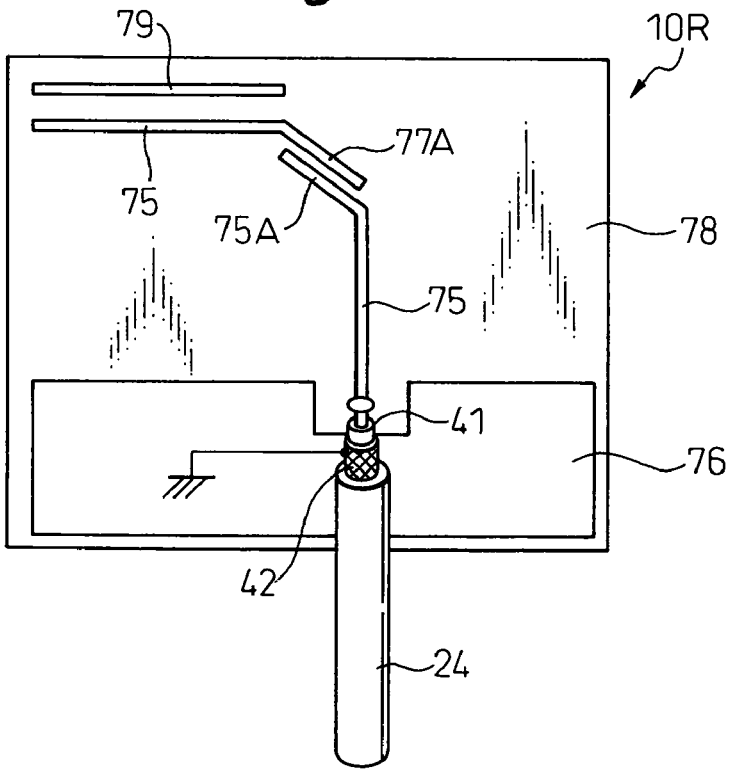
FIG. 29B is a view of the configuration of a modification of the circular polarization antenna of FIG. 25B obtained by forming the circular polarization antenna of the present invention for receiving a right-hand rotating circular polarized wave on a dielectric film.

FIG. 29A shows the configuration of a modification of the left-hand rotating circular polarization antenna 10L of FIG. 25A, and FIG. 29B shows the configuration of a modification of the right-hand rotating circular polarization antenna 10R of FIG. 25B. Accordingly, the same reference numerals are assigned to the same portions, and the explanations thereof will be omitted. In these modifications, on the side of the non-powered element 77 away from the monopole antenna 75, a second non-powered element 79 electrically connected to neither the monopole antenna 75 nor the non-powered element 77 is provided. The second nonpowered element 79 is formed parallel to the non-powered element 77. This second non-powered element 79 is provided so as to function as a waveguide or reflector as will be explained in detail later.

Figure 30A:
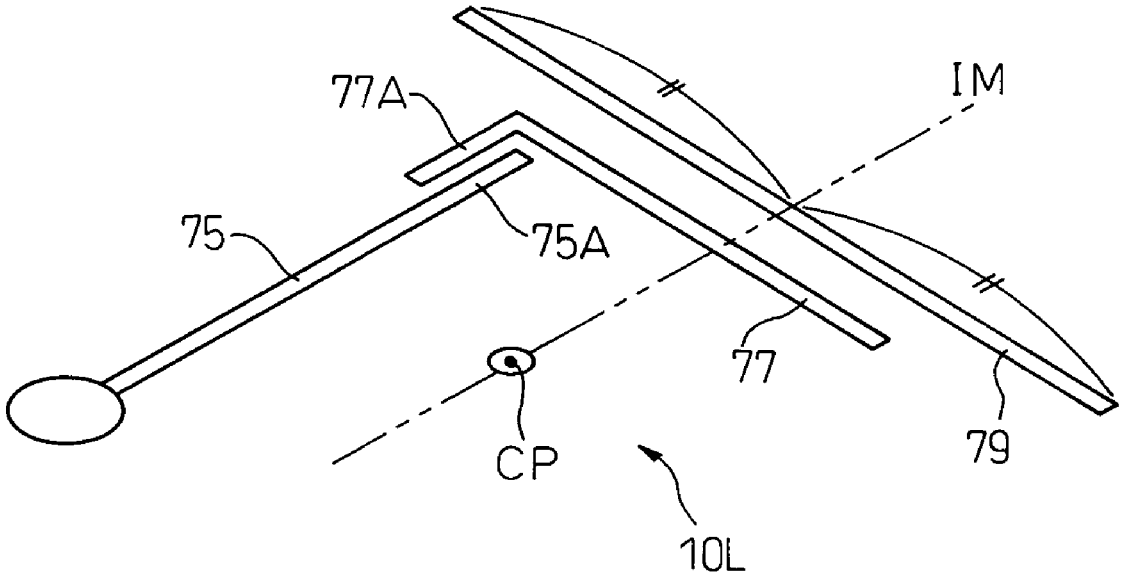
FIG. 30A is a view of an example of the positional relationships with the circular polarization antenna in the case where a second non-powered element is provided in the circular polarization antenna of the present invention.

FIG. 30A is for explaining an example of the positional relationship with the circular polarization antenna 10L when the second non-powered element 79 is provided in the circular polarization antenna 10L of the present invention. The second non-powered element 79 is provided so that an imaginary line IM located at substantially the center position thereof and orthogonal to it passes through the center point CP of the circular polarization antenna 10L configured by the monopole antenna 75 and the non-powered element 77. When the second non-powered element 79 is located at the center point CP of the circular polarization antenna 10 or a position near that, the second non-powered element 79 effectively functions as a waveguide or reflector.

Figure 30B:
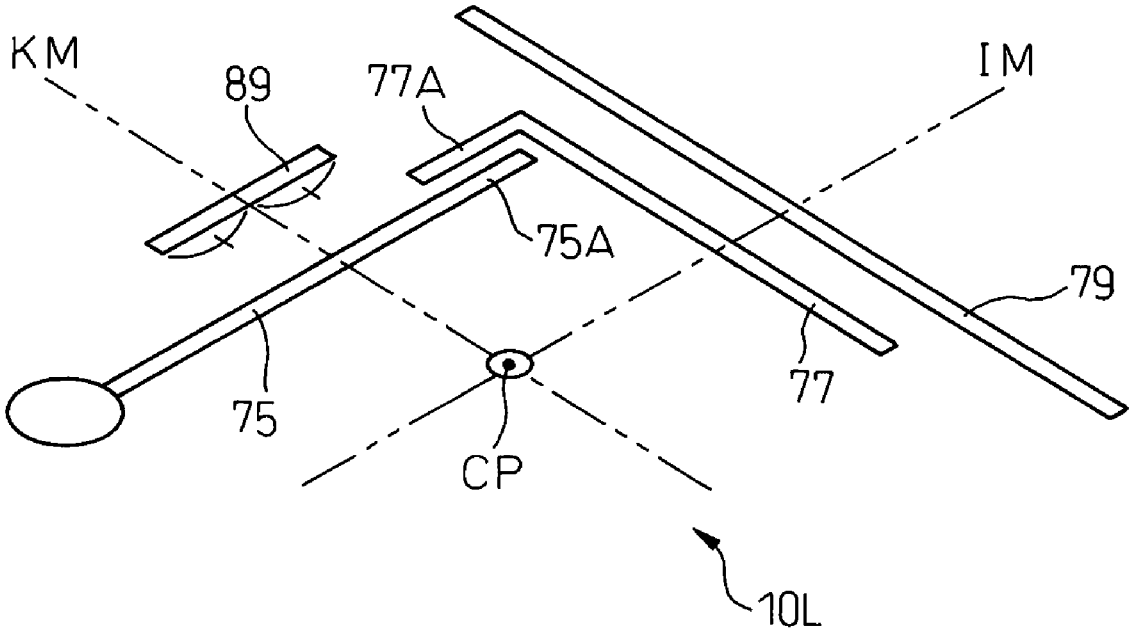
FIG. 30B is a view of another example of the positional relationships with the circular polarization antenna in a case where a second non-powered element is provided in the circular polarization antenna of the present invention.

FIG. 30B shows an embodiment in which the circular polarization antenna 10L having the configuration of FIG. 30A is provided with still another non-powered element 89 (hereinafter referred to as a "third non-powered element 89"). The third non-powered element 89 is provided so that an imaginary line KM located at substantially the center position thereof and orthogonal to it passes through the center point CP of the circular polarization antenna 10L configured by the monopole antenna 75 and the non-powered element 77. When this third non-powered element 89 is located at the center point CP of the circular polarization antenna 10 or a position near that, the third non-powered element 89 effectively functions as a waveguide or reflector.

Figure 31A:
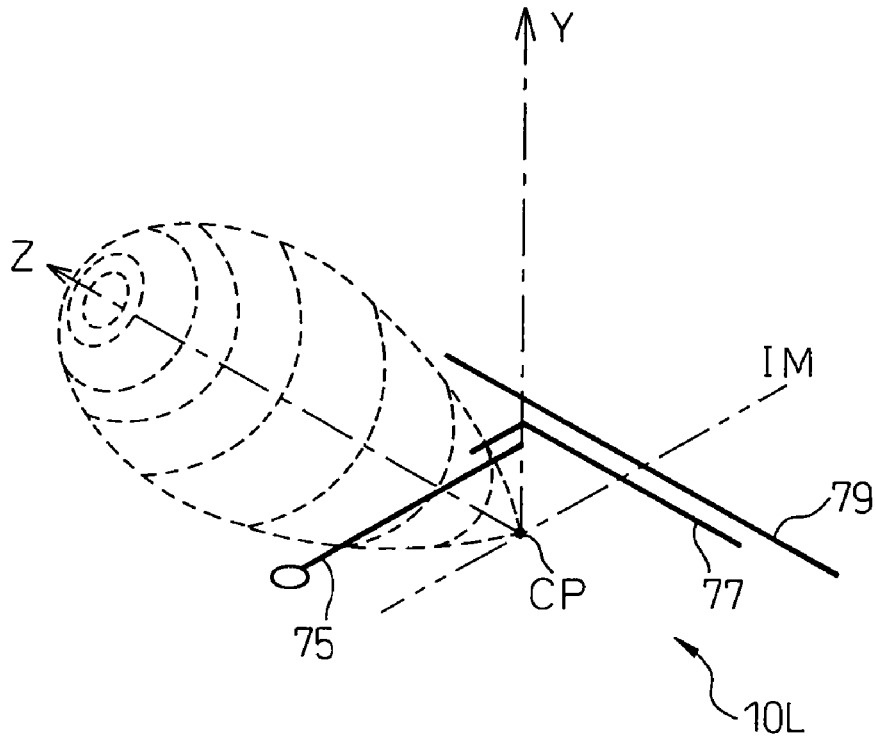
FIG. 31A is a view of an embodiment of arranging a second non-powered element having a length of ½ or more of the wavelength of the wave of the transmission and/or reception frequency of the circular polarization antenna near the circular polarization antenna.
Figure 31B:
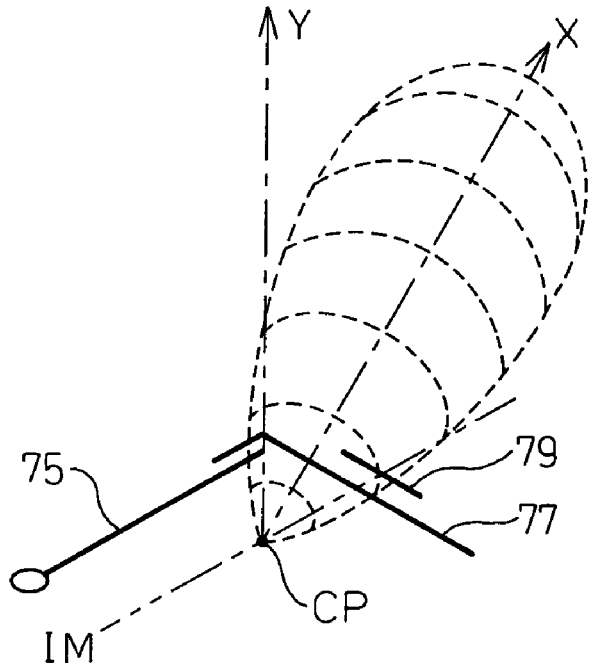
FIG. 31B is a view of an embodiment of arranging a second non-powered element having a length of less than ½ of the wavelength of the wave of the transmission and/or reception frequency of the circular polarization antenna near the circular polarization antenna.

FIGS. 31A and 31B are for explaining the change of the directivity of the circular polarization antenna 10L when the length of the second non-powered element 79 shown in FIG. 30A is made longer or shorter. First, FIG. 31A shows the directivity of the circular polarization antenna 10L when a second non-powered element 79 having the length of ½ or more of the wavelength of the wave of the transmission and reception frequency of the circular polarization antenna 10L is arranged near the non-powered element 77. In this case, the second non-powered element 79 functions as a reflector. As a result, the directivity of reception of the circular polarization antenna 10L becomes the direction of the directive axis Z oriented obliquely upward on the opposite side of the second non-powered element 79 with respect to the vertical axis Y extending from the center point CP of the circular polarization antenna 10L.

FIG. 31B shows the directivity of the circular polarization antenna 10 when a second non-powered element 79 having a length of less than ½ of the wavelength of the wave of the transmission and reception frequency of the circular polarization antenna 10L is arranged near the non-powered element 77. In this case, the second non-powered element 79 functions as a waveguide. As a result, the directivity of the reception of the circular polarization antenna 10L becomes the direction of the directive axis X oriented obliquely upward on the same side as the second non-powered element 79 with respect to the vertical axis Y extending from the center point CP of the circular polarization antenna 10L.

Figure 32A:
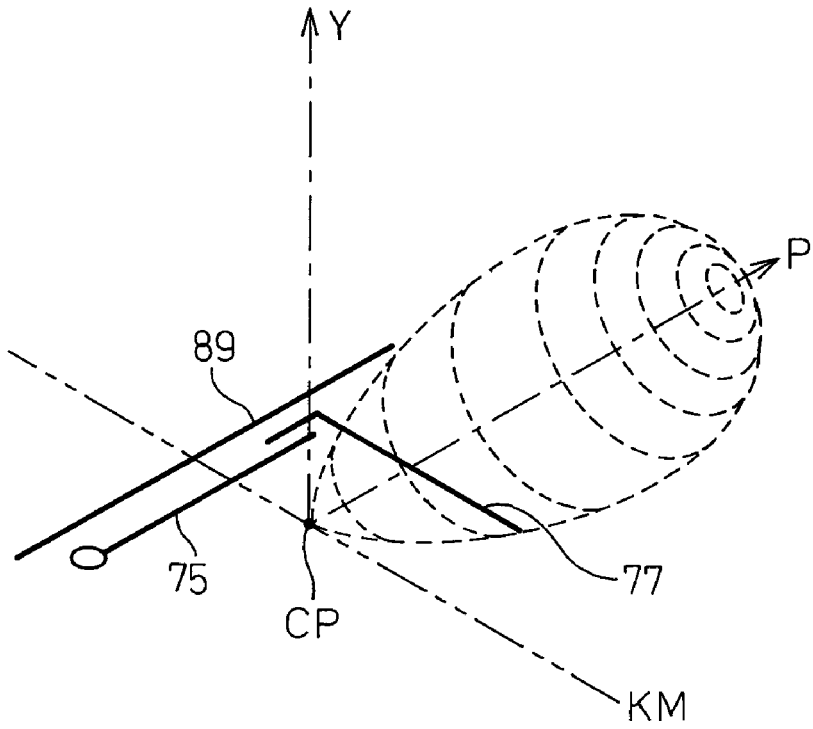
FIG. 32A is a view of an embodiment of arranging a second non-powered element having length of ½ or more of the wavelength of the wave of the transmission and/or reception frequency of the circular polarization antenna at another position near the circular polarization antenna.
Figure 32B:
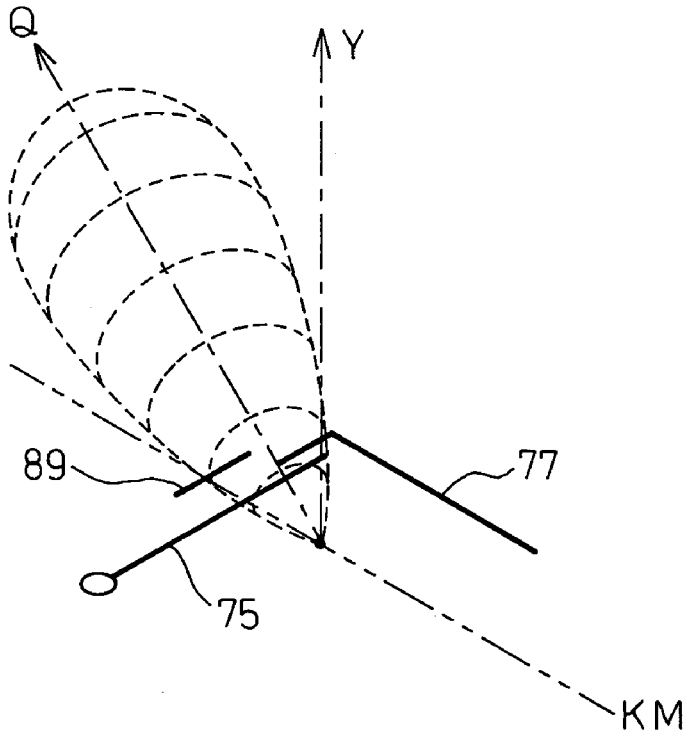
FIG. 32B is a view of an embodiment of arranging a second non-powered element having length of less than ½ of the wavelength of the wave of the transmission and/or reception frequency of the circular polarization antenna at another position near the circular polarization antenna.

FIGS. 32A and 32B are views for explaining the change of the directivity of the circular polarization antenna 10L when the length of the third non-powered element 89 shown in FIG. 30B is made longer or shorter. First, FIG. 32A shows the directivity of the circular polarization antenna 10L when a third non-powered element 89 having a length of ½ or more of the wavelength of the wave of the transmission and reception frequency of the circular polarization antenna 10L is arranged near the monopole antenna 75. In this case, the third non-powered element 89 functions as a reflector. As a result, the directivity of reception of the circular polarization antenna 10L becomes the direction of the directive axis P oriented obliquely upward on the opposite side of the third non-powered element 9 with respect to the vertical axis Y extending from the center point CP of the circular polarization antenna 10L.

FIG. 32B shows the directivity of the circular polarization antenna 10L when a third non-powered element 89 having a length of less than ½ of the wavelength of the wave of the transmission and reception frequency of the circular polarization antenna 10L is arranged near the monopole antenna 75. In this case, the third non-powered element 89 functions as a waveguide. As a result, the directivity of reception of the circular polarization antenna 10L becomes the direction of the directive axis Q oriented obliquely upward on the same side of the third non-powered element 89 with respect to the vertical axis Y extending from the center point CP of the circular polarization antenna 10L.

Figure 33:
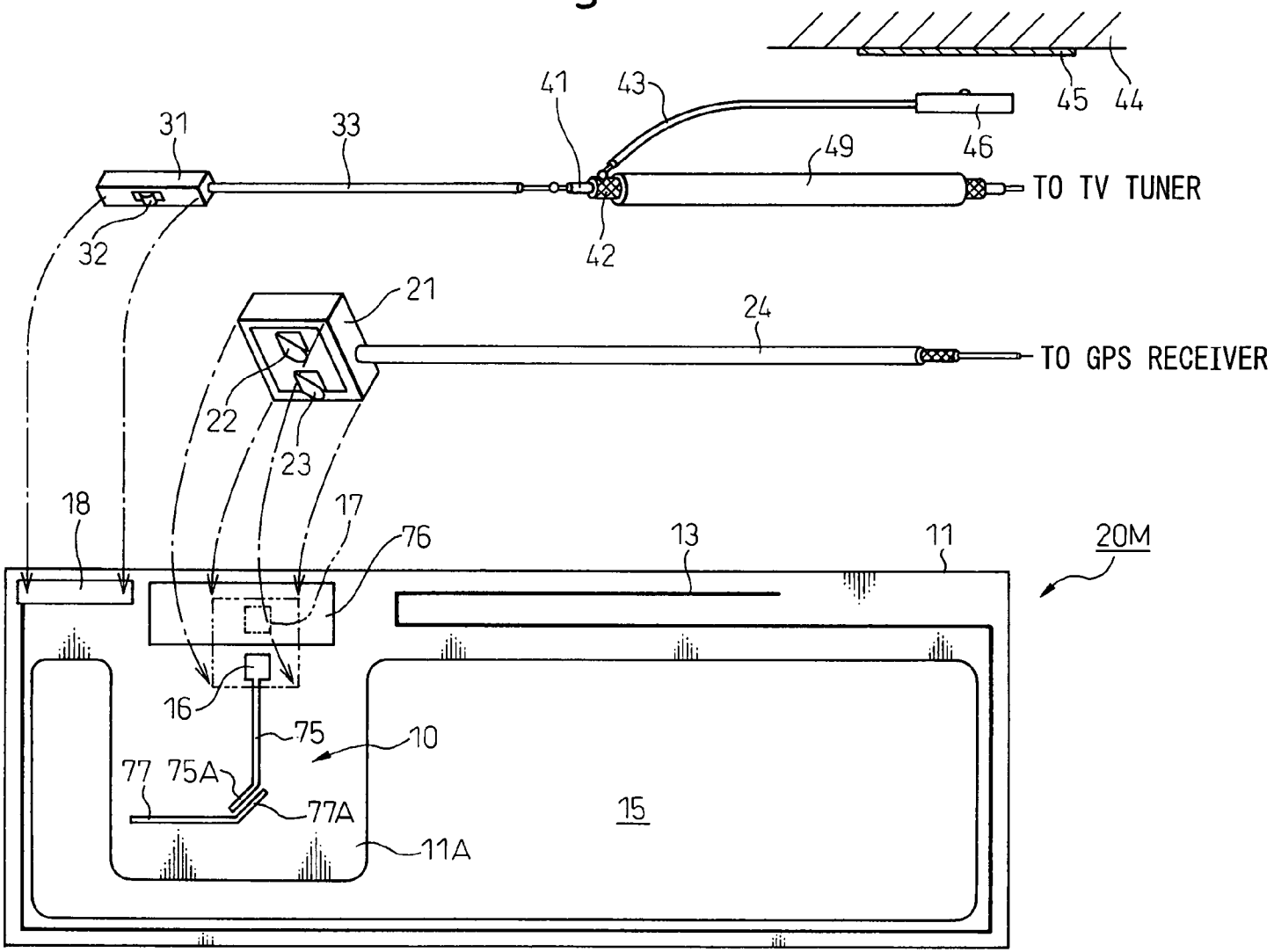
FIG. 33 is a plan view of an example of the configuration of a composite antenna using the circular polarization antenna of the present invention and explaining a cable connected to this.

FIG. 33 shows a concrete embodiment of the circular polarization antenna 10L of the present invention and shows an example of a film antenna 20M including a TV antenna 13. In the film antenna 20M of this embodiment, both of the cable 24 connected to the circular polarization antenna 10 and the cable 33 connected to the TV antenna 13 are shown. The film antenna 20M of this embodiment is provided with the circular polarization antenna 10 for receiving the circular polarized wave and the TV antenna 13 for receiving the television signal on the transparent film 11. The circular polarization antenna 10 of this example is the right-hand rotating circular polarization antenna 10R explained in FIG. 25B and is provided with the monopole antenna 75 and the non-powered element 77.

Further, FIG. 33 shows the film antenna 20M as seen from the reverse direction to the arrival direction of the wave. Namely, when the film antenna 20M is adhered to for example the inside of the windshield of an automobile, this is the view from the inside of the compartment of the automobile. The circular polarization antenna 10 seen from the inside of the compartment is arranged at the left side part of the transparent film 11 and receives a right-hand rotating circular polarized wave with a good sensitivity.

Further, the TV antenna 13 is provided along the peripheral portion of the transparent film 11, and the front end is bent. The antenna connection terminal 18 is provided at one end of the wire-like conductor configuring the TV antenna 13. In this embodiment, the part of the transparent film 11 not provided with the circular polarization antenna 1 and the TV antenna 13 is cut away and becomes an aperture part 15. This aperture part 15 is provided so as to surround the part of the transparent film 11A where the circular polarization antenna 10 is arranged. The part of the transparent film 11A in which the circular polarization antenna 10 is arranged becomes the tongue part 11A.

Further, the end of the power feed side of the monopole antenna 75 configuring the circular polarization antenna 10 is formed in a land state and becomes the power feed terminal 16. Further, a ground pattern 76 is formed near this power feed terminal 16. This ground pattern 76 includes the terminal connection part 17 to which the connection terminal 23 of the connector 21 mentioned later is connected. Further, part of the TV antenna 13 located outside of the non-powered element 77 of the circular polarization antenna 10 functions as the second non-powered element.

The wave received at the circular polarization antenna 10 can be guided to a predetermined receiver, for example, a GPS receiver, via the connector 21 and the cable 24. The connector 21 includes the connection terminal 22 connected to the power feed terminal 16 of the monopole antenna 75 and the connection terminal 23 connected to the terminal connection part 16 of the ground pattern 76. Two connection terminals 22 and 23 are provided with a spring property in this embodiment. The connector 21 may be attached to the transparent film 11 by for example two-sided adhesive tape. The mark indicated by the two-dotted chain line on the transparent film 11 of FIG. 33 is the attachment position of the connector 21. Further, inside the connector 21, an amplifier can be mounted. In this case, the connection terminal 23 is connected to the ground of the amplifier. The cable 24 connected to the connector 21 is the coaxial cable.

The total length of the monopole antenna 75 configuring the circular polarization antenna 10L is equal to the wavelength of the wave to be received when the monopole antenna 75 is arranged in a dielectric body having a dielectric constant of 1. In the case for a GPS, the length of one side of the antenna element is about 48 mm. On the other hand, when this monopole antenna 75 is arranged in a member having high dielectric constant such as glass, the total length of the antenna element can be made shorter in accordance with the shortening of the wavelength.

For example, when defining $\lambda 1$ as the wavelength at a certain specific frequency on the dielectric body, defining $\lambda 0$ as the wavelength of the wave at the same frequency as a certain specific frequency mentioned above in free space, and defining a as the wavelength shortening rate by the dielectric body around the antenna, the relationship of $\lambda 1=\alpha\times\lambda 0$ stands, therefore the total length of the antenna element can be made smaller in accordance with this wavelength shortening rate $\alpha$. Accordingly, the total length L1 of the monopole antenna 75 formed on the transparent film 11 can be made 38 mm in this embodiment. Note that, the conductor configuring the circular polarization antenna 10L may be formed by any of a conductor thin film, wire, or printing by conductive ink.

Figure 35:
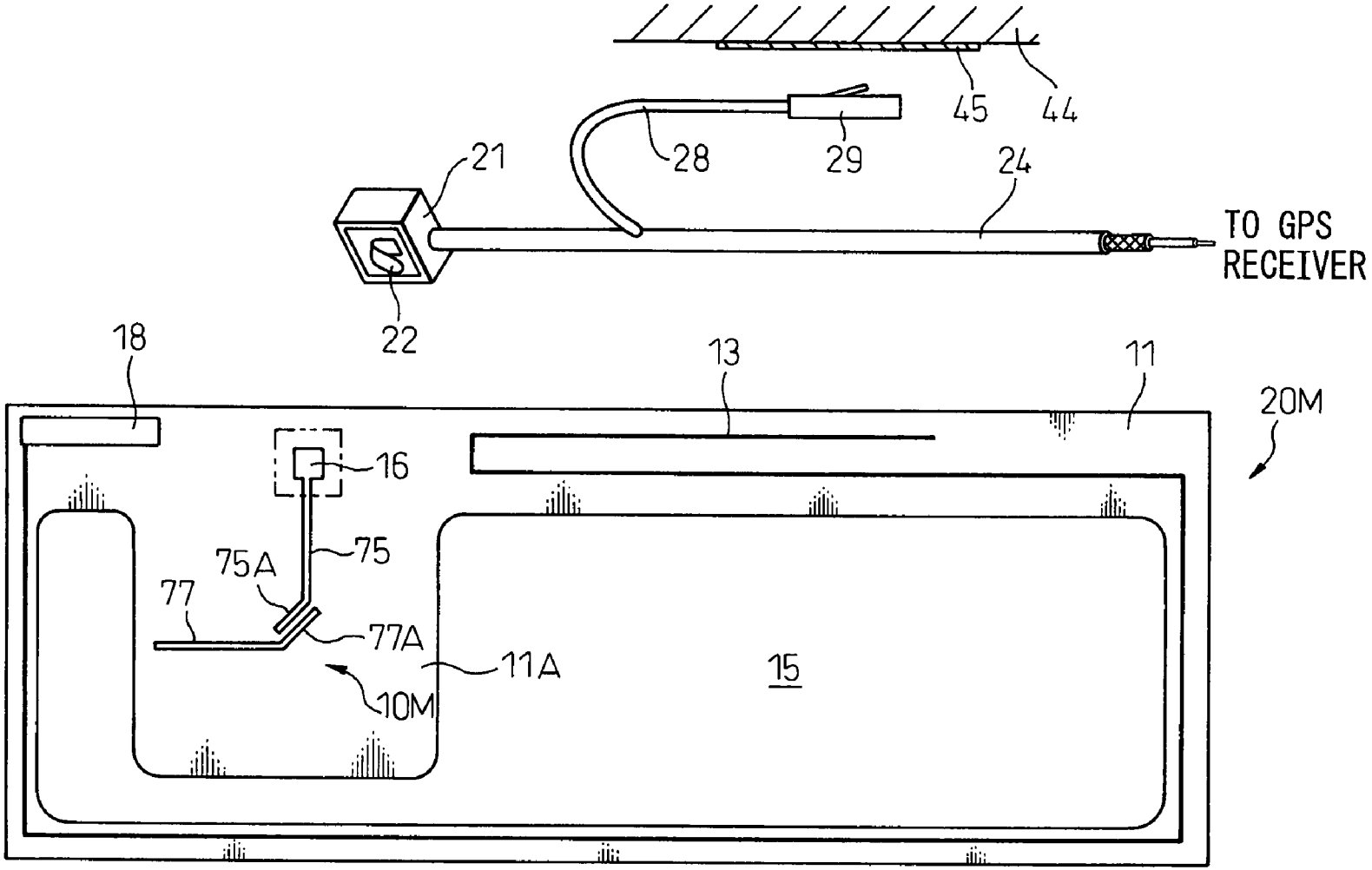
FIG. 35 is a plan view of another example of the configuration of a composite antenna using the circular polarization antenna of the present invention and explaining a cable connected to this.

FIG. 35 shows another concrete embodiment of the configuration of the film antenna 20M using a circular polarization antenna 10M of the present invention and is a view seen from the same direction as that of the film antenna 20M of the embodiment shown in FIG. 33. Note that, this FIG. 35 shows only the configuration of the cable 24 connected to the film antenna 20M. The illustration of the connector 31 and the cable 33 connected to the TV antenna 13 is omitted.

The difference of the film antenna 20M of this embodiment from the film antenna 20M of the embodiment shown in FIG. 33 resides in only the point that a ground pattern 76 is not provided on the transparent film 11 on which the circular polarization antenna 10M is arranged. Accordingly, the same reference numerals are assigned to the same portions as those in the composite antenna 20 explained in FIG. 33, and the explanations thereof will be omitted.

In this embodiment, the connector 21 attached to the front end of the coaxial cable 24 is provided with only one connection terminal 22. The amplifier 26 explained in FIG. 1 is provided inside the connector 21, and the ground thereof is connected to the not illustrated ground line of the coaxial cable 24. The connector 21 may be attached to the transparent film 11 by for example two-sided adhesive tape. A single core cable 38 is connected to the ground line of the coaxial cable 24, and a connector 29 is attached to the front end of this single core cable 38. Namely, the ground line of this coaxial cable 24 is guided to part of the automobile body 44 by the single core cable 38 and connected to metal foil 45 adhered to this body 44 by the connector 29. Namely, the ground line of the coaxial cable 24 is AC grounded by capacity coupling with the body 44 of the automobile. Accordingly, in this embodiment, it is not necessary to provide the ground pattern on the transparent film 11.

Note that, needless to say, the film antenna 20M can be provided with a plurality of circular polarization antennas and provided with other antennas for keyless entry systems etc. in a cut away manner in the same way as the film antenna 20.

Here, an explanation will be given of embodiments of mounting the antenna in a connector connected to the film antenna.

Figure 36A:
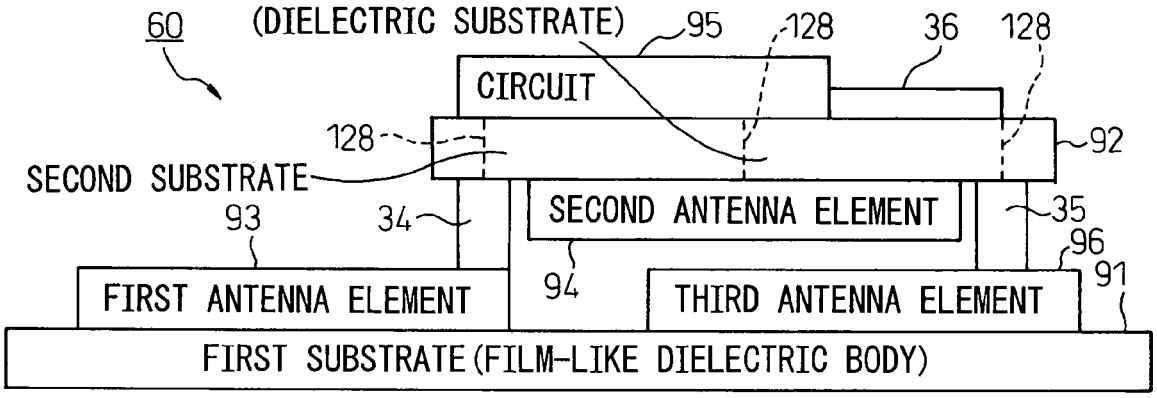
FIG. 36A is a sectional view of the basic configuration of a case where a first substrate of the composite antenna of the present invention is a film-like dielectric body.

FIG. 36A shows the basic configuration of an embodiment in which a first substrate 91 of a composite antenna 60 of the present invention is a film-like dielectric body. The first substrate 91 need only be formed with the first antenna element 93, but here, in addition to the first antenna element 93, the first substrate 91 is formed with a third antenna element 96.

A second substrate 92 is attached to the first substrate 91 configured as described above superimposed on the first substrate 91. The second substrate 92 is a dielectric substrate provided with a circuit 95 to be connected to the antenna elements formed on the first substrate 91 (in this embodiment, the first antenna element 93 and a third antenna element 96). This circuit 95 is attached to the surface opposite to the first substrate 91 among the two surfaces of the second substrate 92. Note that, there also exists a case where the third antenna element 96 is not connected to the circuit 95 on the second substrate 92, but connected to another circuit not on the second substrate 92. Then, the second antenna element 94 is provided on the surface of the second substrate 92 opposite to the first substrate 91. This second antenna element 94 may be provided on the surface of the second substrate 92 opposite to the surface facing the first substrate 91 as well. The second antenna element 94 is connected to the circuit 95 by a through hole 128.

In the state where the second substrate 92 is attached to the first substrate 91, the first antenna element 93 is connected to the circuit 95 by the connection terminal 34 and the through hole 128, and the third antenna element 96 is connected to the circuit 95 by the connection terminal 35, the through hole 128, and the conductor line 36 formed on the second substrate 92. Note that, in the state where the second substrate 92 is attached to the first substrate 91, the antenna elements 93, 94, and 96 and the circuit 95 are arranged so as not to be superimposed on each other with respect to the reception direction of the wave.

Figure 36B:
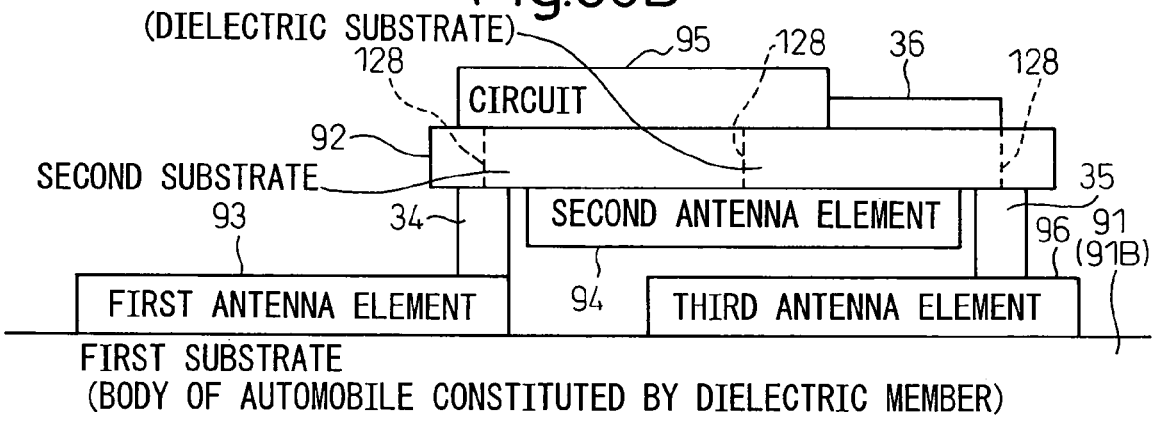
FIG. 36B is a sectional view of the basic configuration of a case where a first substrate of the composite antenna of the present invention is a part of the body of an automobile constituted by a dielectric member.
Figure 36B:
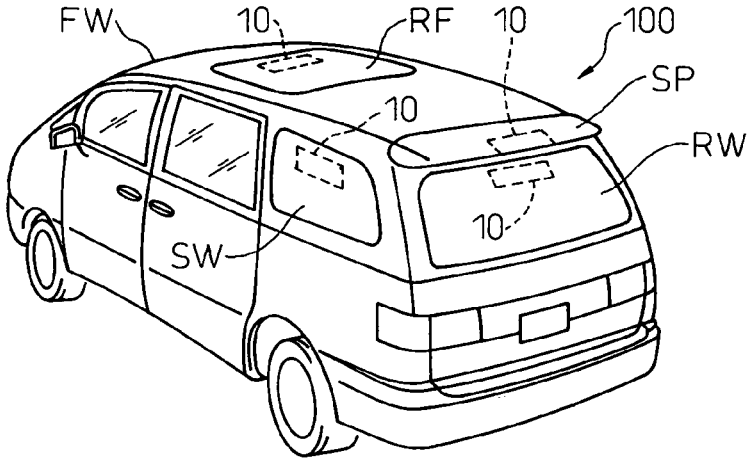

FIG. 36B shows the configuration of an embodiment of a case where the first substrate 91 of the composite antenna 60 of the present invention explained in FIG. 36A is configured by the body 91B of an automobile constituted by dielectric members. The rest of the configuration other than the first substrate 91B is exactly the same as the configuration explained in FIG. 36A, so the same reference numerals are assigned to the same portions, and the explanations thereof will be omitted.

Figure 34:
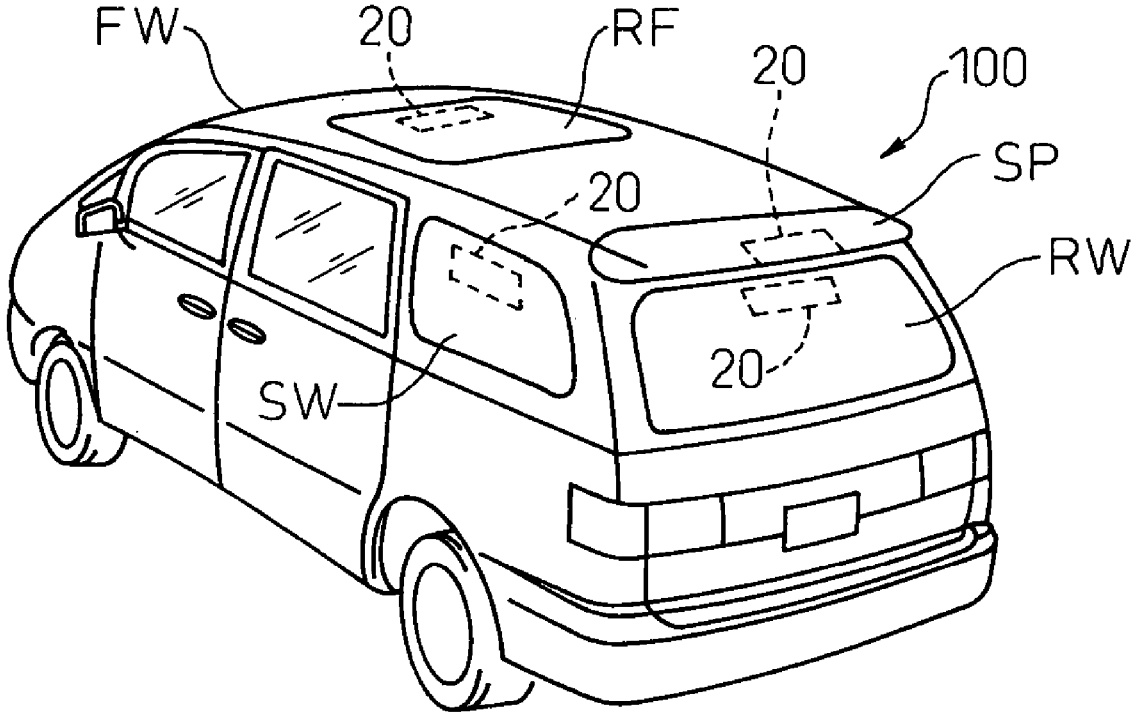
FIG. 34 is a perspective view of an automobile showing an example of an attachment position of the composite antenna shown in FIG. 33 to a vehicle.

The composite antenna 60 of the embodiment explained in FIGS. 36A and 36B or a composite antenna 60 having another configuration can be attached to the attachment position of the automobile 100 shown in FIG. 34 in the same way. For example, as shown in FIG. 36A, when the first substrate 91 is a film-like dielectric body, particularly a transparent film-like dielectric body, it can be provided adhered to the windshield FW, rear window RW, side window SW, etc. of the automobile 100 from the back surface thereof. Further, in the case of the body 91B of an automobile in which the first substrate 91 is constituted by a dielectric member, it is possible to attach the same to a rear spoiler SP made of plastic or a sunroof RF made of plastic or glass.

Figure 37A:
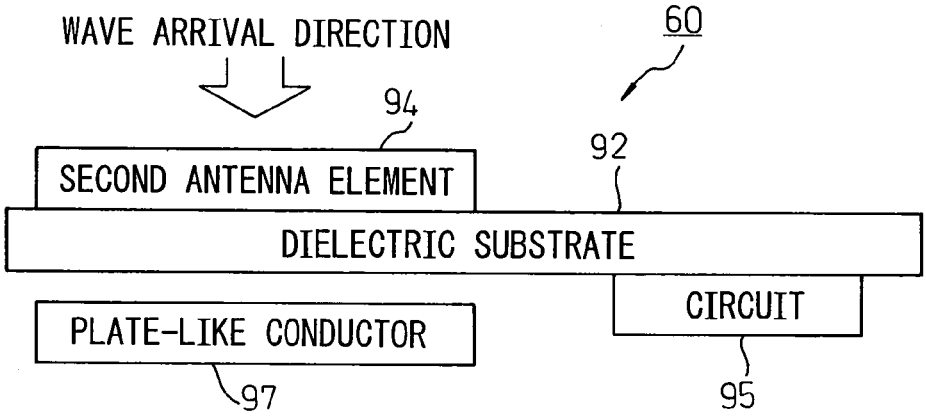
FIG. 37A is a sectional view of the configuration of a second substrate side of the composite antenna of the present invention and shows one antenna element provided on the dielectric substrate and a plate-like conductor provided away from the opposite surface of the dielectric substrate.
Figure 37B:
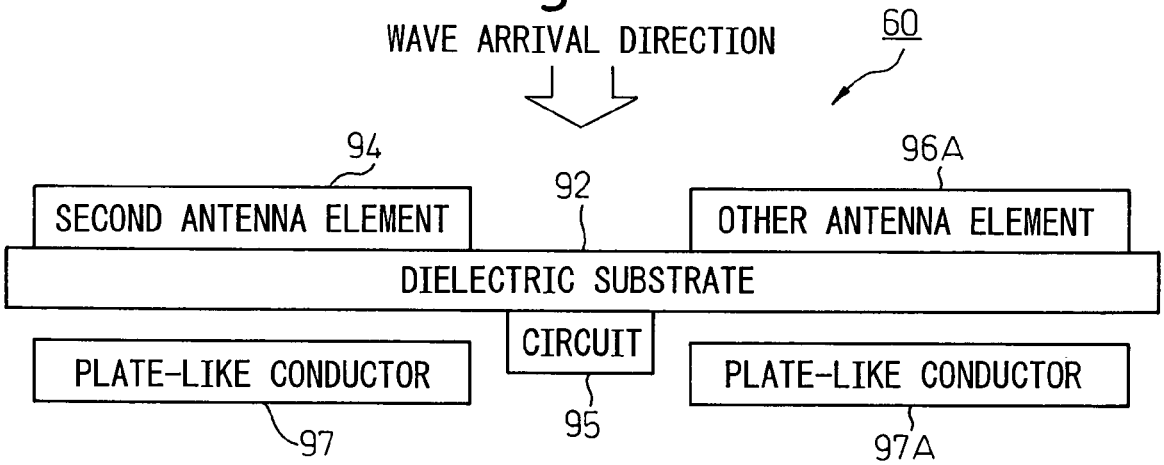
FIG. 37B is a sectional view of the configuration of a second substrate side of the composite antenna of the present invention and shows a configuration in which two antenna elements are provided on the same side of the dielectric substrate and plate-like conductors corresponding to them are provided at positions away from the opposite side surface of the dielectric substrate.

FIGS. 37A and 37B show configurations of the second substrate (dielectric substrate) 92 side of the composite antenna 60 of the present invention upside down from the diagrams shown in FIGS. 36A and 36B so that the upper side is the arrival direction of the wave. First, FIG. 37A shows an embodiment in which one antenna element (second antenna element 94) is provided on the surface of the dielectric substrate 92 in the arrival direction of the wave, and the circuit 95 is provided on the opposite surface of the dielectric substrate 92. As mentioned above, the second antenna element 94 and the circuit 95 are arranged so as not to be superimposed on each other. In this embodiment, in addition to these configurations, a configuration where a plate-like conductor 97 is provided substantially parallel to the dielectric substrate 92 away from the dielectric substrate 92 on the same side as the circuit 95 is shown. This plate-like conductor 97 is for reflecting the wave and making the wave strike the second antenna element 94. The reception sensitivity of the second antenna element 94 increases due to the plate-like conductor 97.

FIG. 37B shows the configuration of an embodiment where one more antenna element (described as "another antenna element" in the diagram) 96A is provided on the dielectric substrate 92 of the composite antenna 60 explained in FIG. 37A. In this case, plate-like conductors 97 and 97A are provided at positions facing the antenna elements 94 and 96A at positions away from the dielectric substrate 92. Note that, by tinkering with the position of the circuit 95, it is also possible to form the plate-like conductors 97 and 97A as a single plate-like conductor 97 facing both of the antenna elements 94 and 96A.

Figure 37C:
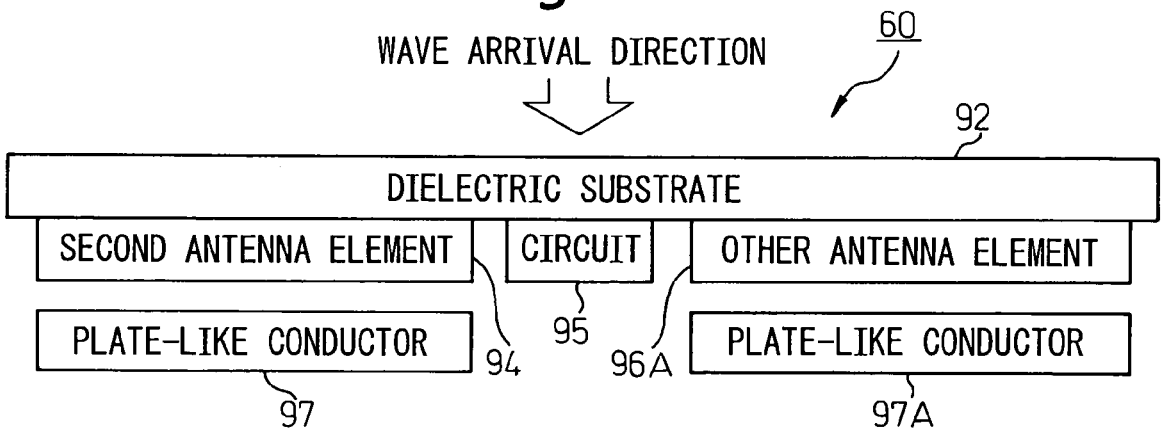
FIG. 37C sectional view of the configuration of a second substrate side of the composite antenna of the present invention and shows a configuration in which two antenna elements are provided on the same side of the dielectric substrate and plate-like conductors corresponding to them are provided at positions away from the dielectric substrate on the same side as the two antenna elements.

Note that, in FIGS. 37A and 37B, the second antenna element 94 and other antenna element 96A are provided on the surface of dielectric substrate 92 in the arrival direction of the wave, but it is also possible if the second antenna element 94 or other antenna element 96A is provided on the opposite surface of the dielectric substrate 92 to the arrival direction of the wave as shown in FIG. 37C.

Figure 38A:
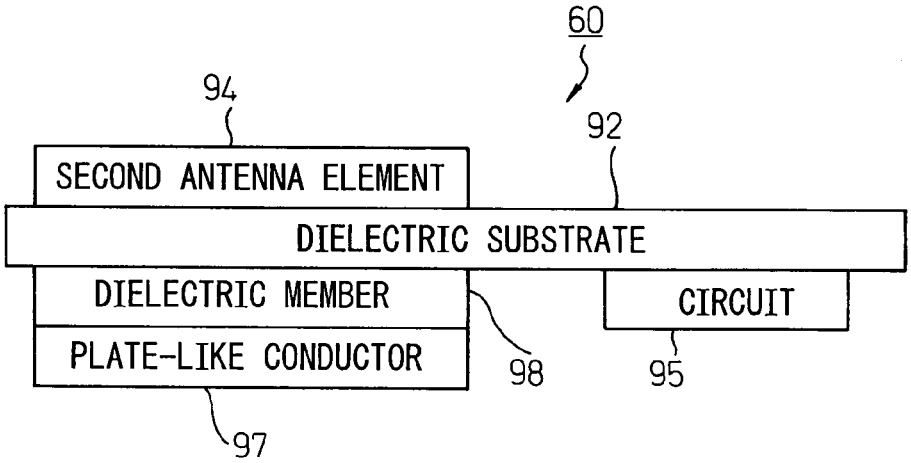
FIG. 38A is a sectional view of the configuration of a second substrate side of the composite antenna of the present invention and shows a configuration in which one antenna element is provided on the dielectric substrate and a plate-like conductor is provided on the opposite side surface of this substrate sandwiching the dielectric member therebetween.
Figure 38B:
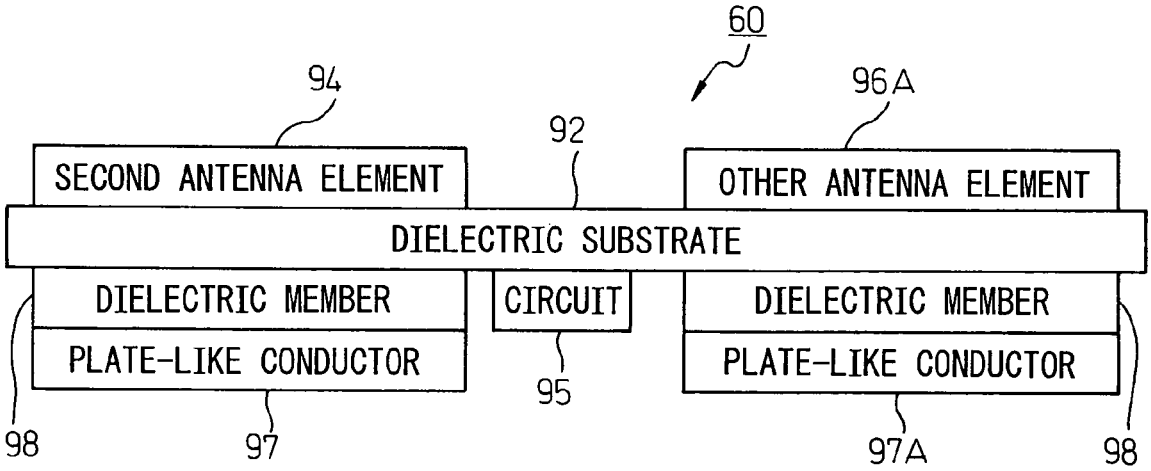
FIG. 38B is a sectional view of the configuration of a second substrate side of the composite antenna of the present invention and shows a configuration in which two antenna elements are provided on the dielectric substrate and plate-like conductors corresponding to them are provided on the opposite side surface of this substrate sandwiching the dielectric member therebetween.

FIGS. 38A and 38B also show the configuration on the second substrate (dielectric substrate) 92 side of the composite antenna 60 of the present invention and show a modification of the composite antenna 60 shown in FIGS. 37A and 37B. Accordingly, the configuration of FIG. 38A corresponds to the configuration of FIG. 37A, and the configuration of FIG. 38B corresponds to the configuration of FIG. 37B.

The difference of the composite antenna 60 shown in FIGS. 38A and 38B from the composite antenna 60 explained in FIGS. 37A and 37B resides in only the point that the plate-like conductors 97 and 97A are provided on the dielectric substrate 92 via the dielectric member 98. The material of this dielectric member 98 is for example a ceramic or plastic. Accordingly, in this modification, the same reference numerals are assigned to the same components as those shown in FIGS. 37A and 37B, and the explanations thereof will be omitted.

Figure 39A:
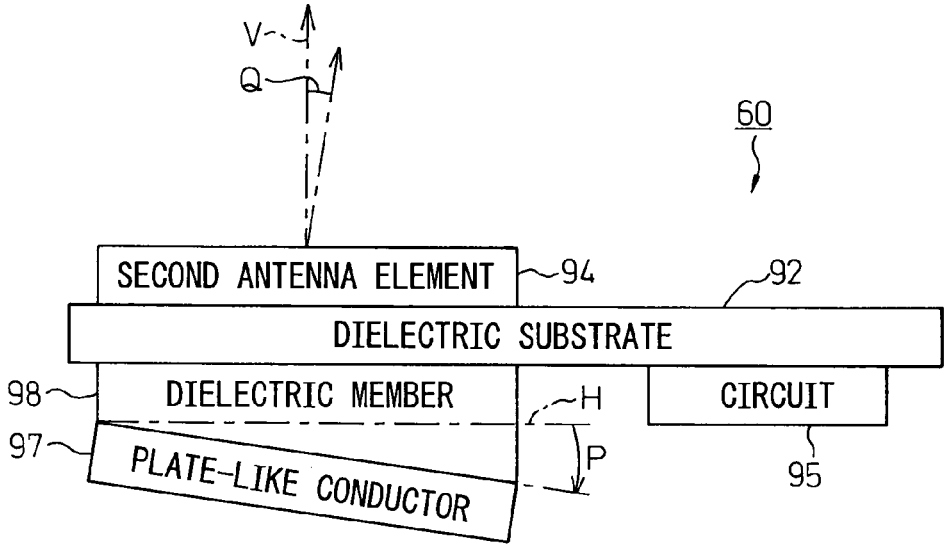
FIG. 39A is a sectional view of a configuration in which the plate-like conductor of FIG. 38A is provided while being inclined with respect to the dielectric substrate.
Figure 39B:
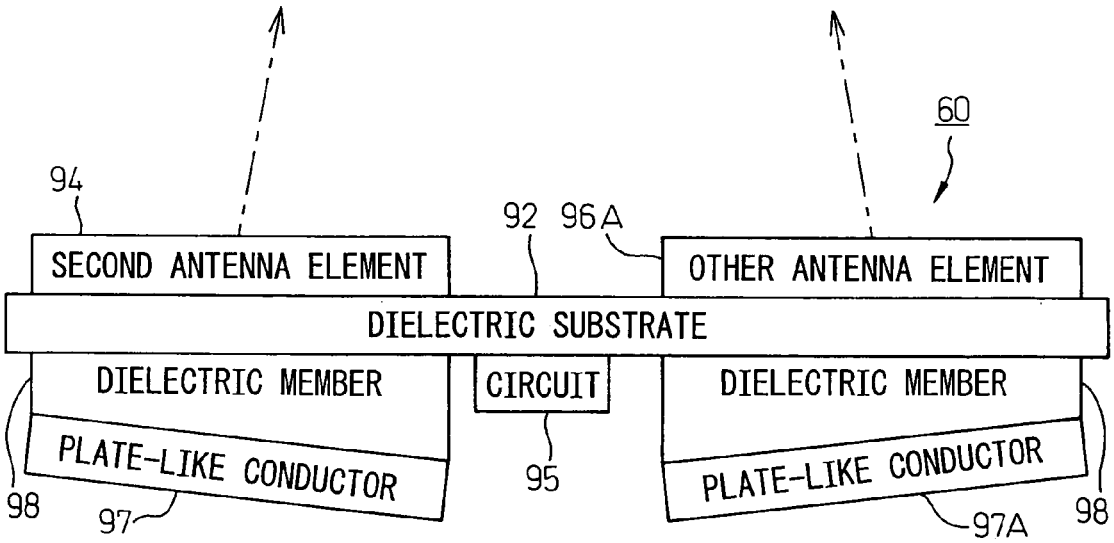
FIG. 39B is a sectional view of a configuration in which plate-like conductors of FIG. 38B are provided while being inclined in different directions with respect to the dielectric substrate.

FIGS. 39A and 39B also show the configuration of the second substrate (dielectric substrate) 92 side of the composite antenna 60 of the present invention and show a modification of the composite antenna 60 shown in FIGS. 38A and 38B. Accordingly the configuration of FIG. 39A corresponds to the configuration of FIG. 38A, and the configuration of FIG. 39B corresponds to the configuration of FIG. 38B.

The difference of the composite antenna 60 shown in FIGS. 39A and 39B from the composite antenna 60 explained in FIGS. 38A and 38B resides in only the inclination angle of the plate-like conductors 97 and 97A with respect to the dielectric member 98. Namely, in the composite antenna 60 explained in FIGS. 38A and 38B, the plate-like conductors 97 and 97A were arranged substantially parallel to the dielectric substrate 92 via the dielectric member 98, but the composite antenna 60 shown in FIGS. 39A and 39B differs in the point that the plate-like conductors 97 and 97A are provided on the dielectric substrate 92 while being inclined with respect to the dielectric substrate 92 by the dielectric member 98. Accordingly, in this embodiment as well, the same reference numerals are assigned to the same components as those shown in FIGS. 38A and 38B, and the explanations thereof will be omitted.

If making the plate-like conductors 97 and 97A be inclined with respect to the dielectric substrate 92 as in the embodiment shown in FIGS. 39A and 39B, the directivity of the antenna provided with the second antenna element 94 can be changed. For example, as shown in FIG. 39A, when the plate-like conductor 97 is inclined by exactly an angle P with respect to a line H parallel to the dielectric substrate 92, the directivity of the wave received by the second antenna element 94 can be inclined by exactly an angle Q with respect to a line V vertical to the second antenna element 94. Accordingly, by the adjustment of the inclination angle of the plate-like conductors 97 and 97A with respect to the dielectric substrate 92, the directivity of the antenna provided with the antenna element formed on the dielectric substrate 92 can be adjusted.

Figure 40A:
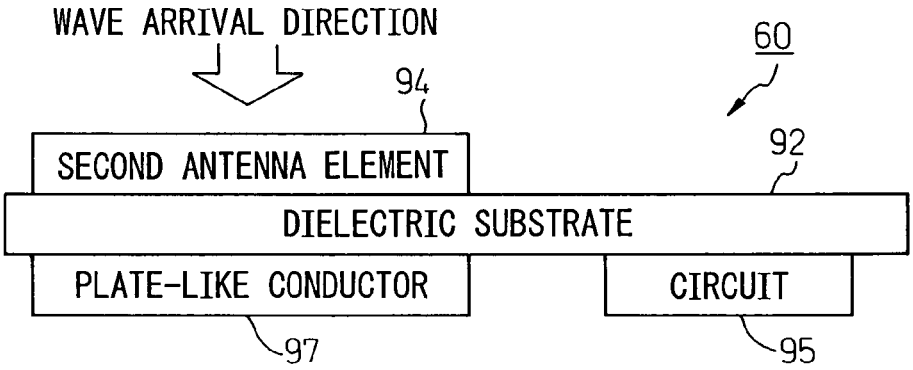
FIG. 40A is a sectional view of the configuration of a second substrate side of the composite antenna of the present invention and shows a configuration in which one antenna element is provided on the dielectric substrate and a plate-like conductor is provided on the surface on the opposite side of this substrate.
Figure 40B:
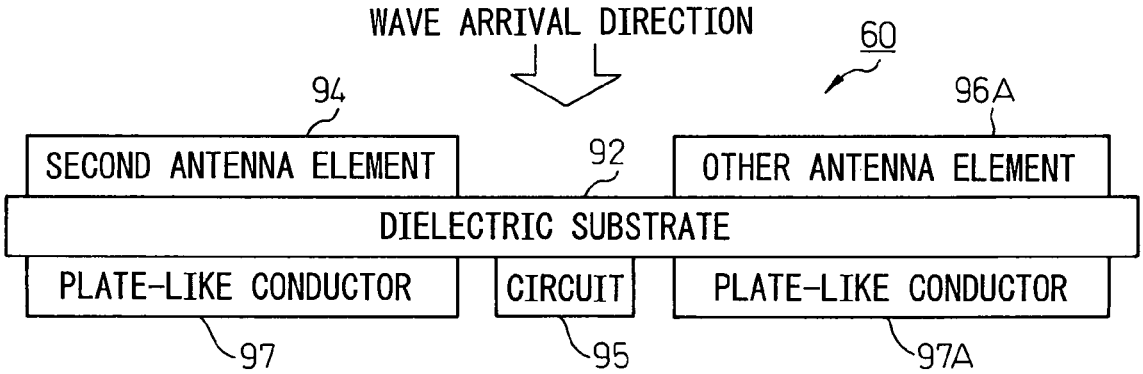
FIG. 40B is a sectional view of the configuration of a second substrate side of the composite antenna of the present invention and shows a configuration in which two antenna elements are provided on the dielectric substrate and plate-like conductors corresponding to them are provided on the surface on the opposite side of the dielectric substrate.
Figure 40C:
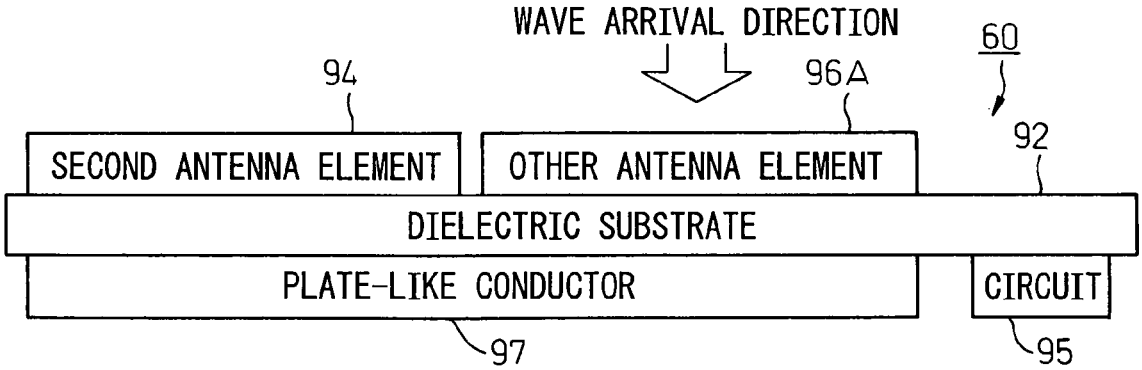
FIG. 40C is a sectional view of a configuration in which plate-like conductors of FIG. 40B are commonly integrally provided.

FIGS. 40A to 40C also show the configuration of the second substrate (dielectric substrate) 92 side of the composite antenna 60 of the present invention and show a modification of the composite antenna 60 shown in FIGS. 37A and 37B. Accordingly, the configuration of FIG. 40A corresponds to the configuration of FIG. 37A, and the configuration of FIG. 40B corresponds to the configuration of FIG. 37B. Note that, the configuration shown in FIG. 40C is a modification of the configuration shown in FIG. 40B.

The difference of the composite antenna 60 shown in FIGS. 40A and 40B from the composite antenna 60 explained in FIGS. 37A and 37B resides in only the point that the plate-like conductors 97 and 97A are directly provided on the dielectric substrate 92. Accordingly, in this embodiment as well, the same reference numerals are assigned to the same components as the components shown in FIGS. 37A and 37B, and the explanations thereof will be omitted. Further, the composite antenna 60 shown in FIG. 40C shows an embodiment in which the plate-like conductors 97 and 97A of the composite antenna 60 shown in FIG. 40B are replaced by a single plate-like conductor 97 facing both of the antenna elements 94 and 96A by shifting the position of the circuit 95.

Figure 41A:
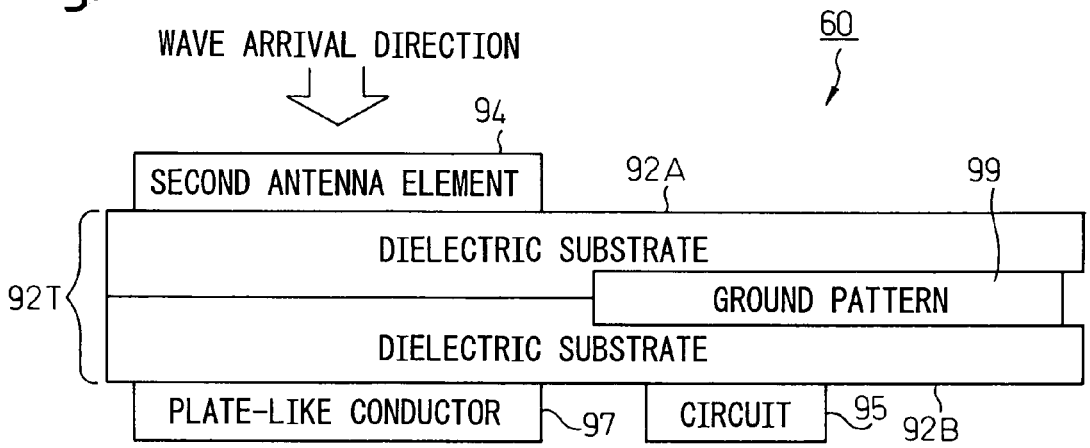
FIG. 41A is a sectional view of a configuration in a case where the dielectric substrate having the configuration shown in FIG. 40A is a multi-layer substrate.
Figure 41B:
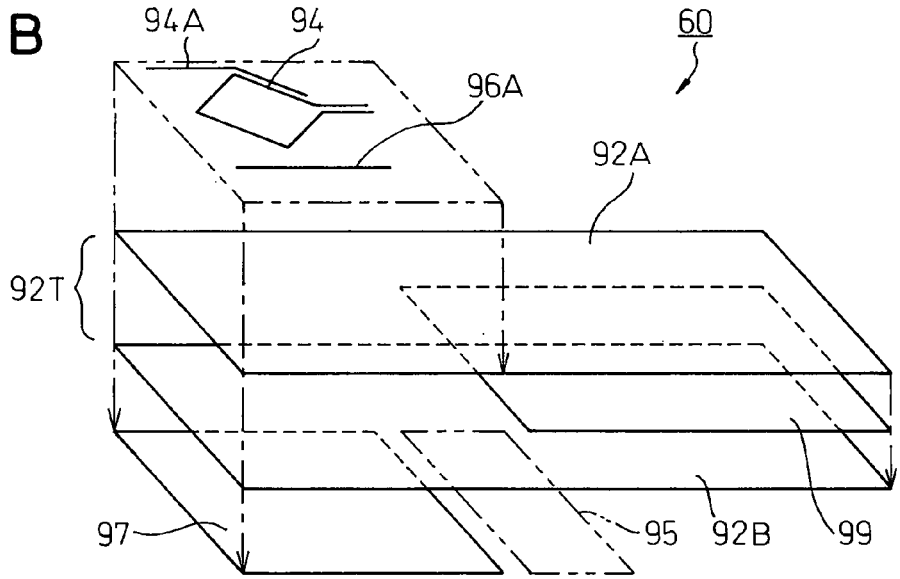
FIG. 41B is a disassembled perspective view of the configuration of FIG. 41A.

FIGS. 41A and 41B show the configuration of an embodiment in which the dielectric substrate 92 of the composite antenna 60 shown in FIG. 36 to FIG. 40 is configured by a multi-layer substrate 92T. They show only the configuration of a multi-layer dielectric substrate 92T side as the second substrate and omit the configuration of the first substrate side. In FIG. 41A, it is assumed that the other antenna element 96A is provided as shown in FIG. 41B in addition to the second antenna element 94.

The multi-layer substrate 92T is configured by the first dielectric substrate 92A, the second dielectric substrate 92B, and a ground pattern 99. The ground pattern 99 is provided at the joint portion of the first dielectric substrate 92A and the second dielectric substrate 92B, but in this embodiment, it is not provided over the entire area of the joint portion, but provided in the region of substantially half of the portion. The circuit 95 provided on one surface of the multi-layer substrate 92T is provided so that this ground pattern 99 is provided in the multi-layer substrate 92T of the portion on which this ground pattern 99 is laminated so as to be superimposed on the ground pattern 99.

The dielectric substrate is configured multi-layered and provided with such a ground pattern 99 for ensuring the stable operation of the circuit 95. Specifically, it is provided for keeping the impedance of the strip line in the circuit 95 constant at the desired value.

On the other hand, as shown in FIG. 41B, the second antenna element 94 (in this embodiment, the ETC antenna configured by the loop antenna 94 and the non-powered element 94A), the other antenna 96A (in this embodiment, the VICS antenna configured by the monopole antenna), and the plate-like conductor 97 are provided at parts of the multi-layer substrate 92T where the ground pattern 99 is not laminated. By this configuration, as shown in FIG. 41A, the arrival direction of the wave is on the second antenna element 94 side, therefore the second antenna element 94 and not illustrated other antenna element 96A can also receive the wave reflected at the plate-like conductor 97.

Figure 41C:
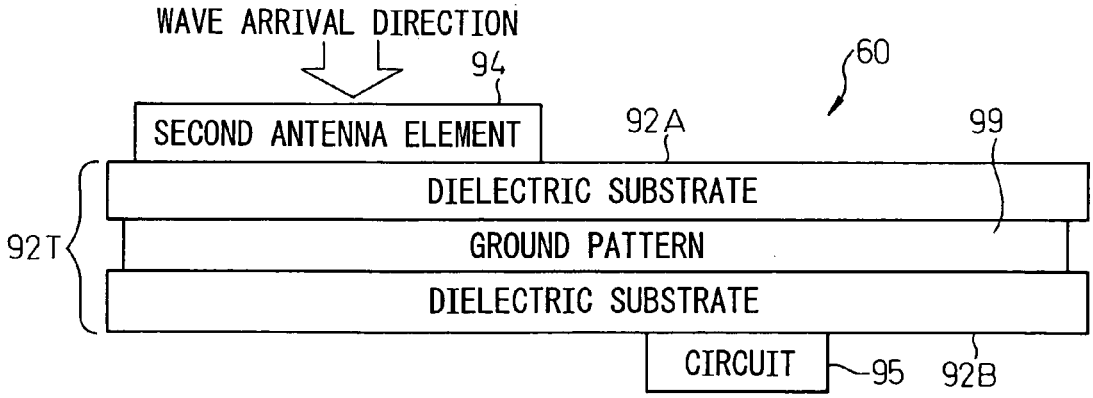
FIG. 41C is a sectional view of a configuration in a case where a ground pattern is provided on the entire surface of the dielectric multi-layer substrate of the configuration shown in FIG. 41A.

Note that, as shown in FIG. 41C, when the ground pattern 99 is provided on the entire surface of the multi-layer substrate 92T, the wave is reflected at the ground pattern 99, so the plate-like conductor 97 becomes unnecessary.

Figure 42:
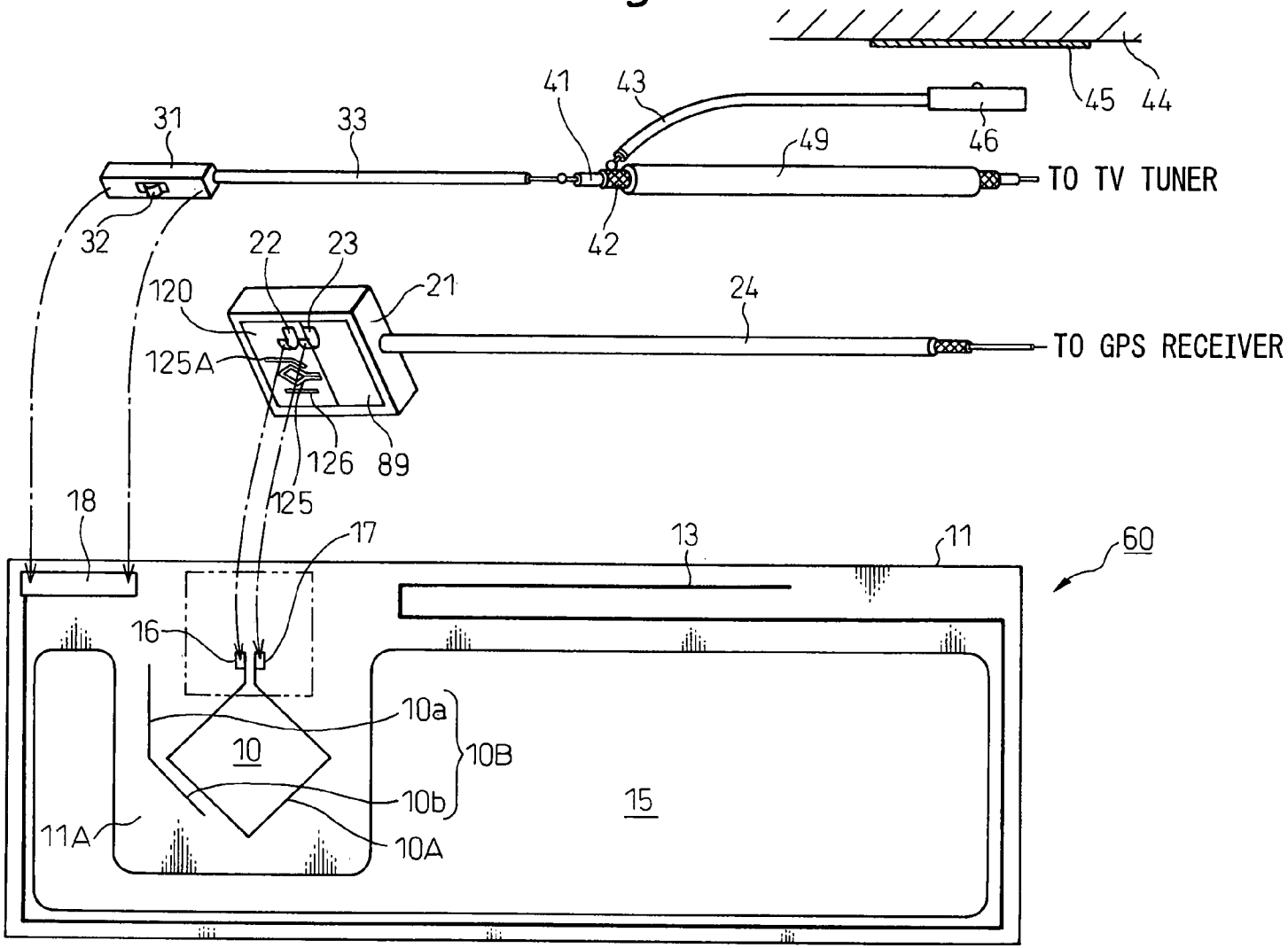
FIG. 42 is an explanatory view of the configuration of a concrete embodiment of the composite antenna of the present invention.

FIG. 42 shows the configuration of a concrete embodiment of the composite antenna 60 of the present invention. The composite antenna 60 of this embodiment is provided with a loop antenna 10A for receiving a circular polarized wave and a TV antenna 13 for receiving a television signal on a transparent film 11 made of a dielectric body. FIG. 42 is a view of the composite antenna 60 seen from the reverse direction to the arrival direction of the wave. Namely, when the composite antenna 60 is adhered to for example the inside of the windshield of an automobile, this is the view seen from the inside of the compartment of the automobile. The loop antenna 10A seen from the inside of the compartment is arranged at the left side of the transparent film 11. The loop antenna 10A is provided with the non-powered element 10B explained in detail later outside of the antenna conductor configuring the loop antenna 10A so as to transmit and receive a right-hand rotating circular polarized wave.

Further, the TV antenna 13 is provided along the periphery of the transparent film 11. The front end is bent so as to secure the length matched with the reception frequency. In this embodiment, the parts of the transparent film 11 not provided with the loop antenna 10A and the TV antenna 13 are cut away to form an aperture part 15. This aperture part 15 is provided so as to surround the part of the transparent film 11A in which the loop antenna 10A is arranged. The part of the transparent film 11A in which the loop antenna 10A is arranged is the tongue part 11A. Further, two power feed terminals 16 and 17 are provided at the two ends of the antenna element configuring the loop antenna 10A, and the antenna connection terminal 18 is provided at one end of the wire-like conductor configuring the TV antenna 13.

The coaxial cable 24 can be connected to the two power feed terminals 16 and 17 of the loop antenna 10A via the connector 21. The wave received at the loop antenna 10A is guided to a predetermined receiver, for example, the GPS receiver of the navigation system, by this coaxial cable 24. The connector 21 provided at the front end of the composite antenna 60 side of the cable 24 includes the dielectric substrate 120. In this embodiment, this dielectric substrate 120 is provided with two connection terminals 22 and 23 connected to two power feed terminals 16 and 17 of the loop antenna 10A and two antennas 125 and 126. Two connection terminals 22 and 23 are provided with a spring property in this embodiment, and a non-powered element 125A is provided in the antenna 125 adjacent to this. The connector 21 may be attached to the transparent film 11 by for example two-sided adhesive tape. The cable 24 is a coaxial cable, therefore one of power feed terminals 16 and 17 is grounded in this embodiment. The internal configuration of the connector 21 will be explained later.

The cable 33 can be connected to the antenna connection terminal 18 of the TV antenna 13. The wave received at the TV antenna 13 is guided to a not illustrated TV tuner by this cable 33 and the cable 49 connected to this. The connector 31 is connected to the front end on the composite antenna 60 side of the cable 33, and the connection terminal 32 provided on this connector 31 is connected to the antenna connection terminal 18 of the TV antenna 13. The connector 31 may be attached to the transparent film 11 by for example two-sided adhesive tape. The cable 33 is a single core cable connected to a core wire 41 of the coaxial cable 49 in this embodiment. The ground line 42 of this coaxial cable 49 is guided to part of the body 44 of the automobile by another single core cable 43 and connected to metal foil 45 adhered to this body 44 by the connector 46. Namely, the ground line 42 of the coaxial cable 44 is AC grounded to the body 44 of the automobile.

Further, the connector 21 shown in FIG. 42 is small in comparison with the transparent film 11 and in addition is attached to the upper portion of the composite antenna 60, therefore is located at the uppermost portion of the windshield 61, so the field of vision of the driver is not obstructed much at all.

Figure 43:
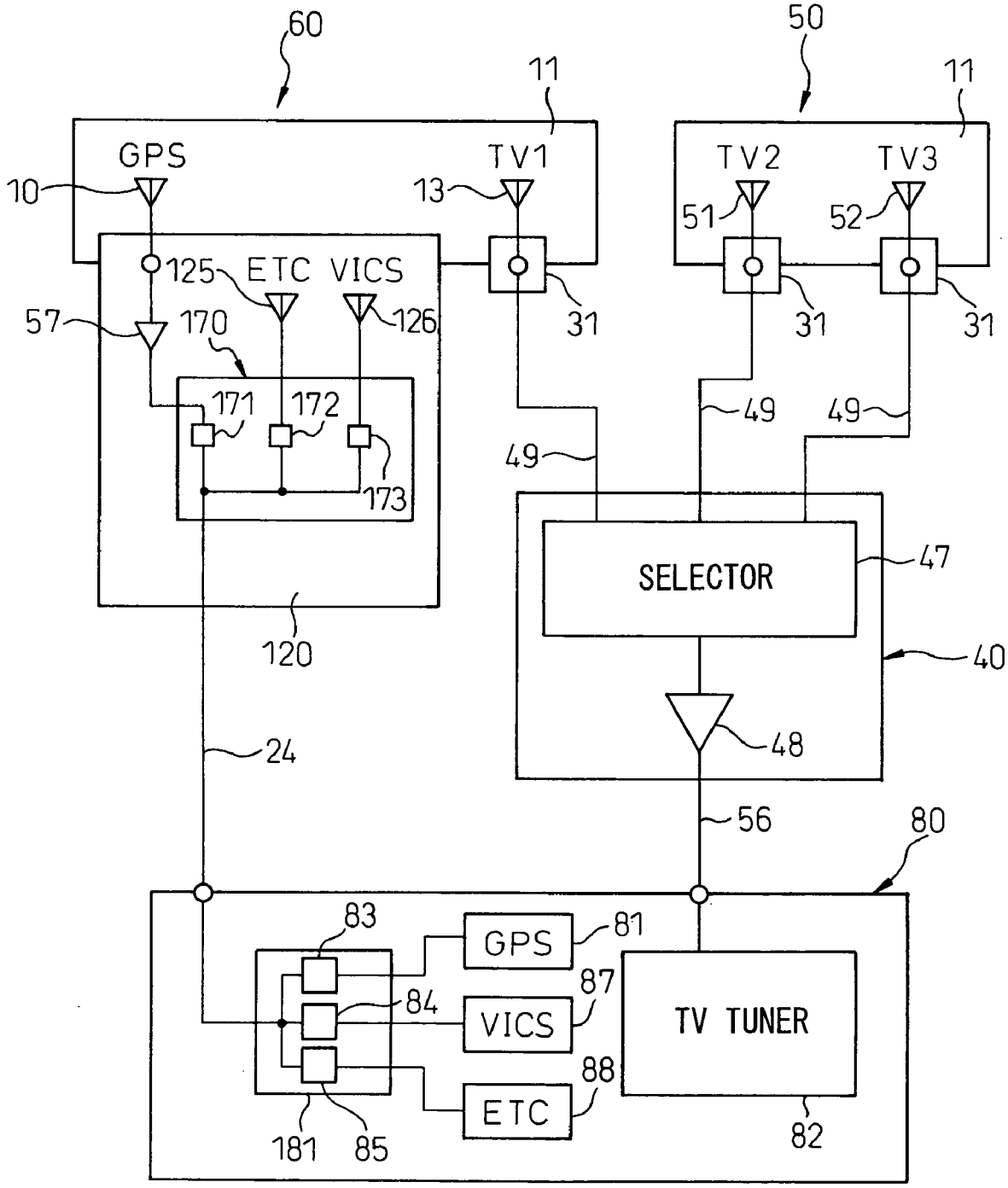
FIG. 43 is a circuit diagram of a connection configuration between the antenna and the navigation system of the composite antenna of this embodiment.

FIG. 43 is a circuit diagram showing the connection between the thin type composite antenna 60 and the thin type TV antenna 50 and the navigation system 80. The loop antenna 10A provided in the composite antenna 60 receives for example the wave of a GPS. The received wave is guided to the dielectric substrate 120 of the connector 21 as mentioned above, amplified at the amplifier 57, and then input to the combiner 170 provided on the dielectric substrate 120. The dielectric substrate 120 of the connector 21 is provided with two antennas 125 and 126 as shown in FIG. 42. The antenna 125 receives for example the ETC use wave, and the antenna 126 receives for example the wave of VICS. Also, the waves received at the antennas 125 and 126 are input to the combiner 170.

In the combiner 170, a band pass filter 171 for passing only the band of the wave used in the GPS, a band pass filter 172 for passing only the band of the wave used in the ETC, and a band pass filter 173 passing only the band of the wave used in the VICS are provided. The GPS signal passed through the amplifier 57 passes through the band pass filter 171, the ETC signal from the antenna 125 passes through the band pass filter 172, and the VICS signal from the antenna 126 is combined after passing through the band pass filter 173 and output from the combiner 170. The output signal (combined signal) from the combiner 170 passes through the cable 24 and is input to the splitter 181 built in the navigation system 80.

In the splitter 181, a band pass filter 183 for passing only the band of the wave used in the GPS, a band pass filter 184 for passing only the band of the wave used in the VICS, and a band pass filter 185 for passing only the band of the wave used in the ETC are provided. Accordingly, the combined signal is split by the band pass filters 183, 184, and 185 in the splitter 181. The GPS signal passed through the band pass filter 183 is input to the GPS receiver 186, the VICS signal passed through the band pass filter 184 is input to the VICS receiver 187, and the ETC signal passed through the band pass filter 185 is input to an ETC communicator 188. Note that, a signal for identifying the vehicle mounting the ETC communicator 188 is output from the ETC communicator 188. This signal passes through a route reverse to the above route and is emitted toward an ETC antenna arranged in a tollbooth from the ETC antenna 125.

Further, the TV antenna 13 provided in the composite antenna 60 is connected to the selector 47 of the selector/amplifier 40 by the connector 31, the cable 24 (not illustrated), and the coaxial cable 49. Further, two TV antennas 51 and 52 provided at the second film antenna 50 are connected to the selector 47 of the selector/amplifier 40 by the connectors 31, the cables 24 (not illustrated), and the coaxial cables 49. The selector 47 selects the TV antenna having a high reception sensitivity (either of the TV antennas 13, 51, and 52) and switches the TV antenna so that the output thereof is output to the amplifier 48. As a result, one of the TV antennas 13, 51, and 52 is connected to the TV tuner 82 built in the navigation system 80 through the selector/amplifier 40 and the coaxial cable 56.

Figure 44A:
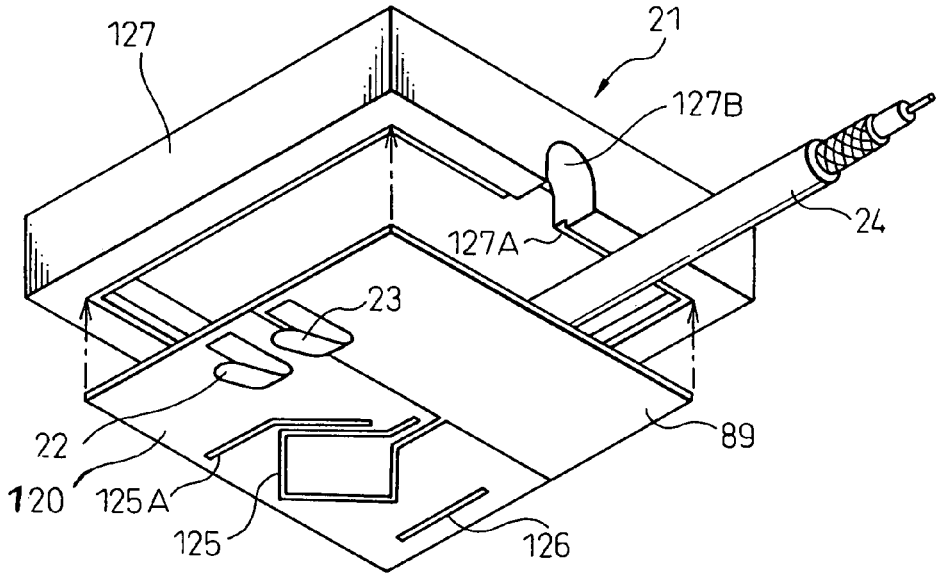
FIG. 44A is a disassembled perspective view of a concrete embodiment of a second substrate side of the composite antenna of the present invention and shows the configuration of the connector shown in FIG. 42.

FIG. 44A shows a concrete embodiment of the configuration of the connector 21 shown in FIG. 42. The connector 21 is configured with the dielectric substrate 120 attached to a case 127. On the back surface of the dielectric substrate 120 exposed at the bottom of the case 127, two connection terminals 22 and 23 connected to two power feed terminals 16 and 17 of the loop antenna 10A formed on the transparent film 11, two antennas 125 and 126, and a ground pattern 89 are provided. Two connection terminals 22 and 23 are provided with a spring property in this embodiment, and the connection terminal 23 is connected to the ground pattern 89. Further, a non-powered element 125A is provided adjacent to one side of the rectangular loop of the antenna 125. The front side of the dielectric substrate 120 accommodated in the case 127 is connected to the coaxial cable 24. The case 127 is provided with a step portion 127A in which the dielectric substrate 120 is fit, and a cable groove 127B for inserting the coaxial cable 24.

Figure 44B:
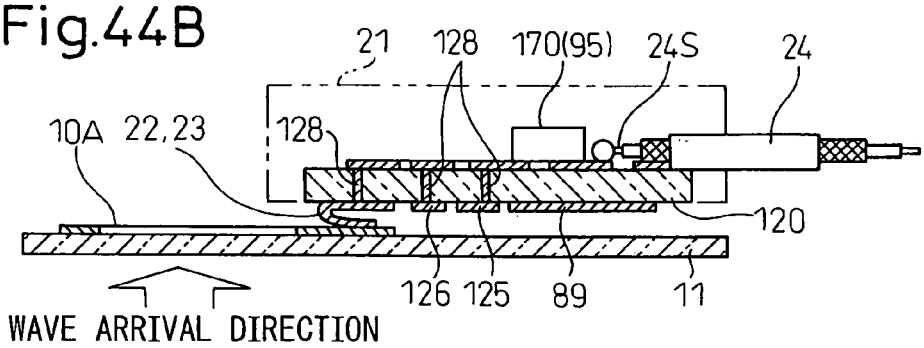
FIG. 44B is a sectional view of a state of attachment to a transparent film shown in FIG. 42 after assembly of FIG. 44A.

FIG. 44B is a sectional view showing a state where the connector 21 shown in FIG. 44A is assembled and then attached to the transparent film 11 shown in FIG. 42. Note that, this sectional view is for explaining the structure. The arrangement of the connection terminals 22 and 23 and the antennas 125 and 126 does not always coincide with the positions shown in FIG. 44A. As seen from this diagram, the loop antenna 10A provided on the transparent film 11 is connected to a combiner 170 (corresponding to the circuit 95 of FIGS. 36 to 41) through the through holes 128 provided in the connection terminals 22 and 23 and the dielectric substrate 120. Further, the antennas 125 and 126 are connected to the combiner 170 through the through hole 128 provided in the dielectric substrate 120. The output of the combiner 170 is connected to the core wire 24S of the coaxial cable 24. Note that, the ground pattern 89 provided on the back surface of the dielectric substrate 120 is provided so as to be located on the back side of the combiner 170. This is for stable operation of the combiner 170. Concretely, this is for holding the impedance of the strip line in the combiner 170 constant at the desired value.

Figure 44C:
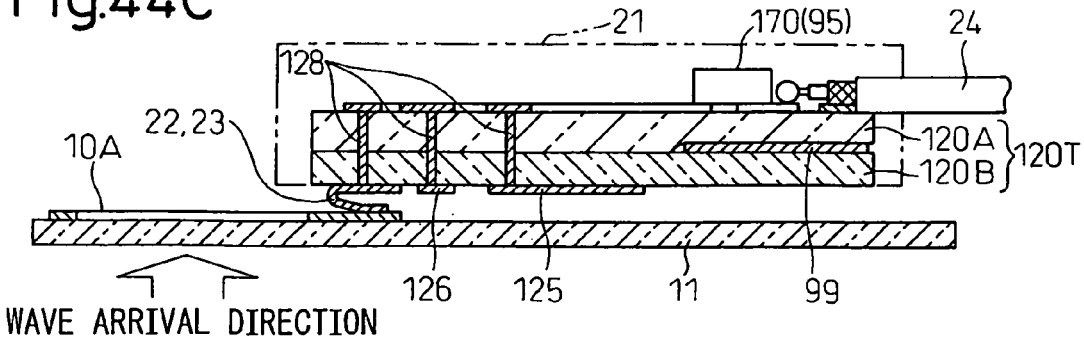
FIG. 44C is a sectional view of the configuration of an embodiment where a multi-layer substrate is used for the dielectric substrate of FIG. 44B.

FIG. 44C is a sectional view of the configuration of an embodiment of a case where a multi-layer substrate 120T is used for the dielectric substrate 120 of FIG. 44B. The multi-layer substrate 120T is formed comprised of the first dielectric substrate 120A and the second dielectric substrate 120B laminated together and a ground pattern 99 provided on the surface where the combiner 170 is provided laminated at a position overlapping the combiner 170. The rest of the configuration is the same as the configuration explained in FIG. 44B. Therefore, the same reference numerals are assigned to the same components, and the explanations thereof will be omitted.

Figure 45:
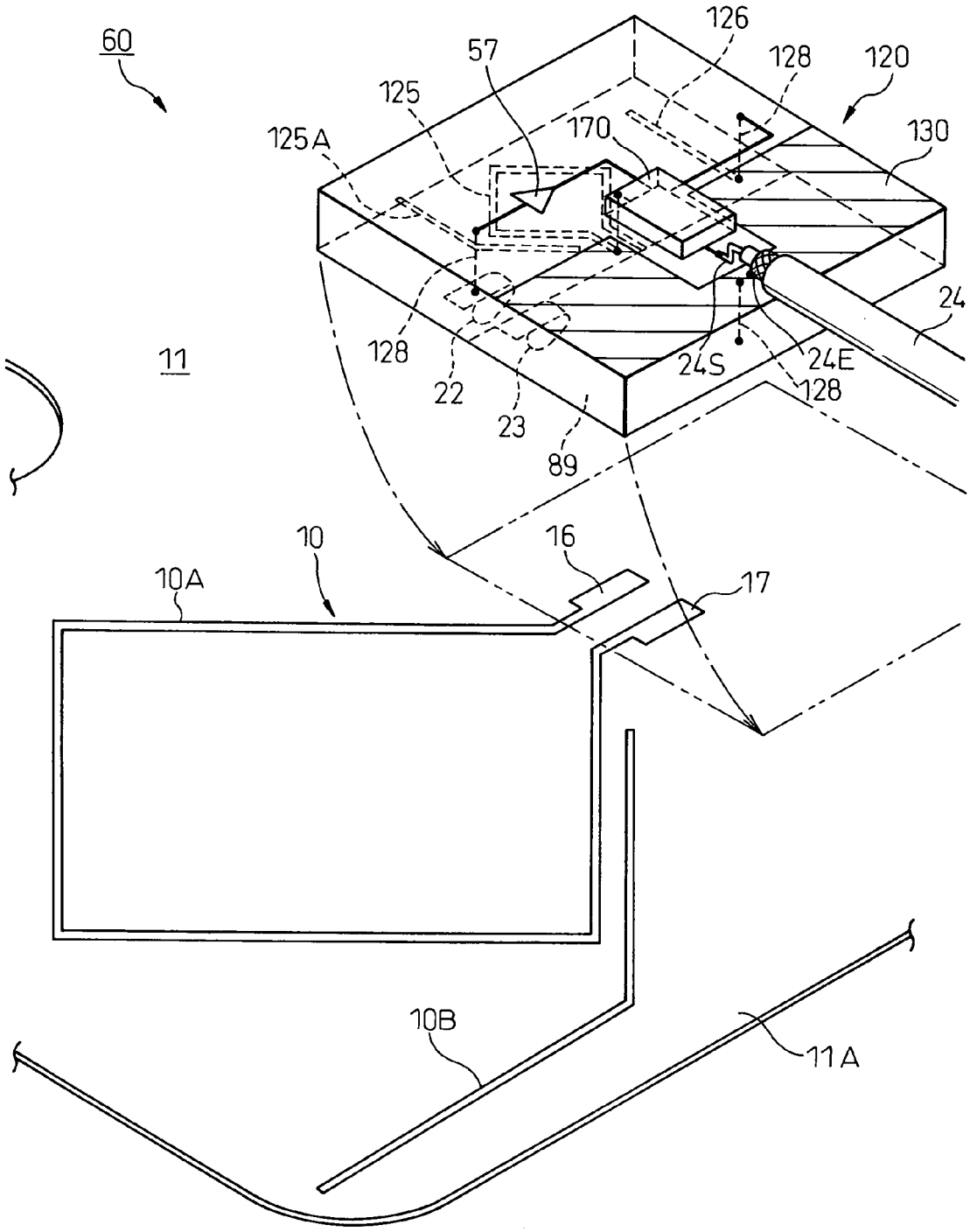
FIG. 45 is a disassembled perspective view for explaining the configuration of the connector shown in FIG. 44A and the attachment of this connector to the transparent film.

FIG. 45 shows the arrangement of the parts mounted at the front and back of the dielectric substrate 120 of the connector 21 shown in FIG. 44A and the connection position of this dielectric substrate 120 to the transparent film 11. On the front side of the dielectric substrate 120, the combiner 170 for combining the antenna outputs, a ground pattern (portion indicated by hatching) 130, and an amplifier 57 are provided and, at the same time, the coaxial cable 24 is connected. In the coaxial cable 24, the ground pattern 24E is connected to the ground pattern 130, and the core wire 24S is connected to the output terminal of the combiner 170.

The ground pattern 89 provided at the back side of the dielectric substrate 120 shown in FIG. 44A is provided at a position overlapping the combiner 170 provided at the front side. The ground pattern 89 provided at back side of the dielectric substrate 120 is connected to the front side ground pattern 130 through the through hole 128. The connection terminal 23 provided at the back side of the dielectric substrate 120 and the terminal on the ground side of the antenna 125 are connected to the ground line 24E of the coaxial cable 24 through the ground pattern 89, the through hole 128, and the ground pattern 130.

Further, the connection terminal 22 is connected through the through hole 128 and the amplifier 57 to the combiner 170, while the terminal of another power feed side of the antenna 125 is guided to the front side of the dielectric substrate 120 through the through hole 128 and connected to the combiner 170 by a conductor. In the same way as above, in the antenna 126, one end is guided to the front side of the dielectric substrate 120 through the through hole 128 and connected to the combiner 170 by a conductor.

The dielectric substrate 120 configured in this way is attached to the transparent film 11 so that the connection terminals 22 and 23 thereof are connected to the power feed terminals 16 and 17 of the loop antenna 10A formed on the transparent film 11. It is seen from this diagram that, in the state where the dielectric substrate 120 is attached to the transparent film 11, the antennas 10A, 125, and 126 are not superimposed.

As seen from this FIG. 45, the composite antenna 60 of this embodiment includes four antennas of the loop antenna 10A located on the transparent film 11, the TV antenna 13 (not illustrated), and antennas 125 and 126 on the dielectric substrate 120 of the connector 21. It is also possible to increase the number of antennas on the transparent film 11 and the number of antennas on the dielectric substrate 120 of the connector 21 more than this.

Figure 46A:
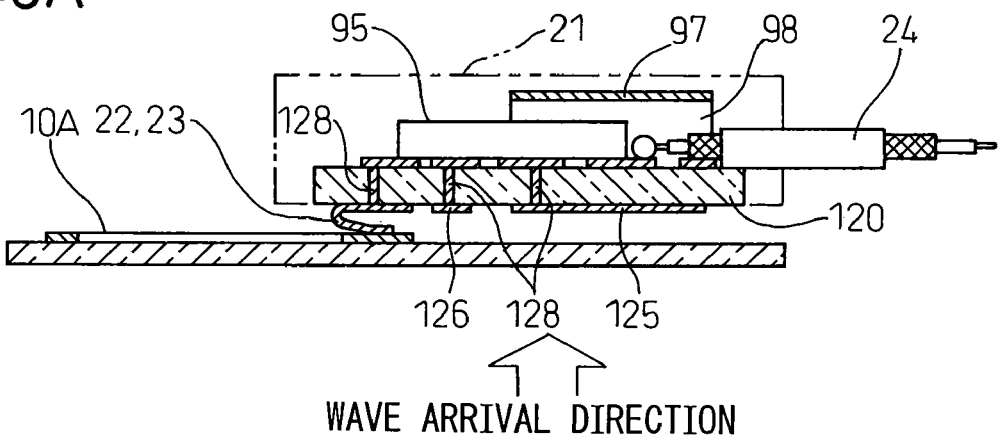
FIG. 46A is a sectional view of the configuration in a state where a reflection plate is built in the connector shown in FIG. 44B in parallel to the dielectric substrate.

FIG. 46A shows the configuration of a state where the plate-like conductor 97 serving as the reflection plate is built in the connector 21 shown in FIG. 44B parallel to the dielectric substrate 120. The plate-like conductor 97 is attached to the dielectric substrate 120 by using a dielectric member 98 such as a ceramic or plastic. The plate-like conductor 97 is provided at a position facing the antenna 125. Note that, although not illustrated, the plate-like conductor can be provided also at a portion facing the antenna 126. The rest of the configuration is the same as that of FIG.

44B, so the same reference numerals are assigned to the same components, and the explanations thereof will be omitted.

Figure 46B:
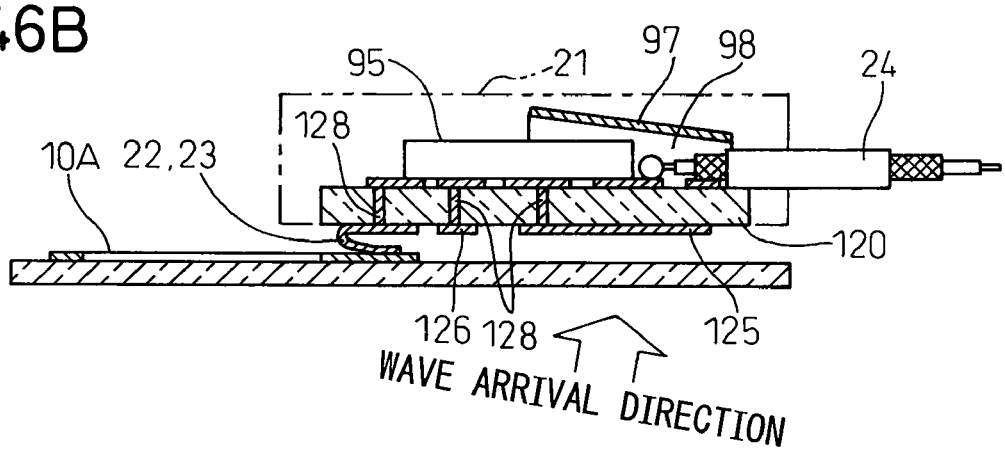
FIG. 46B is a sectional view of the configuration in a state where a reflection plate is built in the connector shown in FIG. 44B while being inclined from the dielectric substrate.

FIG. 46B shows the configuration in which the plate-like conductor 97 serving as the reflection plate is built in the connector 21 shown in FIG. 44B in the state inclined with respect to the dielectric substrate 120. The plate-like conductor 97 can be attached inclined with respect to the dielectric substrate 120 by using a dielectric member 98 such as a ceramic or plastic. The plate-like conductor 97 is provided inclined at a position facing the antenna 125. Note that, although not illustrated, the plate-like conductor can be provided inclined also at the portion facing the antenna 126. The rest of the configuration is the same as that of FIG. 44B, so the same reference numerals are assigned to the same components, and the explanations thereof are omitted. In this configuration, if the plate-like conductor 97 is inclined with respect to the dielectric substrate 120 and made vertical with respect to the arrival direction of the wave, the reception sensitivity of the antenna 125 becomes good.

As shown in FIG. 46B, by adjusting the inclination angle of the plate-like conductor 97, as shown in FIG. 34, when the composite antenna 60 is attached to the windshield 61 of the automobile 100, the directivity of the composite antenna 60 can be made the direction X or the direction Z with respect to the direction of the vertical line Y extending from the composite antenna 60.

In the embodiments explained above, the reception by the composite antenna 60 according to the present invention was explained, but the exact same is also true for the case where a wave is transmitted from the composite antenna 60 explained above.

Further, in the embodiments explained above, the explanation was given of film antennas 20 and 20M in which the circular polarization antennas 10 and 10M were formed on the transparent film 11 and adhered to the back surface of the windshield 61 of an automobile, but the circular polarization antennas 10 and 10M can be formed on a usual printed board or opaque dielectric body like the surface of a plastic case as well. Such an embodiment can be effectively applied to an appliance having a communication function and using a circular polarized wave as the communication wave, for example, for wireless connection between a personal computer and its peripherals by a circular polarized wave, for a portable terminal, etc.

While the invention has been described with reference to specific embodiments chosen for purpose of illustration, it should be apparent that numerous modifications could be made thereto by those skilled in the art without departing from the basic concept and scope of the invention.

What is claimed is:

1. A circular polarization antenna comprising:

an antenna conductor; and a non-powered element arranged near the antenna conductor and configured by a conductor arranged independently from said antenna conductor, wherein said antenna conductor is configured to receive a component of a circular polarized wave and said non-powered element is configured to receive a different component of the circular polarized wave and to apply said different component to said antenna conductor.

2. A circular polarization antenna as set forth in claim 1, wherein a plurality of non-powered elements are arranged near the antenna conductor.

3. A circular polarization antenna as set forth in claim 1, wherein said antenna conductor forms a loop antenna.

4. A circular polarization antenna as set forth in claim 3, wherein said non-powered element is configured by a first part arranged close to said antenna conductor and a second part arranged electrically connected to said first part, and said first part is arranged in a state substantially parallel with respect to at least one part of said antenna conductor.

5. A circular polarization antenna as set forth in claim 3, wherein the loop antenna includes a loop antenna power feed point and a loop antenna opposite pole, the loop antenna opposite pole being opposite the loop antenna power feed point, and wherein said non-powered element includes a component parallel to a line connecting the loop antenna power feed point and the loop antenna opposite pole.

6. A circular polarization antenna as set forth in claim 4, wherein a distance between the second part of said non-powered element and said antenna conductor becomes larger nearer to a front end of said second part.

7. A circular polarization antenna as set forth in claim 4, wherein the second part of said non-powered element is bent with respect to said first part, and the bending direction of said second part is towards said antenna conductor with respect to an imaginary extended line of said first part.

8. A circular polarization antenna as set forth in claim 3, wherein said non-powered element is located on at least one side of a dividing line substantially equally dividing said loop antenna to two.

9. A circular polarization antenna as set forth in claim 3, wherein an auxiliary conductor parallel to said non-powered element is arranged on the opposite side with respect to said loop antenna of said non-powered element.

10. A circular polarization antenna as set forth in claim 3, further comprising a substantially straight second auxiliary conductor that contacts an imaginary circle having the same center as the loop antenna, the second auxiliary conductor being provided near the outside of said loop antenna so as to function as a waveguide or reflector.

11. A circular polarization antenna as set forth in claim 3, wherein one of two power feed terminals of said loop antenna is grounded.

12. A circular polarization antenna as set forth in claim 3, wherein a balance input terminal of a balance/imbalance conversion circuit is connected to two power feed terminals of said loop antenna.

13. A circular polarization antenna as set forth in claim 1, wherein said antenna conductor forms a monopole antenna having a power feed point and a free end.

14. A circular polarization antenna as set forth in claim 13, wherein an axial line of the antenna of said monopole antenna and an axial line of said non-powered element are arranged in orthogonal directions.

15. A circular polarization antenna as set forth in claim 13, wherein said non-powered element is provided with a power transfer part capable of transferring power to said monopole antenna, and said non-powered element is arranged near said free end of said monopole antenna.

16. A circular polarization antenna as set forth in claim 15, wherein said power transfer part is one end of said non-powered element arranged substantially parallel adjacent to said free end of said monopole antenna.

17. A circular polarization antenna as set forth in claim 15, wherein at least a part having a predetermined length from the free end of said monopole antenna is bent to form said power transfer part.

18. A circular polarization antenna as set forth in claim 13, further comprising a second non-powered element made of a wire-shaped conductor to function as a waveguide or the reflector.

19. A circular polarization antenna as set forth in claim 18, wherein said second non-powered element is configured so that an imaginary line, located substantially at the center position thereof and orthogonal to said second nonpowered element, passes through substantially the center of the circular polarization antenna having said monopole antenna and said non-powered element.

20. A circular polarization antenna as set forth in claim 18, wherein said second non-powered element is part of a second antenna.

21. A circular polarization antenna as set forth in claim 1, wherein said non-powered element has a length of ½ or more of the wavelength of the wave of the reception frequency of said circular polarization antenna.

22. A circular polarization antenna as set forth in claim 1, wherein the antenna conductor has a length of substantially one wavelength of the wave received at said circular polarization antenna.

23. A circular polarization antenna as set forth in claim 1, wherein said non-powered element is arranged on a same plane on which said antenna conductor is arranged.

24. A circular polarization antenna as set forth in claim 1, wherein said antenna conductor and said non-powered element are formed by same conductor foil.

25. A circular polarization antenna as set forth in claim 1, wherein said antenna conductor and said non-powered element are formed on a flexible sheet-like dielectric body.

26. A circular polarization antenna as set forth in claim 25, further comprising:

an adhesive layer arranged on a first surface of said sheet-like dielectric body, wherein said antenna conductor and said non-powered element are arranged on a second surface of said sheet-like dielectric body.

27. A circular polarization antenna as set forth in claim 26, further comprising:

a protective layer for protecting said antenna conductor and said non-powered element, wherein said protective layer and said non-powered element are arranged on the second surface of said sheet-like dielectric body.

28. A circular polarization antenna as set forth in claim 27, wherein at least said antenna conductor and said non-powered element are covered by said protective layer.

29. A circular polarization antenna as set forth in claim 25, wherein said sheet-like dielectric body is constituted by a transparent insulation film, and the film is arranged on an outer member constituted by glass or an insulator of an automobile.

30. A circular polarization antenna as set forth in claim 1, wherein said antenna conductor and said non-powered element are arranged on an outer member constituted by glass or an insulator of an automobile.

31. A circular polarization antenna as set forth in claim 29, wherein said circular polarization antenna is provided at a windshield at a side facing a driver's seat of an automobile.

32. A circular polarization antenna as set forth in claim 25, wherein a plurality of circular polarization antennas are arranged on said sheet-like dielectric body.

33. A circular polarization antenna as set forth in claim 32, wherein said sheet-like dielectric body is provided with a cut part which enables said plurality of circular polarization antennas to be individually separated.

34. A circular polarization antenna as set forth in claim 10, wherein said second auxiliary conductor is part of another antenna.

35. A composite antenna comprising:

an antenna conductor;

a non-powered element arranged near said antenna conductor and arranged independently from said antenna conductor;

a flexible sheet-like dielectric body at which said antenna conductor and said non-powered element are formed; and a second antenna arranged on a same plane as the plane of arrangement of said antenna conductor at said sheet-like dielectric body, wherein said antenna conductor is configured to receive a component of a circular polarized wave and said non-powered element is configured to receive a different component of the circular polarized wave for applying said different component to said antenna conductor.

36. A composite antenna as set forth in claim 35, wherein a cut part enabling separation of a circular polarization antenna comprised of said antenna conductor and said non-powered element is provided in said sheet-like dielectric body.

37. A composite antenna as set forth in claim 36, wherein said second antenna is at least one of an antenna for receiving TV waves, an antenna for receiving radio waves, an antenna for transmitting and/or receiving keyless entry system signals of an automobile, an antenna for transmitting and/or receiving signals used in an anti-car jack system, and an antenna for transmitting and/or receiving signals used in a remote engine starter system.

38. A composite antenna as set forth in claim 35, wherein a plurality of additional antennas are arranged at said sheet-like dielectric body, and power feed terminals of a circular polarization antenna comprised of said linear polarization antenna and said non-powered element are arranged between power feed terminals of said plurality of additional antennas.

39. A composite antenna as set forth in claim 35, wherein said second antenna is formed by the same conductor foil as that of said antenna conductor or said non-powered element.

40. A composite antenna as set forth in claim 35, wherein said sheet-like dielectric body is arranged at a position where said antenna conductor and said second antenna are arranged.

41. An antenna to which a signal line is connected, comprising:

a dielectric body at which an antenna element is arranged;

at least one antenna element arranged on said dielectric body;

a power feed terminal formed on said dielectric body and connected to said antenna element; and a mark formed at the periphery of said power feed terminal of said dielectric body for indicating a connection position of said signal line, wherein the mark is not electrically connected to said signal line.

42. An antenna as set forth in claim 41, wherein when said signal line is connected to said power feed terminal, said mark is arranged in a state where it is equally exposed at a position surrounding said signal line.

43. An antenna as set forth in claim 41, wherein when said signal line is connected to said power feed terminal, said mark is hidden by said signal line, while when said signal line is connected such that said signal line is shifted with respect to said power feed terminal, said mark is arranged in a state where part thereof can be viewed while protruding from said signal line.

44. An antenna as set forth in claim 41, wherein said mark is formed by the same conductive member as the conductive member constituting said antenna element and/or said power feed terminal.

45. An antenna as set forth in claim 44, wherein said conductive member is a conductive ink or a conductive foil.

46. An antenna as set forth in claim 41, wherein said mark is a short line or a set of short lines.

47. An antenna as set forth in claim 41, wherein said mark is constituted by small holes formed on said dielectric body.

48. An antenna as set forth in claim 41, wherein said antenna element is a circular polarization antenna configured by an antenna conductor and a non-powered element arranged near said antenna conductor and constituted by a conductor arranged independently from the antenna conductor constituting said antenna conductor.

49. An antenna to which a signal line is connected, comprising:

a dielectric body at which an antenna element is arranged;

at least one antenna element arranged at said dielectric body;

a protective film for covering the top of said dielectric body;

a power feed terminal formed on said dielectric body, to which said antenna element is connected, and whose electrode portions are exposed from said protective film; and a protective sheet adhered to said dielectric body so as to cover said electrode portions of said power feed terminal and detachable from the top of said dielectric body, wherein said signal line being connected to said power feed terminal in a state where part of said protective sheet is peeled off from said power feed terminal.

50. An antenna as set forth in claim 49, wherein said protective sheet is provided with a cut part for positioning said signal line, and said protective sheet is temporarily attached to said dielectric body in a state where said cut part corresponds to the connection position of said signal line onto said dielectric body.

51. An antenna as set forth in claim 50, wherein said cut part is separated from said protective sheet.

52. An antenna as set forth in claim 50, wherein said protective sheet indicates an attachment position for said signal line when said signal line is connected to said dielectric body.

53. An antenna as set forth in claim 49, wherein said antenna element is a circular polarization antenna having an antenna conductor and a non-powered element arranged near the antenna conductor and arranged independently from said antenna conductor.

54. A composite antenna provided with a plurality of antennas, comprising:

a first antenna element:

a first substrate having said first antenna element formed thereon;

a second substrate provided with a circuit electrically connected to said first antenna element;

a second antenna element provided on a first surface of the second substrate, and a first plate-like conductor arranged on a second surface of the second substrate without clearance and facing the second antenna element.

55. A composite antenna as set forth in claim 54, wherein said second substrate is a dielectric substrate.

56. A composite antenna as set forth in claim 54, further comprising:

an antenna element other than said second antenna element formed on the first surface of said second substrate, and a second plate-like conductor arranged on the second surface of said second substrate facing said antenna element.

57. A composite antenna as set forth in claim 55, wherein one surface of said dielectric substrate is the surface of a wave arrival direction.

58. A composite antenna as set forth in claim 54, further comprising a dielectric member provided between said first plate-like conductor and said second substrate.

59. A composite antenna as set forth in claim 56, wherein said first plate-like conductor and said second plate-like conductor are integrated to be one plate-like conductor.

60. A composite antenna as set forth in claim 56, wherein said second substrate is configured by a multi-layer substrate, said second antenna element is formed on the front surface of said multi-layer substrate, said second plate-like conductor is formed on the back surface of said multi-layer substrate, and a ground pattern of said circuit is formed at an intermediate layer of said multi-layer substrate.

61. A composite antenna as set forth in claim 55, further comprising:

a combiner provided in said dielectric substrate for combining signals received at said first antenna element formed on said first substrate with signals received at said second antenna element formed on said second substrate.

62. A composite antenna as set forth in claim 54, wherein at least one of said first and second antenna elements is a circular polarization antenna.

63. A composite antenna as set forth in claim 54, wherein said first antenna element has a power feed terminal and said second substrate is provided in a connector connected to the power feed terminal of said first antenna element for outputting signals received at said first antenna element from the composite antenna.

64. A composite antenna as set forth in claim 62, wherein said circular polarization antenna is configured by an antenna conductor and a non-powered element provided near said antenna conductor and arranged independently from the antenna conductor, wherein said antenna conductor is configured to receive a component of a circular polarized wave and said non-powered element is configured to receive a different component of the circular polarized wave for applying said different component to said antenna conductor.

65. An antenna apparatus comprising:

a circular polarization antenna provided with an antenna conductor and a non-powered element arranged near the antenna conductor and arranged independently from said antenna conductor;

a flexible sheet-like dielectric body on which said antenna conductor and said non-powered element are formed;

a power feed terminal formed on said dielectric body and connected to said antenna conductor; and a signal line connected to said power feed terminal for outputting signals received at said circular polarization antenna from the antenna apparatus, wherein said antenna conductor is configured to receive a component of a circular polarized wave and said non-powered element is configured to receive a different component of the circular polarized wave for applying said different component to said antenna conductor.

66. An antenna apparatus as set forth in claim 65, further comprising an amplification unit for amplifying received signals.

67. An antenna apparatus having a composite antenna comprising:

a linear polarization antenna provided with an antenna conductor, a non-powered element arranged near the antenna conductor and arranged independently from said antenna conductor, and a power feed terminal;

a flexible sheet-like dielectric body on which said antenna conductor and said non-powered element are formed;

a second antenna arranged on a same plane as the plane of arrangement of said antenna conductor on said sheet-like dielectric body; and a signal line connected to said power feed terminal of said linear polarization antenna for outputting signals received at said linear polarization antenna from the antenna apparatus, wherein said antenna conductor is configured to receive a component of a circular polarized wave and said non-powered element is configured to receive a different component of the circular polarized wave for applying said different component to said antenna conductor.

68. An antenna apparatus having an antenna comprising:

an antenna element having a power feed terminal;

a dielectric body on which said antenna element is arranged;

a signal line connected to the power feed terminal of said antenna element for outputting signals received at said antenna element from the antenna apparatus; and a mark formed on said dielectric body around said power feed terminal for indicating a connection position of said signal line.

69. An antenna apparatus having a composite antenna comprising:

a first antenna element;

a first substrate having said first antenna element formed thereon, where the first antenna element has a power feed terminal;

a second substrate provided with a circuit electrically connected to the first antenna element;

a second antenna element provided on a first surface of the second substrate;

a first plate-like conductor arranged on a second surface of said second substrate without clearance and facing said second antenna element; and a signal line connected to the power feed terminal of said first antenna element for outputting signals received at said first antenna element from the antenna apparatus.

70. An antenna apparatus having a composite antenna comprising:

a circular polarization antenna provided with an antenna conductor and a non-powered element arranged near the antenna conductor and arranged independently from said antenna conductor, wherein said antenna conductor has a first power feed terminal;

a flexible sheet-like dielectric body at which said antenna conductor and said non-powered element are formed;

a second antenna element arranged on a same plane as the plane of arrangement of said antenna conductor at said sheet-like dielectric body, wherein said second antenna element has a second power feed terminal;

a first signal line connected to the first power feed terminal of said antenna conductor for outputting signals received at said circular polarization antenna from the antenna apparatus; and a second signal line connected to the second power feed terminal of said second antenna element for outputting signals received at said second antenna element from the antenna apparatus, wherein said antenna conductor is configured to receive a component of a circular polarized wave and said non-powered element is configured to receive a different component of the circular polarized wave for applying said different component to said antenna conductor.

71. An antenna apparatus as set forth in claim 70, wherein said second antenna element is for receiving a TV signal, a plurality of such antennas are arranged, and a selector able to select an antenna able to receive TV signals well from among said plurality of antennas is provided.

72. A reception apparatus comprising:

a circular polarization antenna provided with an antenna conductor and a non-powered element arranged near the antenna conductor and arranged independently from said antenna conductor;

a flexible sheet-like dielectric body at which said antenna conductor and said non-powered element are formed;

a power feed terminal formed on said dielectric body and connected to said antenna conductor;

a signal line connected to said power feed terminal for outputting signals received at said circular polarization antenna from the reception apparatus, wherein said antenna conductor is configured to receive a component of a circular polarized wave and said non-powered element is configured to receive a different component of the circular polarized wave for applying said different component to said antenna conductor.

73. A reception apparatus as set forth in claim 72 further comprising:

a receiver for processing signals from said signal line, wherein said receiver is a navigation system.

* * * * *